US007490567B2

(12) United States Patent
Sakuma

(10) Patent No.: US 7,490,567 B2
(45) Date of Patent: Feb. 17, 2009

(54) SEAM PUCKERING PREVENTING SHUTTLE DEVICE OF SEWING MACHINE

(75) Inventor: Kouichi Sakuma, Yamagata (JP)

(73) Assignee: Suzuki Manufacturing, Ltd. (JP)

( * ) Notice: Subject to any disclaimer, the term of this patent is extended or adjusted under 35 U.S.C. 154(b) by 372 days.

(21) Appl. No.: 10/571,921

(22) PCT Filed: Dec. 27, 2004

(86) PCT No.: PCT/JP2004/019550

§ 371 (c)(1),
(2), (4) Date: Mar. 15, 2006

(87) PCT Pub. No.: WO2005/071153

PCT Pub. Date: Aug. 4, 2005

(65) Prior Publication Data

US 2007/0095263 A1 May 3, 2007

(30) Foreign Application Priority Data

Jan. 26, 2004 (JP) ..... 2004-017648
Mar. 15, 2004 (JP) ..... 2004-072293
Oct. 26, 2004 (JP) ..... 2004-311467

(51) Int. Cl.
*D05B 57/14* (2006.01)
*D05B 57/00* (2006.01)

(52) U.S. Cl. ..... 112/181

(58) Field of Classification Search ..... 112/181, 112/231, 232, 182, 185, 187–190, 228
See application file for complete search history.

(56) References Cited

U.S. PATENT DOCUMENTS 3,693,566 A 9/1972 Ketterer ..... 112/184

(Continued)

FOREIGN PATENT DOCUMENTS

JP 49-19427 5/1974

(Continued)

*Primary Examiner*—Ismael Izaguirre
(74) *Attorney, Agent, or Firm*—Bacon & Thomas, PLLC

(57) ABSTRACT

A puckering preventing shuttle device of a sewing machine capable of providing high quality stitches without producing puckering by eliminating needle thread extraction resistance on the outer periphery of a rotating hook bobbin case holder to reduce the tension of a needle thread so as to keep a balance between the needle thread and a bobbin thread and also enabling the proper tightening of the threads even in an extra-soft fabric. The device comprises the rotating hook bobbin case holder (80) storing a bobbin case storing a bobbin around which the bobbin thread is wrapped and detachably fixed to a machine frame and locked to the machine frame by rotating hook bobbin case holder stopper (90) to stop its rotation and a rotating hook (70) in which the rotating hook bobbin case holder (80) is installed, having a sword tip (75), and rotated by a lower shaft. A needle thread inlet (EN1) and a needle thread outlet (EX1) are formed at circumferentially different positions between the rotating hook bobbin case holder stopper (90) and the rotating hook bobbin case holder (80) where the loop of the needle thread picked up by the sword tip (75) for each rotation of the rotatingly driven rotating hook (70) forms a clearance for guiding in and out the needle thread on the outer periphery of the rotating hook bobbin case holder (80) by eccentrically disposing the rotating center (O1) of the rotating hook (70) relative to the rotating center of the lower shaft.

25 Claims, 65 Drawing Sheets

U.S. PATENT DOCUMENTS

| | | | | | |
|---|---|---|---|---|---|
| 3,921,551 | A * | 11/1975 | Gustmann et al. | ..... | 112/181 |
| 4,142,475 | A | 3/1979 | Zocher | ..... | 112/181 |
| 4,483,264 | A * | 11/1984 | Ketterer | ..... | 112/231 |
| 4,527,494 | A * | 7/1985 | Herron et al. | ..... | 112/231 |
| 6,745,712 | B1 * | 6/2004 | Fujinaga et al. | ..... | 112/181 |
| 6,799,527 | B2 * | 10/2004 | Kato | ..... | 112/232 |

FOREIGN PATENT DOCUMENTS

| | | | |
|---|---|---|---|
| JP | 53-119153 | | 10/1978 |
| JP | 53-125151 | | 11/1978 |
| JP | 54-98358 | | 7/1979 |
| JP | 57-13316 | | 3/1982 |
| JP | 57-44358 | | 9/1982 |
| JP | 63-115591 | | 5/1988 |
| JP | 3-27470 | | 3/1991 |
| JP | 3-54704 | | 3/1991 |
| JP | 05-269283 | | 10/1993 |
| JP | 61-149196 | | 7/1996 |
| JP | 2655623 | | 9/1997 |
| JP | 11-107157 | | 4/1999 |
| JP | 11-226284 | | 8/1999 |
| JP | 2603135 | | 2/2000 |
| JP | 2002-143588 | | 5/2002 |
| WO | 00/73556 | A1 | 12/2000 |

* cited by examiner

Fig. 16
(a)
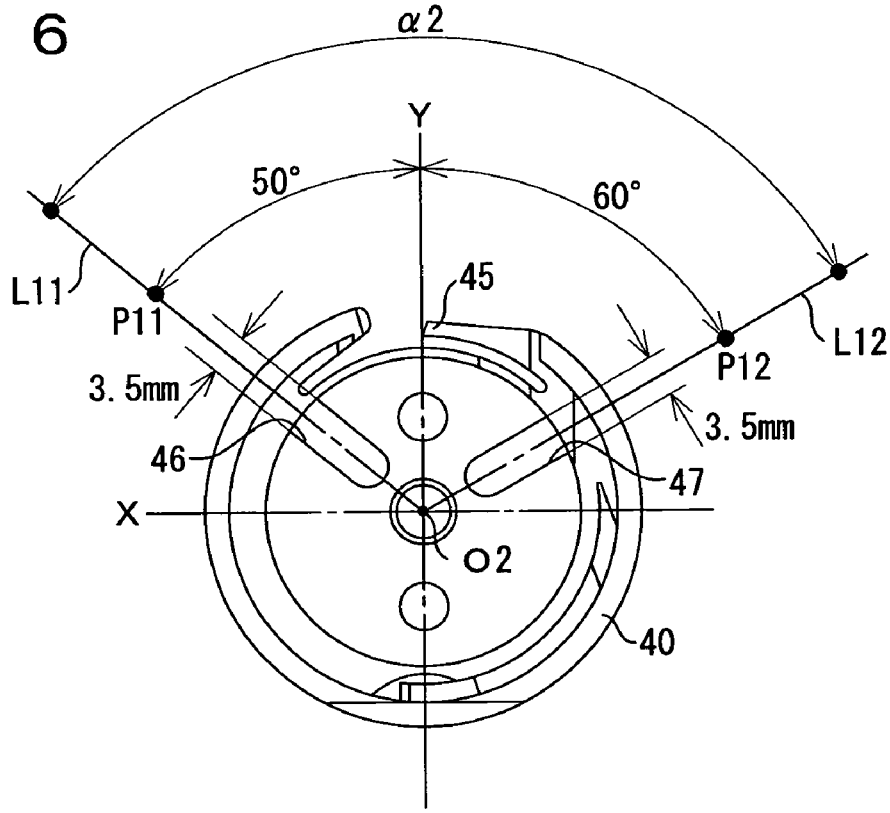
(b)
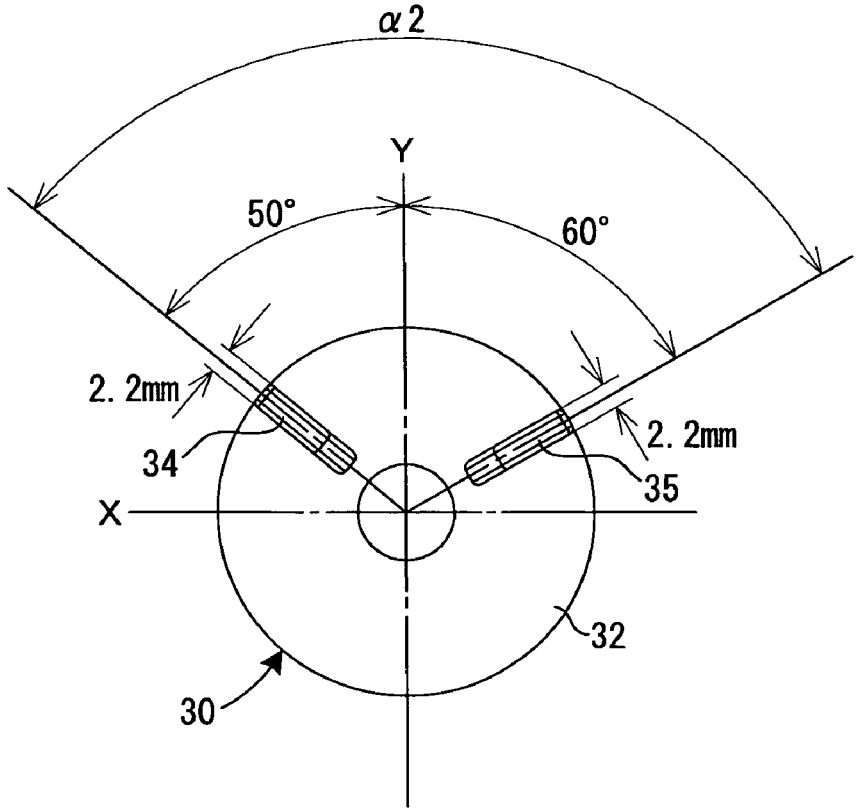

SEAM PUCKERING PREVENTING SHUTTLE DEVICE OF SEWING MACHINE

TECHNICAL FIELD

The present invention relates to a seam puckering preventing shuttle device of a sewing machine and, more particularly, to a seam puckering preventing shuttle device of a sewing machine, in which an upper thread extraction from a rotation hook at the time of guiding in and out an upper thread on the rotation hook is performed smoothly without any resistance thereby to prevent the seam puckering.

BACKGROUND ART

In the prior art, in an industrial or home lock stitch sewing machine using a full rotation hook, either a shuttle bobbin having a lower thread wound thereon or a shuttle bobbin case accommodating the bobbin is mounted in an inner hook, and the inner hook or an outer hook is equipped with a loop-taker point. The hook having the loop-taker point is rotated to guide in the upper thread inserted into a needle so that the upper thread is picked up by the loop-taker point and the upper thread and the lower thread may be interlaced to form lock stitches in a work.

In the case of an outer hook rotation type having the loop-taker point in the outer hook, for example, the inner hook has to be fixed by an abutment between an inner hook groove formed in the inner hook and an inner hook stopper disposed at a frame. Since the inner hook is fixed although the outer hook is rotated at a high speed, the abutment between the inner hook stopper and the inner hook groove is made in a high rotation-friction torque. When the upper thread is guided out from the hook, it is obliged to push the abutment and guide out when it is taken up by a thread take-up lever. As a result, the upper thread is subjected to a far higher inner hook extraction tension than the intrinsically necessary thread pulling tension by the thread take-up lever. This make it impossible to stabilize the interlace point between the upper thread and the lower thread at the time when the upper thread and the lower thread are interlaced to form the lock stitches in the work, so that the seam puckering is caused in the work by the high upper thread tension.

In the case of an outer hook rotation type horizontal hook, therefore, a rotation hook device (as referred to Patent Publication 1, for example) is proposed which is provided with an opener, which rocks at a predetermined timing according to the rotation of an outer hook, and a stopper plate which is attached to the opener and can alternately engage with stopper grooves formed in the inner hook. The stopper plate is extracted from one of the stopper grooves, when the upper thread passes through the stopper groove, and the other stopper groove is brought into engagement to stop the rotation of the inner hook.

There is proposed an opener (as referred to Patent Publication 2, for example), in which the upper thread is guided out from the outer hook by forcibly opening the abutment between the inner hook stopper and the inner hook groove.

There is further proposed an opener driving mechanism (as referred to Patent Publication 3, for example), which can be attached to a general-purpose horizontal hook of a sewing machine and equipped with an opener for rotating an inner hook oppositely to the rotating direction of the outer hook thereby to reduce the rattling noises between the engaging projection of the inner hook and the retaining member of the throat plate.

Those hook device using the opener has drawbacks of complicated mechanisms and serious noises. There is further proposed a full rotation hook (as referred to Patent Publication 4 or Patent Publication 5, for example), in which the inner hook is equipped with a loop-taker point and in which a driver axis is eccentric to the rotation center of the inner hook.

There is also known a fine thread split preventing full rotation hook device (as referred to Patent Publication 6 or Patent Publication 7), in which a needle thread is prevented, when extracted or guided out from the inner hook, from becoming wild, thereby to avoid the piercing of the needle thread by the needle or the shortage of the thread.

Patent Publication 1: JP-A-61-149196;
Patent Publication 2: JP-A-63-115591;
Patent Publication 3: JP-A-2002-143588;
Patent Publication 4: Domestic Re-publication of PCT Patent application: 2000/73556
Patent Publication 5: JP-A-11-226284
Patent Publication 6: JP-A-53-119153
Patent Publication 7: JP-A-53-125151

DISCLOSURE OF THE INVENTION

Problems that the Invention is to Solve

In the rotation hook device for a sewing machine, as disclosed in Patent Publication 1 of Background Art, the hook shaft, in which the rotational movement from a lower shaft hinged horizontally for rotations is vertically transmitted and converted, is equipped on its one end with an eccentric cam, from which the rocking motions are transmitted to the opener. Therefore, the device is limited to the horizontal hook, and the opener driving mechanism is so complicated as not to stand a high-speed run and to raise the price.

On the other hand, the opener of the hook in the sewing machine disclosed in Patent Publication 2 in Background Art has a complicated mechanism for pushing to open the abutment portion between the inner hook stopper and the inner hook grooves forcibly at the rotating time, and has a defect the clearance is hard to form according to the varying speed of the sewing machine.

In the opener driving mechanism of the horizontal hook, as disclosed in Patent Publication 3 in Background Art, the cam shaft to be decelerated from the hook shaft is provided so that the rocking motions generated by the cam driven by the cam shaft are transmitted through the rotating shaft and the opener link. The opener drive mechanism is limited to the horizontal hook, and the opening driving mechanism is so complicated that it cannot stand the high-speed run and that its cost is high.

In the full rotation hook, as disclosed in Patent Publication 4 in Background Art, the driver rotation axis of the hook is made eccentric with respect to the rotation axis of the inner hook so that the torque to be transmitted from the driver to the inner hook is periodically varied to pass the needle thread loosely at the instant of a low torque. By the resilient deformation of the spring member, however, the driver is brought into and out of abutment against the inner hook. As the case may be, there is a difficulty that the tension for the needle thread extraction cannot be completely released.

In the full rotation hook, as disclosed in Patent Publication 5 in Background Art, the driver rotation axis of the hook is made so eccentric with respect to the rotation axis of the inner hook that the eccentric direction is set in the direction closer to the loop-taker point. There arises a difficulty that the clearance for the upper thread extraction is difficult to form in accordance with the varying speed of the sewing machine.

The full rotation hook, as disclosed in Patent Publication 6 or Patent Publication 7 in Background art, is moved to rock up and down and to the right and left due to the center deflection due to the eccentricity of the inner hook and the outer hook thereby to form a clearance between the retaining portion of the inner hook and the projection of the hook support, so that the upper thread is extracted through that clearance. Because of the improper positioning of the retaining portion of the inner hook, however, there arise difficulties that the upper thread cannot be guided in the inner hook, and that the upper thread cannot be extracted without any resistance from the inner hook.

In these rotation hooks, the upper thread is subjected by a thread take-up lever to a far higher inner hook extraction tension than the intrinsically necessary thread pulling tension so that the interlace point between the upper thread and the lower thread cannot be stabilized at a interlaced point when the upper thread and the lower thread are interlaced to form lock stitches in the work. Especially in the work of thin cloth such as cloths for cotton shirts or woman's wear georgette, the seam puckering due to the wearing shrinkage or wearing wrinkles occurs unless the upper thread and the lower thread are set to a weak tension. In this case, there is a drawback in that the sewing tension cannot be set lower than the inner hook extraction tension so that the normal stitches cannot be formed. In the lock stitch sewing machine, it is a permanent object to prevent that seam puckering phenomenon.

Therefore, the invention has been conceived to eliminate those difficulties of the prior art. A first object of the invention is to provide a seam puckering preventing shuttle device of a sewing machine, which is enabled, by making an inner hook eccentric to an outer hook rotation driving portion, to eliminate the upper thread extraction resistance on the outer circumference of the inner hook, to lower the upper thread tension thereby to balance the upper and lower threads and to make the tightening of threads proper even for an extremely thin cloth, so that the seam puckering can be eliminated to form seams of high quality.

A second object of the invention is to provide a seam puckering preventing shuttle device of a sewing machine, which is enabled, by making an inner hook driven portion eccentric to an inner hook rotation driving portion, to eliminate the upper thread extraction resistance on the outer circumference of the inner hook, to lower the upper thread tension thereby to balance the upper and lower threads and to make the tightening of threads proper even for an extremely thin cloth, so that the seam puckering can be eliminated to form seams of high quality.

A third object of the invention is to provide a seam puckering preventing shuttle horizontal device of a sewing machine, which is enabled, by making an inner hook accommodating a shuttle bobbin and prevented from rotating by an inner hook stopper with respective to a frame, eccentric to an outer hook rotation driving portion, to eliminate the upper thread extraction resistance on the outer circumference of the inner hook, to lower the upper thread tension thereby to balance the upper and lower threads and to make the tightening of threads proper even for an extremely thin cloth, so that the seam puckering can be eliminated to form seams of high quality.

A fourth object of the invention is to provide a seam puckering preventing shuttle device of a sewing machine, which is enabled, by arranging an outer hook concentric with an outer hook rotation driving portion by causing the reciprocating movements of inner hook stopper in the radial direction of the axial direction of a rotation driving portion in synchronism with the rotation of the rotation driving portion, and by forming an upper thread entrance/exit between the inner hook stopper and the inner hook, to eliminate the upper thread extraction resistance, to lower the upper thread tension thereby to balance the upper and lower threads and to make the tightening of threads proper even for an extremely thin cloth, so that the seam puckering can be eliminated to form seams of high quality.

Means for Solving Problems

In order to achieve those objects, according to the invention, there is provided a seam puckering preventing shuttle device of a sewing machine, which uses an upper thread inserted into a needle moving upward and downward while drawing a trace vertically of a throat plate, and a lower thread accommodated in a full rotation hook, which is disposed below the throat plate and accommodates the lower thread, and which picks up the upper thread, at the time when the upper thread inserted into the needle extending through a work placed on the throat plate and performing reciprocating movements in the vertical direction is raised from the lower dead center of the needle for each feed of the work, with a loop-taker point of the full rotation hook to interlace the upper thread and the lower thread thereby to form lock stitches in the work.

According to a first aspect of the seam puckering preventing shuttle device of a sewing machine of the invention: the full rotation hook includes: an inner hook accommodating a shuttle bobbin having the lower thread wound thereon and fixed removably, and prevented from rotating relative to the frame by an inner hook stopper; and an outer hook mounting the inner hook, having the loop-taker point and rotated by a rotation driving portion; the inner hook is arranged to have its rotation center eccentric to the rotation center of the rotation driving portion so that an upper thread entrance and an upper thread exit are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven was pulled out to the maximum by the outer circumference of the inner hook; the upper thread entrance is arranged at the position where the loop of the upper thread picked up by the loop-taker point is guided in on the outer circumference of the inner hook whereas the upper thread exit is arranged at the position where the loop of the upper thread is guided out on the outer circumference of the inner hook and pulled upward of the throat plate; the upper thread entrance and the upper thread exit are arranged at an angular space of 120 degrees to 160 degrees, preferably 120 degrees to 180 degrees; and the rotation center of the inner hook is eccentric in the direction at the angular space between the upper thread entrance and the upper thread exit with respect to the rotation center of the rotation driving portion.

According to a second aspect of the seam puckering preventing shuttle device of a sewing machine of the invention: the full rotation hook includes: an inner hook accommodating a shuttle bobbin case accommodating a shuttle bobbin having the lower thread wound thereon and removably fixed, and prevented from rotating relative to the frame by an inner hook stopper; and an outer hook mounting the inner hook therein, having the loop-taker point and rotated by a rotation driving portion; the inner hook is arranged to have its rotation center eccentric to the rotation center of the rotation driving portion so that an upper thread entrance and an upper thread exit are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven was pulled out to the maximum by the outer circumference of the inner hook; the upper thread entrance is arranged at the position where the loop of the upper thread picked up by the loop-taker point is guided in on the outer circumference of the inner hook whereas the upper thread exit is arranged at the position where the loop of the upper thread is guided out on the outer circumference of the inner hook and pulled upward of the throat plate; the upper thread entrance and the upper thread exit are arranged at an angular space of 120 degrees to 160 degrees, preferably 120 degrees to 180 degrees; and the rotation center of the inner hook is eccentric in the direction at the angular space between the upper thread entrance and the upper thread exit with respect to the rotation center of the rotation driving portion.

In the full rotation hooks of the first and second aspects, the angular space between the upper thread inlet and the upper thread exit is the 120 to 160 degrees, preferably 110 degrees to 180 degrees in place of the 120 to 180 degrees, or preferably 150 degrees to 170 degrees.

According to a third aspect of the seam puckering preventing shuttle device of a sewing machine of the invention: the full rotation hook includes: an inner hook accommodating a shuttle bobbin having the lower thread wound thereon and fixed removably, having a loop-taker point and rotationally driven by a rotation driving portion; and an outer hook mounting the inner hook rotatably therein and prevented from rotating with respect to a frame; the inner hook includes two driven portions arranged at circumferential different positions, and two driving portions individually loosely fitted on the driven portions for driving the inner hook to rotate; the inner hook is arranged to have its rotation center eccentric to the rotation center of the rotation driving portion so that, when the driving portion and the driven portion of one pair are in the driving state to drive the inner hook to rotate, the driving portion and the driven portion of the other pair form clearances, before the loop of the upper thread is pulled to the maximum by the loop-taker point of the inner hook, for guiding in and out the loop of the upper thread on the side of the driving portions of the inner hook; the upper thread entrance is arranged at the phase where the loop of the upper thread picked up by the loop-taker point is guided in on the outer circumference of the inner hook whereas the upper thread exit is arranged at the phase where the loop of the upper thread is guided out on the outer circumference of the inner hook and pulled upward of the throat plate; the upper thread entrance and the upper thread exit are arranged at an angular space of 90 degrees to 130 degrees at circumferentially different positions across the upper dead center of the loop-taker point; and the rotation center of the driven portions is eccentric, in the direction backward of the upper dead center of the loop-taker point, with respect to the rotation center of the rotation driving portion.

According to a fourth aspect of the seam puckering preventing shuttle device of a sewing machine of the invention: the full rotation hook includes: an inner hook accommodating a shuttle bobbin case accommodating a shuttle bobbin having the lower thread wound thereon and removably fixed, and having the loop-taker point and driven to rotate by a rotation driving portion; and an outer hook mounting the inner hook rotatably therein and prevented from rotating with respect to a frame; the inner hook includes two driven portions arranged at circumferential different positions, and two driving portions individually loosely fitted on the driven portions for driving the inner hook to rotate; the inner hook is arranged to have its rotation center eccentric to the rotation center of the rotation driving portion so that, when the driving portion and the driven portion of one pair are in the driving state to drive the inner hook to rotate, the driving portion and the driven portion of the other pair form clearances, before the loop of the upper thread is pulled to the maximum by the loop-taker point of the inner hook, for guiding in and out the loop of the upper thread on the side of the driving portions of the inner hook; the upper thread entrance is arranged at the phase where the loop of the upper thread picked up by the loop-taker point is guided in on the outer circumference of the inner hook whereas the upper thread exit is arranged at the phase where the loop of the upper thread is guided out on the outer circumference of the inner hook and pulled upward of the throat plate; the upper thread entrance and the upper thread exit are arranged at an angular space of 90 degrees to 130 degrees at circumferentially different positions across the upper dead center of the loop-taker point; and the rotation center of the driven portions is eccentric, in the direction backward of the upper dead center of the loop-taker point, with respect to the rotation center of the rotation driving portion.

In the full rotation hooks of the third and fourth aspects, the driven portions are individually formed of a grove or hole extending a predetermined length in the circumferential direction or in a radial direction whereas the driving portions are made of projections extending a predetermined length in the circumferential direction.

According to a fifth aspect of the invention, there is provided a seam puckering preventing horizontal shuttle device of a sewing machine, which uses an upper thread inserted into a needle moving upward and downward while drawing a trace vertically of a throat plate, and a lower thread accommodated in a full rotation horizontal hook, which is disposed below the throat plate and accommodates the lower thread, and which picks up the upper thread, at the time when the upper thread inserted into the needle extending through a work placed on the throat plate and performing reciprocating movements in the vertical direction is raised from the lower dead center of the needle for each feed of the work, with a loop-taker point of the full rotation horizontal hook to interlace the upper thread and the lower thread thereby to form lock stitches in the work.

According to the fifth aspect of the seam puckering preventing shuttle device of a sewing machine of the invention: the full rotation horizontal hook includes: an inner hook accommodating a shuttle bobbin having the lower thread wound thereon and fixed removably, and prevented from rotating relative to the frame by an inner hook stopper; and an outer hook mounting the inner hook therein, having the loop-taker point and rotated by a rotation driving portion; the inner hook is arranged to have its rotation center eccentric to the rotation center of the rotation driving portion so that an upper thread entrance and an upper thread exit are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven was pulled out to the maximum by the outer circumference of the inner hook; the upper thread entrance is arranged in a rotational direction of 180 degrees to 210 degrees, preferably 180 degrees of the loop-taker point from the needle drop point of the needle and at the position where the loop of the upper thread picked up by the loop-taker point is guided in on the outer circumference of the inner hook, whereas the upper thread exit is arranged in a rotational direction of 90 degrees to 180 degrees, preferably 110 degrees from the upper thread entrance and at the position where the loop of the upper thread is guided out on the outer circumference of the inner hook and pulled upward of the throat plate; and the rotation center of the inner hook is eccentric in the direction at the angular space between the upper thread entrance and the upper thread exit with respect to the rotation center of the rotation driving portion.

In the full rotation horizontal hook of the fifth aspect, the inner hook includes a shuttle bobbin support pin erected at the center of an upward diverging housing portion for holding the bobbin, so that the bobbin may be prevented from being rotationally inscribed with the inner hook to rewind the lower thread from the bobbin, and so that the bobbin may be prevented from being rotationally inscribed with the housing portion to float.

According to a sixth aspect of the seam puckering preventing shuttle device of a sewing machine of the invention: the full rotation hook includes: an inner hook accommodating a shuttle bobbin having the lower thread wound thereon and fixed removably, and prevented from rotating by an inner hook stopper; and an outer hook mounting the inner hook therein, having the loop-taker point and rotated by a rotation driving portion; the outer hook is arranged to have its rotation center concentric with the rotation driving portion and includes an inner hook stopper driving portion for moving the inner hook stopper reciprocally in synchronism with the rotation of the rotation driving portion and in the radial direction of the axial direction of the rotation driving portion to hold the inner hook, so that two upper thread entrances and upper thread exits are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven was pulled out to the maximum by the outer circumference of the inner hook; the upper thread entrance is arranged at the position where the loop of the upper thread picked up by the loop-taker point is guided in on the outer circumference of the inner hook whereas the upper thread exit is arranged at the position where the loop of the upper thread is guided out on the outer circumference of the inner hook and pulled upward of the throat plate; and the upper thread entrance and the upper thread exit are arranged at an angular space of 110 degrees to 180 degrees, preferably 150 degrees to 170 degrees.

According to a seventh aspect of the seam puckering preventing shuttle device of a sewing machine of the invention: the full rotation hook includes: an inner hook accommodating a shuttle bobbin case accommodating a shuttle bobbin having the lower thread wound thereon and removably fixed, and prevented from rotating relative to the frame by an inner hook stopper; and an outer hook mounting the inner hook therein, having the loop-taker point and rotated by a rotation driving portion; the outer hook is arranged to have its rotation center concentric with the rotation driving portion and includes an inner hook stopper driving portion for moving the inner hook stopper reciprocally in synchronism with the rotation of the rotation driving portion and in the radial direction of the axial direction of the rotation driving portion to hold the inner hook, so that two upper thread entrances and upper thread exits are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven was pulled out to the maximum by the outer circumference of the inner hook; the upper thread entrance is arranged at the position where the loop of the upper thread picked up by the loop-taker point is guided in on the outer circumference of the inner hook whereas the upper thread exit is arranged at the position where the loop of the upper thread is guided out on the outer circumference of the inner hook and pulled upward of the throat plate; and the upper thread entrance and the upper thread exit are arranged at an angular space of 110 degrees to 180 degrees, preferably 150 degrees to 170 degrees.

In the first to seventh aspects of the seam puckering preventing shuttle device of a sewing machine of the invention, when the tension of the upper thread is to be balanced with the tension of the lower thread to be guided out from the shuttle bobbin accommodated in the full rotation hook thereby to stabilize the interlace point between the upper thread and the lower thread, the upper thread is inserted from a spool through a thread deflection preventing conduit and a thread tension balancing device into the needle thereby to fix the thread tension of the thread tension balancing device, so that the pulsations of the upper thread, as might otherwise be caused by taking or pulling up the upper thread by a thread take-up lever when the upper thread is guided in and out the full rotation hook, may be suppressed.

In the first to seventh aspects of the seam puckering preventing shuttle device of a sewing machine of the invention, when the work is advanced stitch by stitch by a feed dog by clamping the work on the throat plate between a presser foot and the feed dog, and by taking up the upper thread by a thread take-up lever for guiding in and out the upper thread the full rotation hook, the feed dog is one formed through the center of a needle drop hole of the needle for advancing the work stitch by stitch by clamping the work having seams with the presser foot, and has a width two times to four times, preferably 2.5 times to 3.5 times as large as the diameter of the needle drop hole.

In the first to seventh aspects of the seam puckering preventing shuttle device of a sewing machine of the invention, when the work is advanced stitch by stitch by a feed dog by clamping the work on the throat plate between a presser foot and the feed dog, and by taking up the upper thread by a thread take-up lever for guiding in and out the upper thread the full rotation hook, at the deceleration from the feeding speed for the work having the seams to advance while being clamped on the feed dog by the presser foot, the work may not be brought by an inertia to slide into the clearance to be formed between the throat plate and the presser foot raised by the feed dog and may not be loosened by the cloth feed more than a necessary amount for one stitch, because the presser foot is equipped at an entrance portion thereof for the work with a resilient member for always contacting with the work before sewn.

Advantage of the Invention

According to the seam puckering preventing shuttle device of the sewing machine of the invention, the rotation center of the inner hook is arranged eccentrically of the rotation driving portion, and there are formed the upper thread entrance and exit are formed to arrange such clearances at circumferentially difference positions of the full rotation hook as guides in and out the outside the inner hook the loop of the upper thread picked up by the loop-taker point for each rotation of the rotationally driven hook. As a result, the extraction resistance of the upper thread of the outer circumference of the inner hook can be eliminated to reduce the upper thread tension so that the balance between the upper and lower threads can be taken properly to prevent the seam puckering.

According to the seam puckering preventing shuttle device of the sewing machine of the invention, moreover, the inner hook is arranged concentrically of the outer hook rotation driving portion, and the inner hook stopper is reciprocally moved in synchronism with the rotation of the rotation driving portion and radially of the axial direction of the rotation driving portion thereby to form the upper thread entrance and exit between the inner hook stopper and the inner hook. As a result, the extraction resistance of the upper thread of the outer circumference of the inner hook can be eliminated to reduce the upper thread tension so that the balance between the upper and lower threads can be taken properly to prevent the seam puckering.

According to the seam puckering preventing shuttle device of the sewing machine of the invention, moreover, the upper thread is inserted from the spool through the thread deflection preventing conduit and the thread tension balancing device into the needle thereby to fix the thread tension balance of the thread tension balancing device. As a result, the tension of the upper thread for suppressing the pulsations of the upper thread when guiding in and out the upper thread on the full rotation hook by taking or pulling up the upper thread by the thread take-up lever is balanced by the tension of the lower thread let off from the bobbin accommodated in the full rotation hook, so that the interlace point between the upper thread and the lower thread can be stabilized at the interlaced point to prevent the seam puckering.

According to the seam puckering preventing shuttle device of the sewing machine of the invention, moreover, the feed dog is one extending through the center of the needle drop hole of the needle for advancing the work having the seam stitch by stitch while holding it with the presser foot. The feed dog has a width predetermined times as large as the diameter of the needle drop hole thereby to hold the work on the throat plate between the presser foot and the feed dog. As a result, the cloth can be stably fed when the upper thread is guided in and out on the full rotation hook by taking or pulling up the upper thread by the thread take-up lever and when the work is advanced for each stitch of the work by the feed dog, so that the seam puckering can be prevented.

According to the seam puckering preventing shuttle device of the sewing machine of the invention, moreover, the presser foot is equipped at the entrance portion thereof for the work with the resilient member for always contact with the work before sewn. When the work is advanced stitch by stitch by a feed dog by clamping the work on the throat plate between a presser foot and the feed dog, and by taking up the upper thread by a thread take-up lever for guiding in and out the upper thread the full rotation hook, at the deceleration from the feeding speed for the work having the seams to advance while being clamped on the feed dog by the presser foot, the work may not be brought by an inertia to slide into the clearance to be formed between the throat plate and the presser foot raised by the feed dog and may not be loosened by the cloth feed more than a necessary amount for one stitch, thereby to prevent the seam puckering.

According to the seam puckering preventing shuttle device of the sewing machine of the invention, moreover, the tension of the upper thread is balanced by the tension of the lower thread let off from the shuttle bobbin accommodated in the full rotation hook. As a result, the interlace point between the upper thread and the lower thread can be stabilized at the interlaced point, so that thin cloth such as cloths for cotton shirts or woman's wear georgette can be sewn without any seam puckering due to the wearing shrinkage or wearing wrinkles.

In case the seam puckering preventing shuttle device of the sewing machine of the invention is applied to the full rotation horizontal hook, the inner hook has the bobbin support pin erected at the center of the housing portion for holding the shuttle bobbin, so that the shuttle bobbin may be prevented from being rotationally inscribed with the inner hook to rewind the lower thread from the shuttle bobbin, and so that the shuttle bobbin may be prevented from being rotationally inscribed with the upward diverging housing portion accommodating the shuttle bobbin to float.

BRIEF DESCRIPTION OF THE DRAWINGS

FIG. 5I An action explaining diagram showing an action state of the outer-hook-loop-taker-point type full rotation hook of FIG. 1.

FIG. 14I An action explaining diagram showing an action state of the inner-hook-loop-taker-point type full rotation hook of FIG. 11.

FIG. 16 Diagrams showing a specific example of the inner-hook-loop-taker-point type full rotation hook of FIG. 11. (a) an explanatory diagram of the arranged state of an inner hook first driven portion and an inner hook second driven portion of the inner hook, and (b) an explanatory diagram of the arranged state of an inner hook driving first projection and an inner hook driving second projection of the inner hook driving member.

FIG. 23I An action explaining diagram showing an action state of the outer-hook-loop-taker-point type full-rotation horizontal rotation hook of FIG. 20.

FIG. 29I An action explaining diagram showing an action state of the outer-hook-loop-taker-point type full rotation hook of FIG. 26.

BEST MODE OF THE INVENTION

An example of the best mode for carrying out a seam puckering preventing shuttle device of a sewing machine of the invention is described with reference to the accompanying drawings.

The sewing machine, to which the full rotation hook device of the invention is applied, is provided with a lock stitch forming mechanism for forming lock stitches, which are composed of stitches parallel to and stitches perpendicular to the face of a work.

This lock stitch forming mechanism has a well-known structure (as disclosed in JP-A-49-117148, JP-A-52-154448, JP-A-53-108547, JP-A-54-60052, JP-A-54-110049, JP-A-55-35676, JP-A-55-113490, JP-A-55-146190, JP-A-56-3091 and so on), so that its detailed explanation is omitted.

Figure 4:
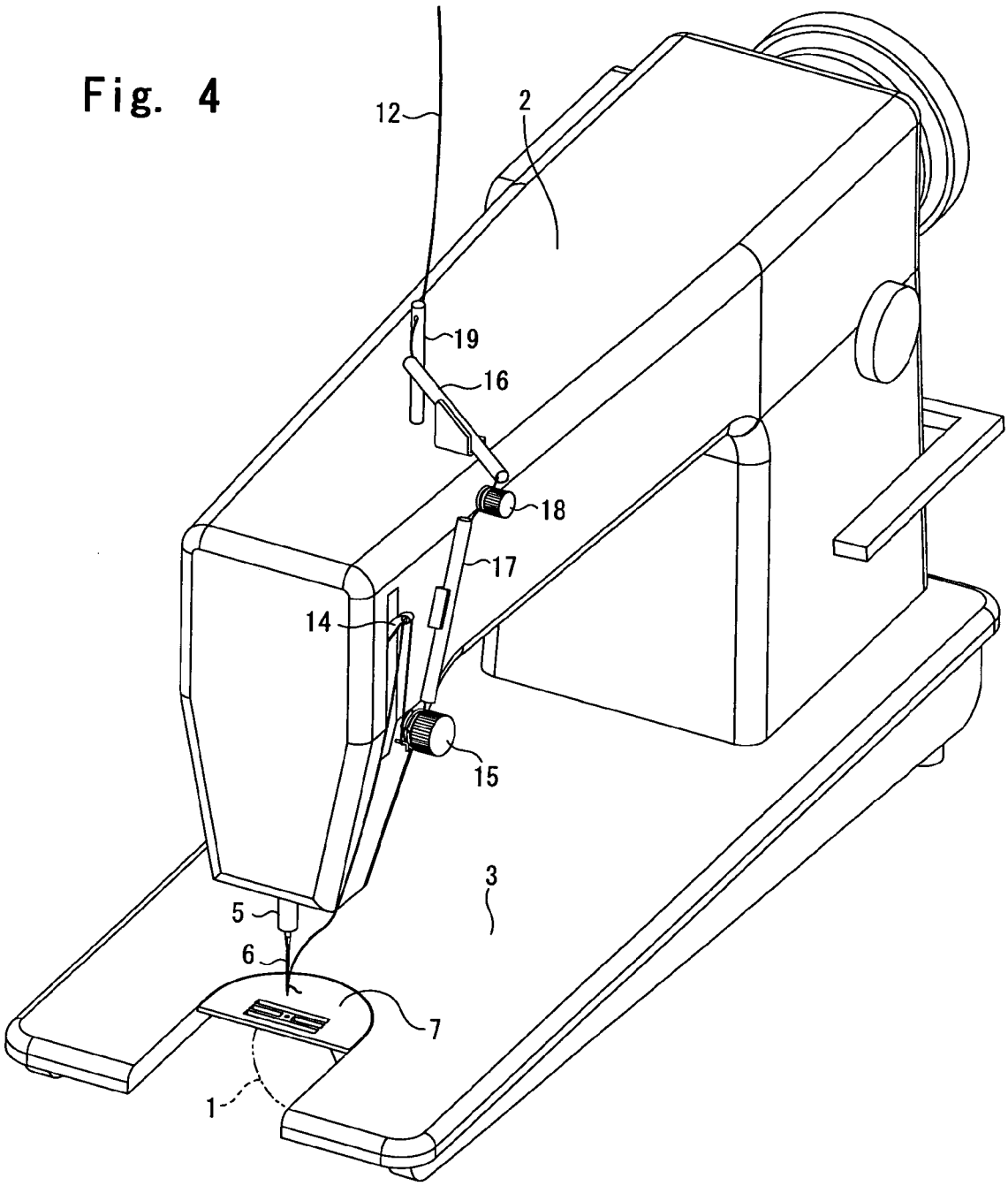
FIG. 4 A perspective view showing the entirety of the sewing machine, to which the seam puckering preventing shuttle device of the sewing machine of the invention is applied.

However, the lock stitch forming mechanism is briefly described. As shown in FIG. 4, the mechanism is provided with a needle 6 fixed in a needle bar 5 for moving upward and downward with respect to a throat plate 7 while drawing a trace in the vertical direction, and a full rotation hook 1 or a vertical hook for rotating in association with the upward/downward movements of the needle 6 thereby to draw a trace in its rotating direction. An upper thread 12 is inserted into the needle 6, and a lower needle (not-shown) is accommodated in the full rotation hook 1. When the upper thread 12 inserted into the needle 6 reciprocating in the vertical direction through the work placed on the throat plate 7 at each feed of the work is raised from the lower dead point of the needle 6, the upper thread 12 is picked up by a loop-taker point (not-shown) of the rotating full rotation hook 1 disposed below the throat plate 7 for accommodating the lower thread so that the upper thread 12 and the lower thread are interlaced to form lock stitches in the work.

Embodiment 1

Outer-Hook-Loop-Taker-Point Type Full Rotation Hook (with Eccentric Inner Hook)

Figure 1:
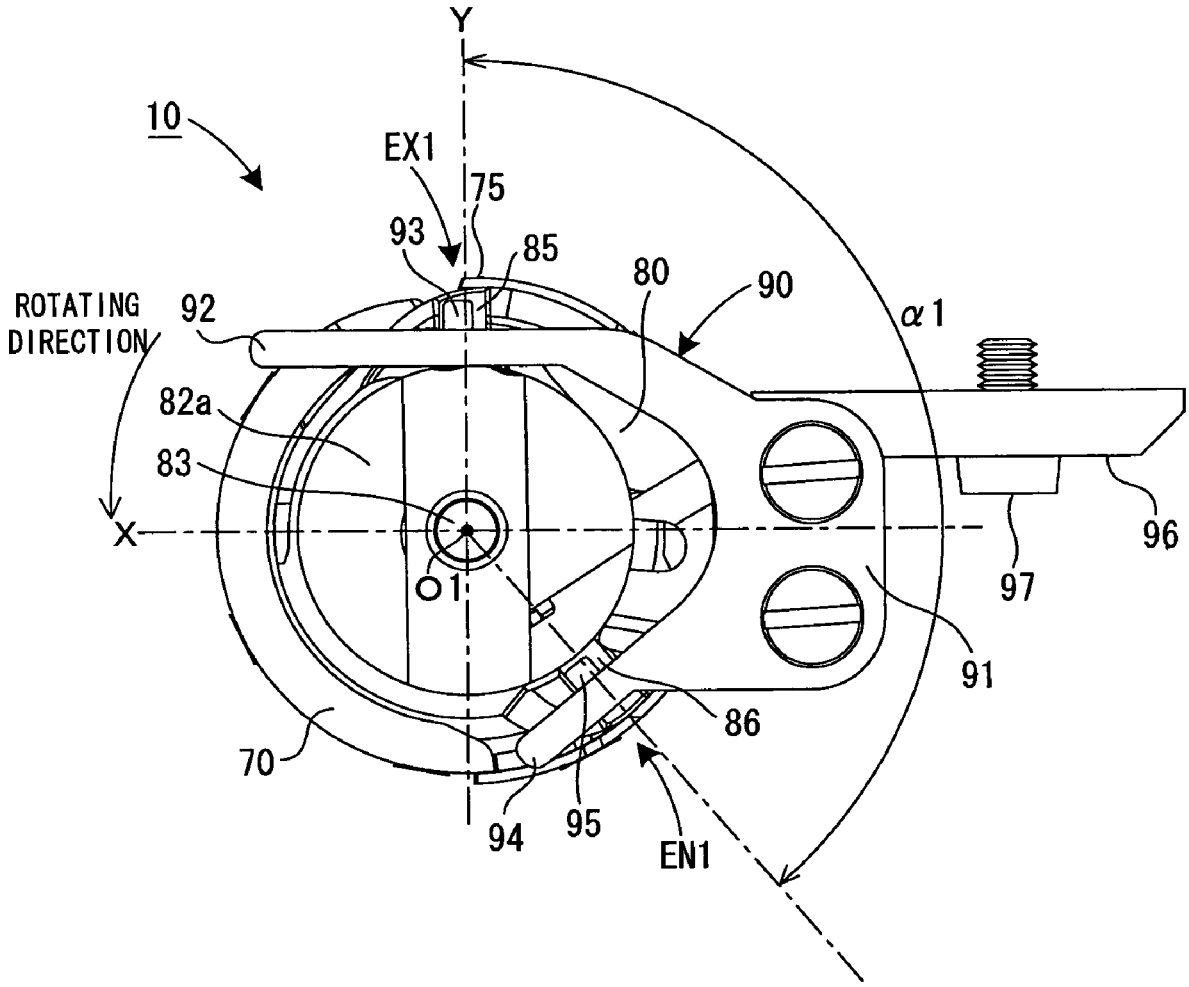
FIG. 1 An explanatory diagram showing one preferred mode of embodiment, in which a seam puckering preventing shuttle device of a sewing machine of the invention is applied to an outer-hook-loop-taker-point type full rotation hook.
Figure 2:
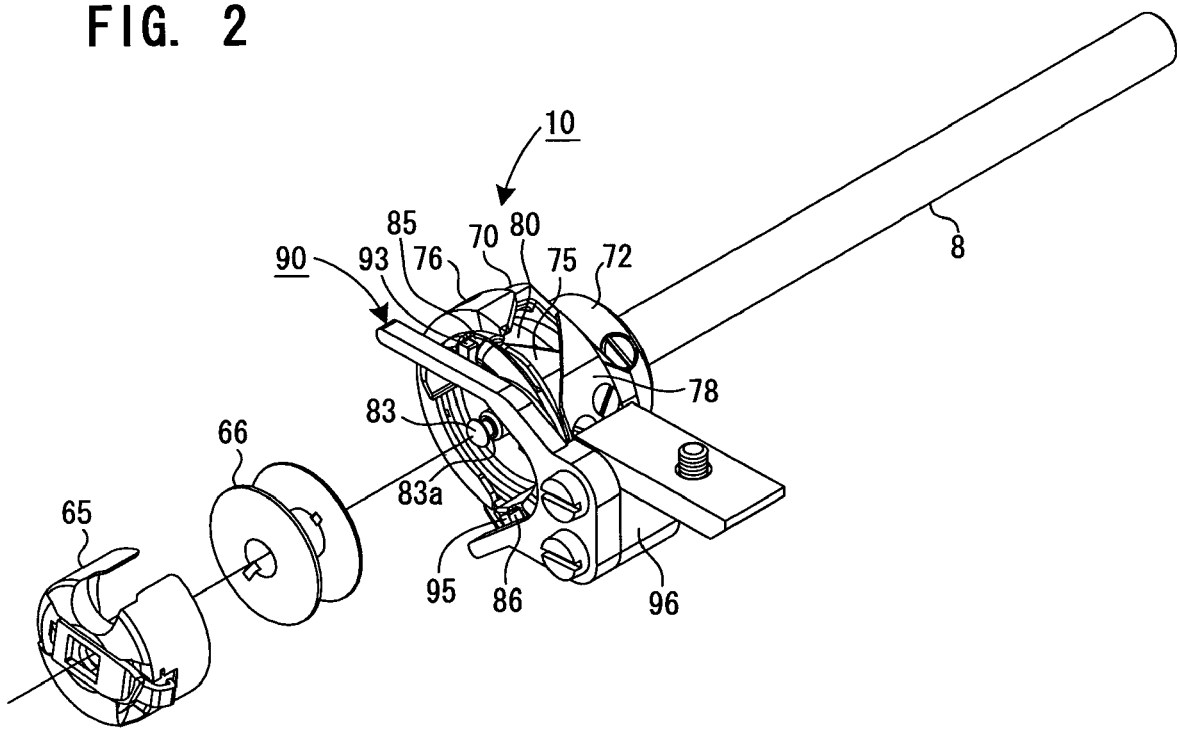
FIG. 2 A perspective view showing the outer-hook-loop-taker-point type full rotation hook.
Figure 3:
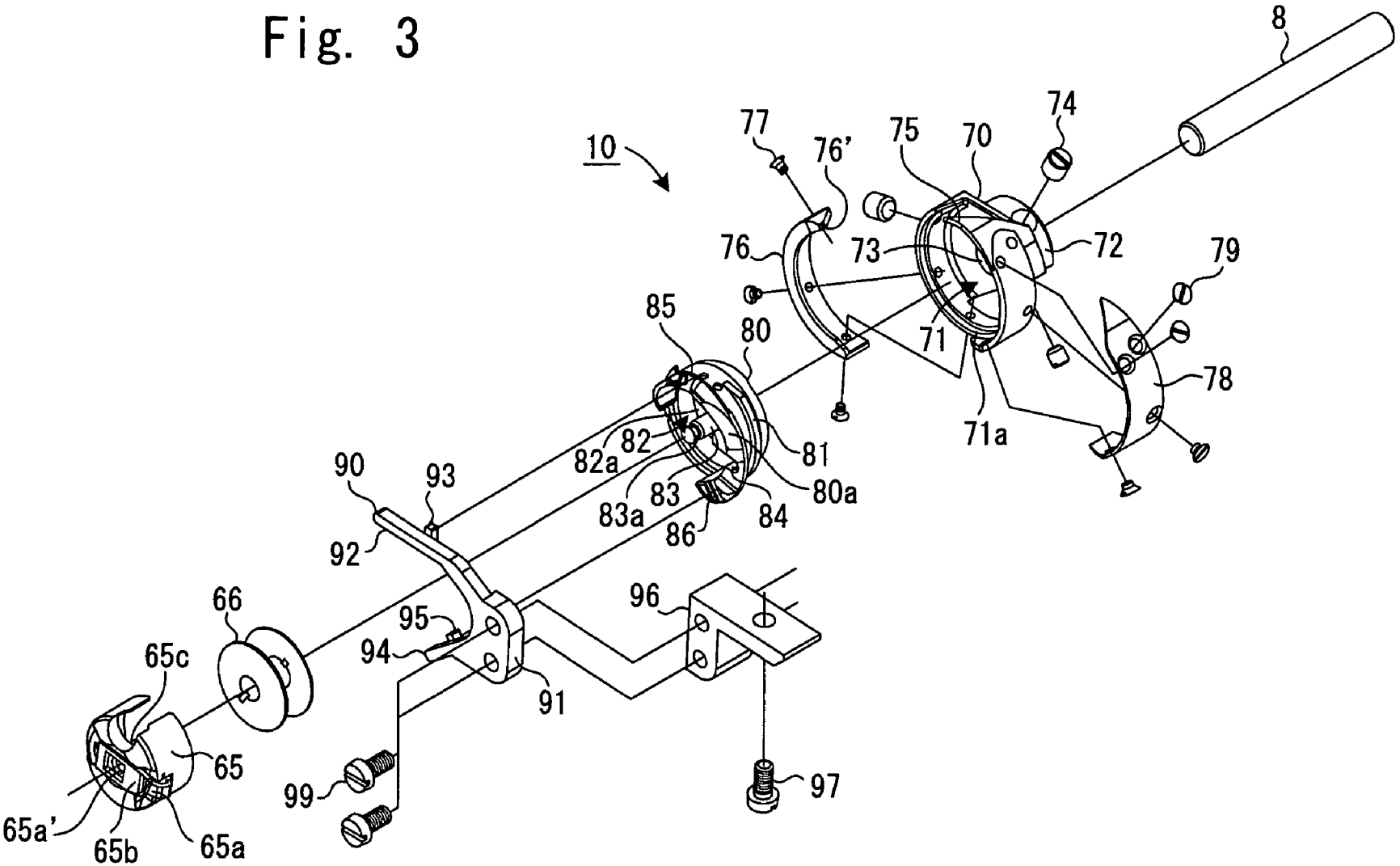
FIG. 3 An exploded perspective view showing the outer-hook-loop-taker-point type full rotation hook.

This full rotation hook 1 is disposed below the throat plate 7 attached to a bed 3 of the sewing machine body, and is exemplified by an outer-hook-loop-taker-point type full rotation hook 10, as shown in FIG. 1, FIG. 2 and FIG. 3. The full rotation hook 10 includes: a shuttle bobbin case 65 accommodating a shuttle bobbin 66 having the lower thread wound thereon and easily removably fixed to the frame (not-shown) of the sewing machine body; an inner hook 80 accommodating the shuttle bobbin case 65 and prevented from rotating relative to the frame by an inner hook stopper 90; and an outer hook 70 accommodating the inner hook 80 and having a loop-taker point 75 and rotated by a lower shaft 8 or one part of the rotation driving portion. When the outer hook 70 is rotated counter-clockwise in FIG. 1 by the lower shaft 8, the loop-taker point 75 can pick up the loop of the upper thread 12 (as referred to FIG. 4 and FIG. 5) and can turn around the outer circumference of the inner hook 80 through the clearance between the outer hook 70 and the inner hook 80. For convenience, FIG. 1 presents a diagram omitting the shuttle bobbin case 65.

In the outer-hook-loop-taker-point type full rotation hook 10, moreover, the inner hook 80 has its rotation center O1 (FIG. 5A) arranged eccentrically of the rotation center O (FIG. 5A) of the lower shaft 8 or one part of the rotation driving portion. As a result, an upper thread entrance EN1 and an upper thread exit EX1 are formed at such circumferentially different positions between the inner hook stopper 90 and the inner hook 80 as to form the clearance, through which the loop of the upper thread 12 picked up by the loop-taker point 75 for every rotation of the rotationally driven outer hook 70 is guided in and out the circumference of the inner hook 80 after it was pulled out to the maximum by the outer circumference of the inner hook 80.

This upper thread entrance EN1 is arranged at the position where the loop of the upper thread 12 picked up by the loop-taker point 75 is guided in on the outer circumference of the inner hook 80, and the upper thread exit EX1 is arranged at the position where the loop of the upper thread 12 is guided out from the outer circumference of the inner hook 80 and pulled upward of the throat plate 7.

The upper thread entrance EN1 and the upper thread exit EX1 are arranged at an angular space $\alpha 1$ of 120 degrees to 160 degrees, preferably 120 degrees to 180 degrees. In the example shown in FIG. 1, the angular space $\alpha 1$ is set at 140 degrees. Here, the upper thread entrance EN1 and the upper thread exit EX1 are formed by the clearance varying with the rotation of the outer hook 70. The angular space α1 on the rotation center O1 of the inner hook 80 between the upper thread entrance EN1 and the upper thread exit EX1 expresses the angular space value at the time when the clearance between the upper thread entrance EN1 and the upper thread exit EX1 becomes the maximum for each thread passage. Moreover, this angular space should not be limited to the range of 120 degrees to 160 degrees. In the operation tests of the inventors, it has been confirmed that the outer-hook-loop-taker-point type full rotation hook 10 normally operated as the hook within the range of 110 degrees to 180 degrees. Here, this range is preferably set within 150 degrees to 170 degrees, in case the normal speed of the sewing machine is set to 4,000 to 5,000 rpm, for example.

The rotation center of the inner hook 80 is made eccentric in a direction d1 (as referred to FIG. 6) in the angular space α1 between the upper thread entrance EN1 and the upper thread exit EX1 with respect to the rotation center of the lower shaft 8 or the rotation driving portion.

The inner hook 80 is formed into a bottomed cylindrical shape having a shuttle bobbin case housing 82 on its inner side and a flange portion 80*a* on the open side. In the surface of the flange portion 80*a*, there are formed an upper inner hook stopper groove 85 and a lower inner hook stopper groove 86, which are recessed to engage with an upper inner hook stopper 93 and a lower inner hook stopper 95 provided at the later-described inner hook stopper 90. The lower inner hook stopper groove 86 is arranged at the position where the loop of the upper thread 12 picked up by the loop-taker point 75 of the outer hook 70 is guided in on the outer circumference of the inner hook 80, and the upper inner hook stopper groove 85 is arranged at the position where the loop of the upper thread 12 is guided out from the outer circumference of the inner hook 80. On the other hand, the upper inner hook stopper groove 85 and the lower inner hook stopper groove 86 are arranged at the circumferentially different positions of the inner hook 80 and at the angular space α1 from the rotation center O1 of the inner hook 80 (as referred to FIG. 1). By thus arranging the upper inner hook stopper groove 85 and the lower inner hook stopper grove 86, the loop of the upper thread 12 can be smoothly moved on the outer circumference of the inner hook 80.

From the rotation center O1 of the bottom portion 82*a* of the shuttle bobbin case housing 82 of the inner hook 80, there is protruded a stud pin 83, which acts as a center pin for mounting the shuttle bobbin case 65 rotatably. In the outer circumference of the leading end portion of the stud pin 83, a groove 83*a* for fixing the attached shuttle bobbin case 65 in the inner hook 80 is formed over the entire circumference. In the groove 83*a* of the stud pin 83, there is retained an aperture 65*a*', which is formed in a lower shuttle bobbin case latch 65*a* of the shuttle bobbin case 65. When an upper shuttle bobbin case latch 65*b* of the shuttle bobbin case 65 is raised, the aperture 65*a*' of the lower latch 65*a* is not retained in the groove 83*a* of the stud pin 83. Therefore, the center hole (not-shown) drilled on the center axis 65*c* of the shuttle bobbin case 65 is fitted on the stud pin 83, and the shuttle bobbin case 65 is brought into abutment against the bottom portion 82*a* of the inner hook 80. After the shuttle bobbin case 65 was accommodated in the inner hook 80, the upper latch 65*b* is released. Then, the lower latch 65*a* is caused by a shuttle bobbin case latch spring (not-shown) to restore the original position so that the aperture 65*a*' of the lower latch 65*a* is retained in the groove 83*a* of the stud pin 83. As a result, the shuttle bobbin case 65 can be fixed on the stud pin 83 of the inner hook 80. In the flange portion 80*a* of the inner hook 80, moreover, there is formed a horn groove 84, which engages, when the lower latch 65*a* of the shuttle bobbin case 65 is returned to the original position by the latch spring, with a horn portion formed at one end of the lower latch 65*a* thereby to block the rotation of the shuttle bobbin case 65. The shuttle bobbin 66 is rotatably fitted on the center axis 65*c* of the shuttle bobbin case 65.

In the outer circumference of the inner hook 80, there is formed an inner hook race 81, which is so partially cut off along the outer circumference that it may be fitted in a race groove 71*a* formed in the later-described outer hook 70.

The reason why the inner hook race 81 is thus partially cut away is to guide in the loop of the upper thread on the outer circumference of the inner hook 80 as in the well-known outer-hook-loop-taker-point type full rotation hook.

The outer hook 70 has a structure similar to that of the well-known outer-hook-loop-taker-point type full rotation hook. The outer hook 70 has an outer hook boss 72 to be fixed on the lower shaft 8 by a fixing member 74 such as screws, and a lower shaft mounting hole 73 formed in the outer hook boss 72 has a rotation center coaxial with that of the lower shaft 8. The outer hook 70 and its loop-taker point 75 rotate coaxially with the lower shaft 8 or the rotation driving portion.

This outer hook 70 is provided on its inner side with an inner hook housing 71 for accommodating the inner hook 80. This inner hook housing 71 is provided on its opening side with the race groove 71*a* for rotating the inner hook race 81 of the inner hook 80 in a fitted sliding state. The race groove 71*a* is made eccentric from the lower shaft 8 acting as the rotation driving portion. When the inner hook race 81 of the inner hook 80 is fitted in the race groove 71*a* of the outer hook 70, therefore, the rotation center O1 of the inner hook 80 fitted in the outer hook 70 is made eccentric to the rotation center of the lower shaft 8 or the rotation driving portion, because the race groove 71*a* and the inner hook race 81 are concentric with each other. Thus, the inner hook 80 is disposed to have its rotation center O1 eccentric from the lower shaft 8 or the rotation driving portion. As a result, the inner hook 80 makes eccentric rotating motions with respect to the rotation center of the lower shaft 8.

After the inner hook 80 was accommodated in the inner hook housing 71 of the outer hook 70, an inner hook holder 76 is so fixed to the outer hook 70 by a fixing member 77 such as screws that the inner hook 80 may not come out. This inner hook holder 76 clamps the inner hook race 81 of the inner hook 80 rotatably. In the vicinity of the loop-taker point 75 mounted on the outer circumference of the outer hook 70, moreover, a thread guide spring 78 for guiding the loop of the upper thread 12 picked up by the loop-taker point 75 on the outer circumference of the inner hook 80 is fixed on the outer circumference of the outer hook 70 by a fixing member 79 such as screws.

The inner hook stopper 90 is formed into a generally bifurcated shape having an upper arm portion 92 equipped with the ridge-shaped upper inner hook stopper 93 and an lower arm portion 94 equipped with the ridge-shaped lower inner hook stopper 95, respectively. This inner hook stopper 90 is fixed at its inner hook stopper base portion 91 by a fixing member 99 such as screws on an inner hook stopper bed 96 which is fixed by a fixing member 97 such as a screw at a predetermined position of the frame disposed in the bed 3 of the sewing machine body. At this interlaced point, the upper inner hook stopper 93 is arranged in the direction of the needle 6, and the lower inner hook stopper 95 is arranged at the angular space α1 substantially equal to that between the upper inner hook stopper groove 85 and the lower inner hook stopper groove 86 of the inner hook 80.

When the outer hook 70, the inner hook 80 and the inner hook stopper 90 thus constructed are assembled, clearances of predetermined widths are set between the upper inner hook stopper groove 85 and the upper inner hook stopper 93 and between the lower inner hook stopper groove 86 and the lower inner hook stopper 95. The clearances thus formed function as the upper thread entrance and exit EN1 and EX1.

Next, the hook actions of the outer-hook-loop-taker-point type full rotation hook 10, which is provided with those two upper thread entrance and exit EN1 and EX1 and in which the outer hook 70 makes rotational movements relative to the inner hook 80 in synchronism with the needle 6, upon the upper thread 12 are described with reference to FIG. 5. In this action description, the direction is so taken as views FIG. 5 in front.

Here, this outer-hook-loop-taker-point type full rotation hook 10 makes two rotations for one cycle of the upward and downward movements of the needle 6. In FIG. 5 to be used for explaining the hook actions, it is assumed that the outer hook 70 rotates counter-clockwise when the lower shaft 8 makes a counter-clockwise rotational movement. For conveniences, the action description is started from the state (FIG. 5A, in which the needle having the upper thread 12 inserted thereinto has risen a predetermined length, e.g., 2 mm from the lower dead center and in which the loop-taker point 75 of the outer hook 70 has been positioned at the upper dead center. At this position, the upper thread exit EX1 is formed between the upper inner hook stopper groove 85 of the eccentrically moving inner hook 80 and the two side faces of the upper inner hook stopper 93 of the inner hook stopper 90, and the lower inner hook stopper 95 of the inner hook stopper 90 abuts against the left wall of the lower inner hook rotation stopper groove 86 of the inner hook. For conveniences, moreover, the upper inner hook stopper 93 and the lower inner hook stopper 95 of the inner hook stopper 90 are shown by circles in FIG. 5.

When the needle 6 begins to rise from the aforementioned state, the upper thread 12 inserted into the needle 6 is pressed together with the needle 6 by the upper face of the thread plate 7 so that it is not raised together with the needle 6 but left to form the loop.

Figure 5A:
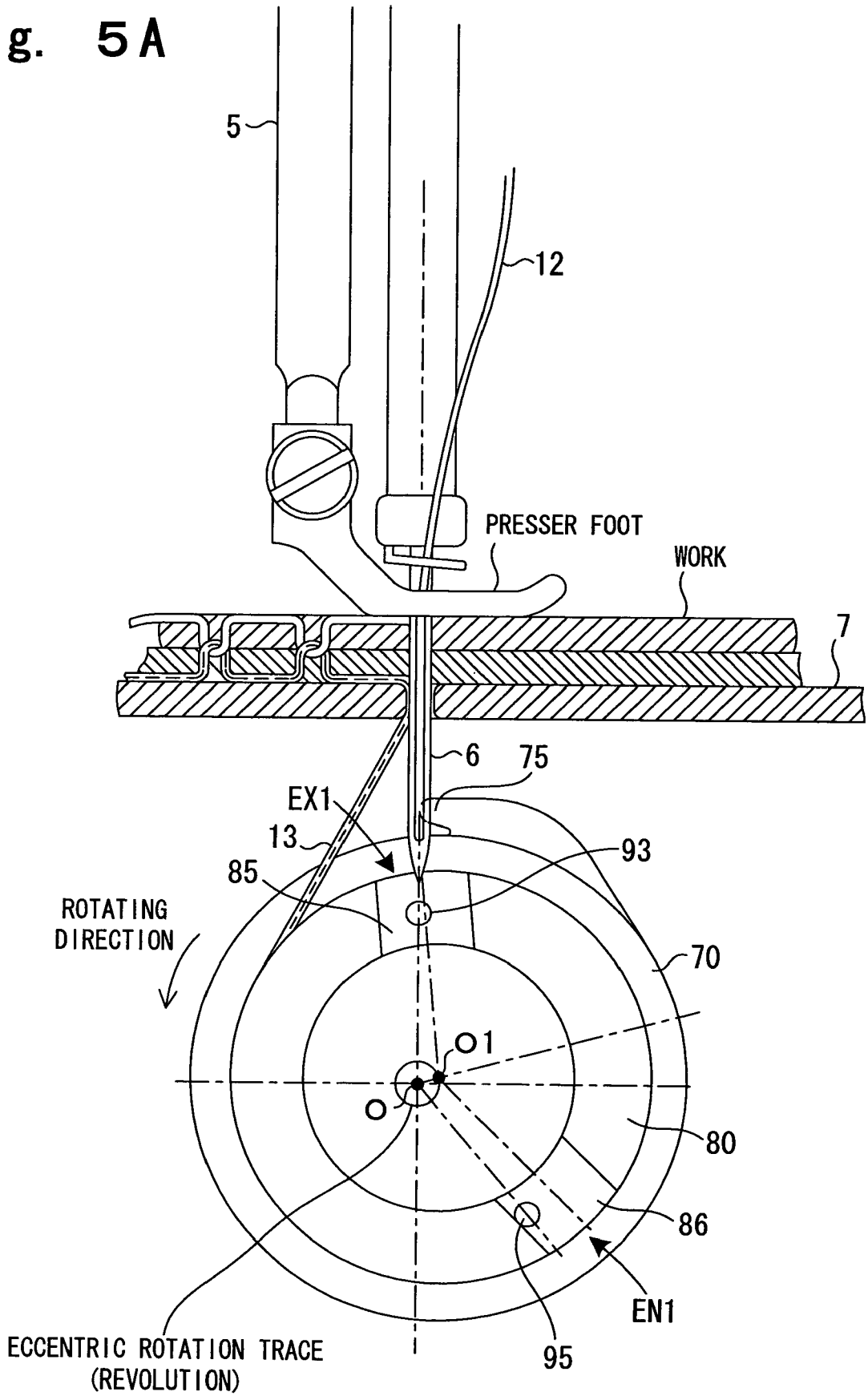
FIG. 5A An action explaining diagram showing an action state of the outer-hook-loop-taker-point type full rotation hook of FIG. 1.
Figure 5B:
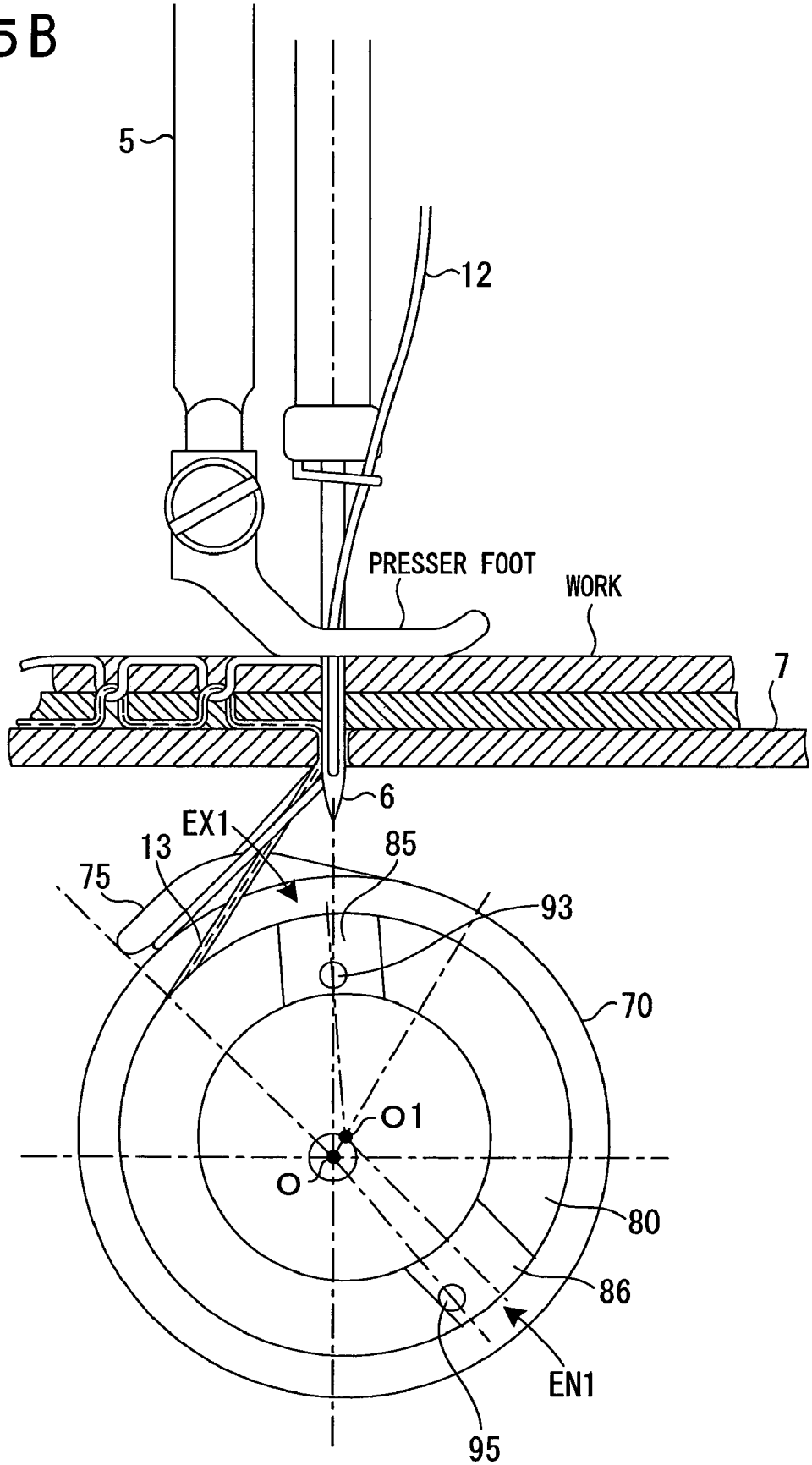
FIG. 5B An action explaining diagram showing an action state of the outer-hook-loop-taker-point type full rotation hook of FIG. 1.
Figure 5C:
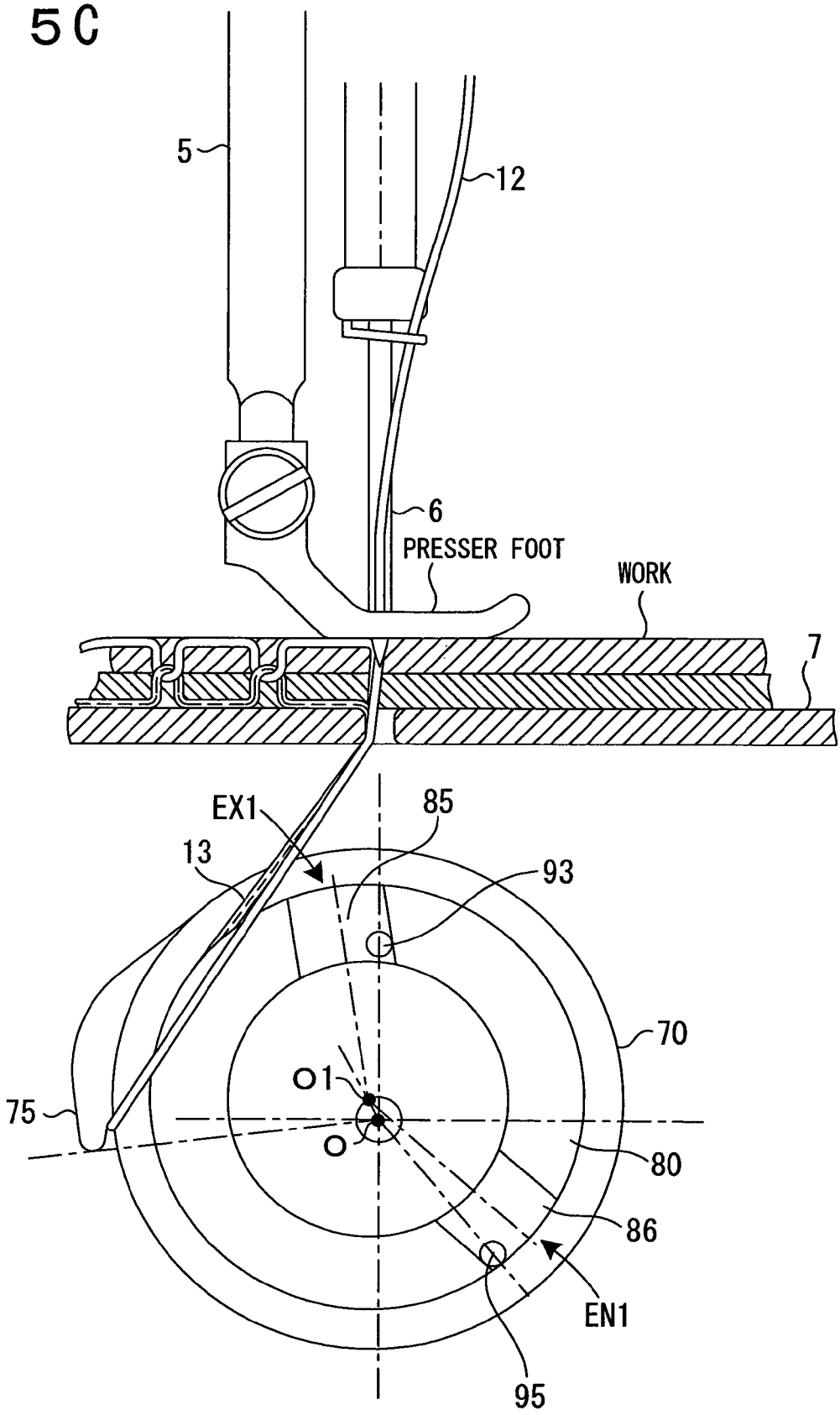
FIG. 5C An action explaining diagram showing an action state of the outer-hook-loop-taker-point type full rotation hook of FIG. 1.
Figure 5D:
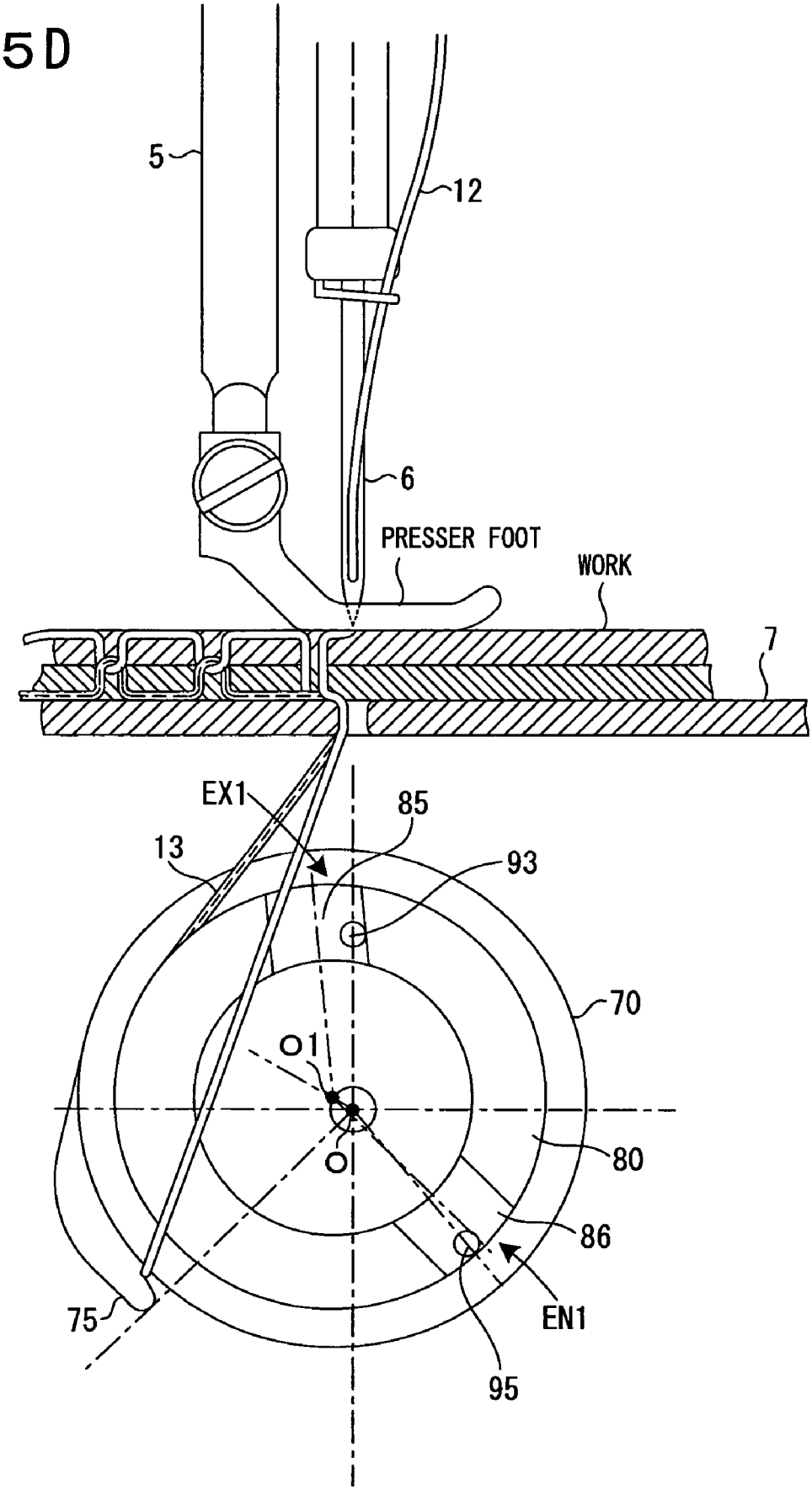
FIG. 5D An action explaining diagram showing an action state of the outer-hook-loop-taker-point type full rotation hook of FIG. 1.

This loop of the upper thread 12 is picked up by the loop-taker point 75 of the outer hook 70 rotating counter-clockwise, as shown in FIGS. 5B and 5C, so that it is pulled in on the outer circumference of the inner hook 80. At this time, the inner hook 80 eccentrically accommodated in the outer hook 70 is eccentrically rotated counter-clockwise by the slight friction between the inner hook race 81 and the outer hook race groove 71*a* so that the upper inner hook stopper 93 of the inner hook stopper 90 having the clearance from the upper rotation stopper groove 85 of the inner hook 80 abuts against the righthand wall of the upper rotation stopper groove 85 (FIG. 5C). Here, the lower rotation stopper groove 86 of the inner hook 80 and the lower inner hook stopper 95 of the inner hook stopper 90 remains in abutment.

Figure 5E:
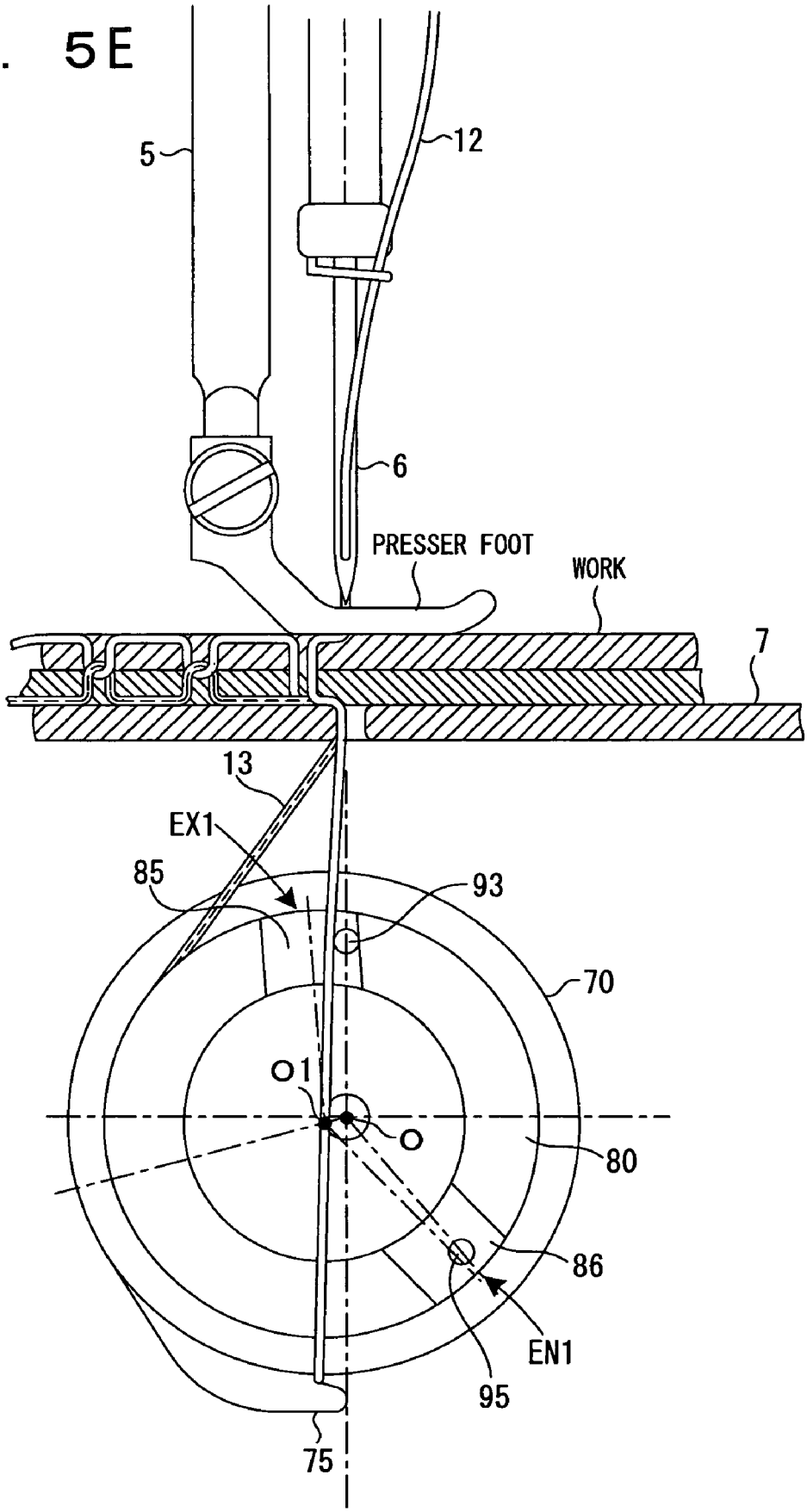
FIG. 5E An action explaining diagram showing an action state of the outer-hook-loop-taker-point type full rotation hook of FIG. 1.

The loop of the upper thread 12 pulled in on the outer circumference of the inner hook 80 is guided below, as shown in FIGS. 5B and 5E, by the loop-taker point 75 being moved by the rotational movement of the outer hook 70. At this time, the lower inner hook stopper 95 of the inner hook stopper 90 abutting against the lefthand wall of the lower rotation stopper groove 86 of the inner hook 80 gradually leaves the lefthand wall of the lower rotation stopper groove 86. This is because the inner hook 80 regulated in the eccentrically rotational movement by the inner hook stopper 90 is caused to revolve by the rotational movement of the outer hook 70 so that it makes a displacement of the eccentricity of the inner hook 80. Here, the upper inner hook stopper 93 remains in abutment against the righthand wall of the upper rotation stopper groove 85.

Figure 5F:
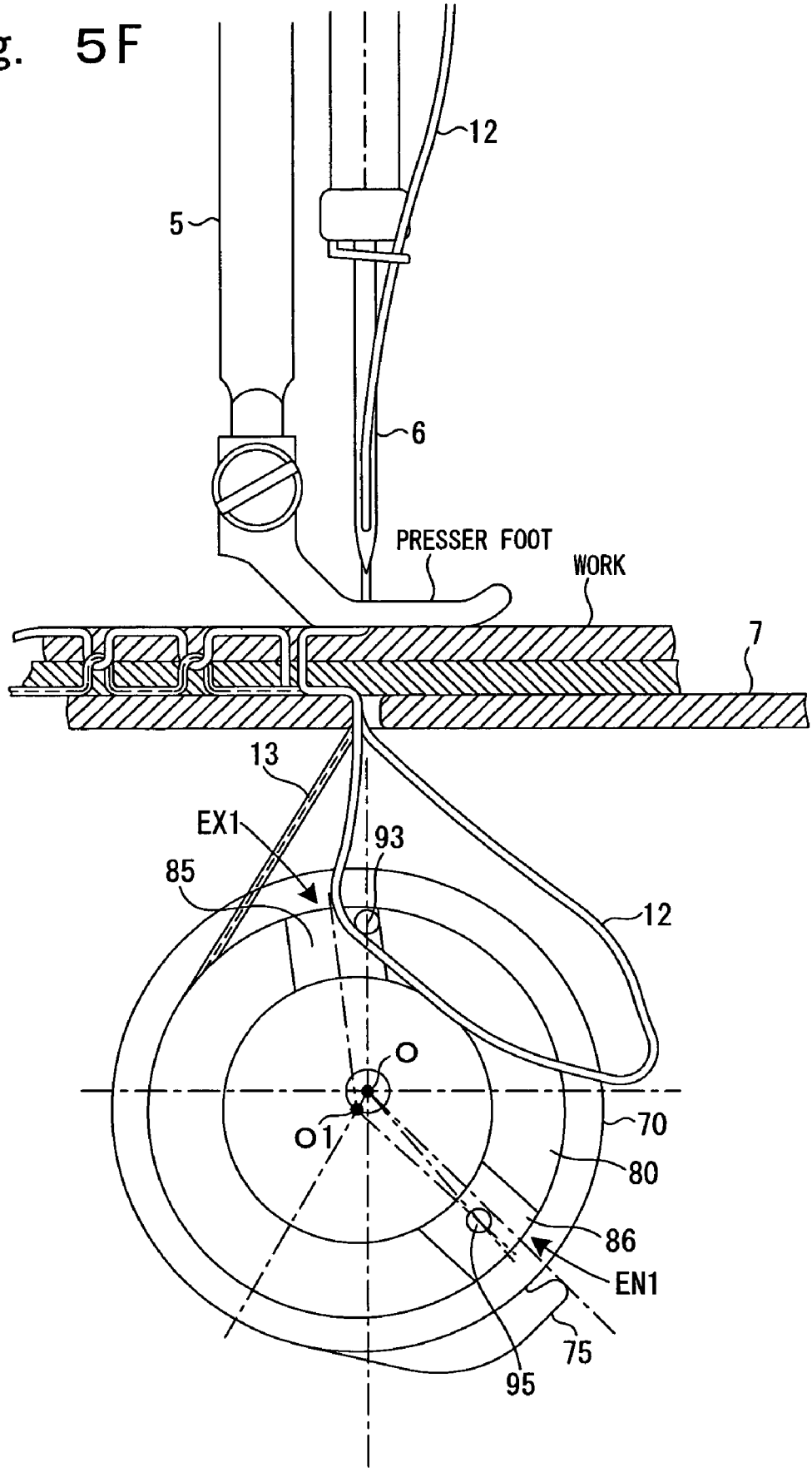
FIG. 5F An action explaining diagram showing an action state of the outer-hook-loop-taker-point type full rotation hook of FIG. 1.
Figure 5G:
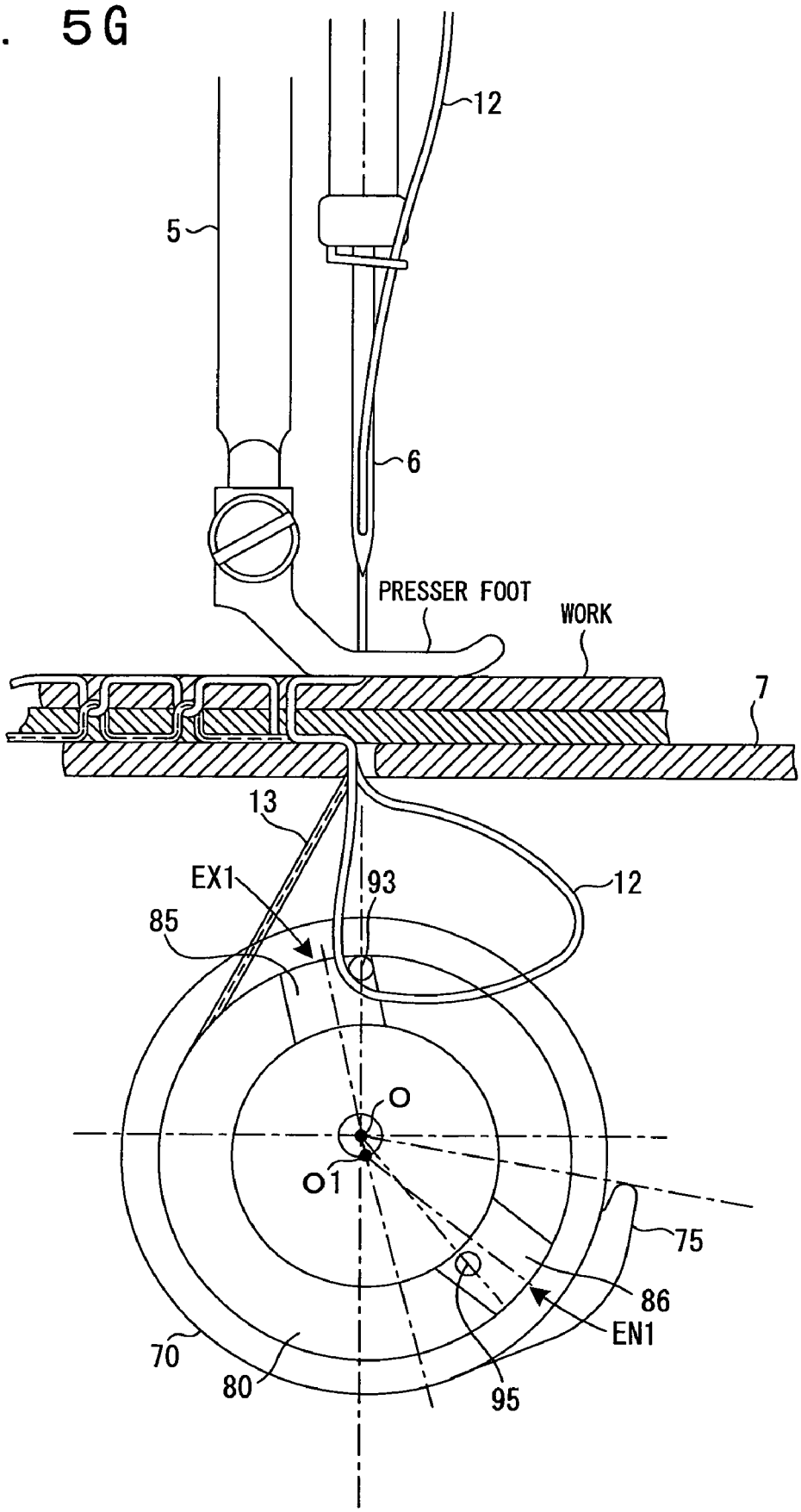
FIG. 5G An action explaining diagram showing an action state of the outer-hook-loop-taker-point type full rotation hook of FIG. 1.
Figure 5H:
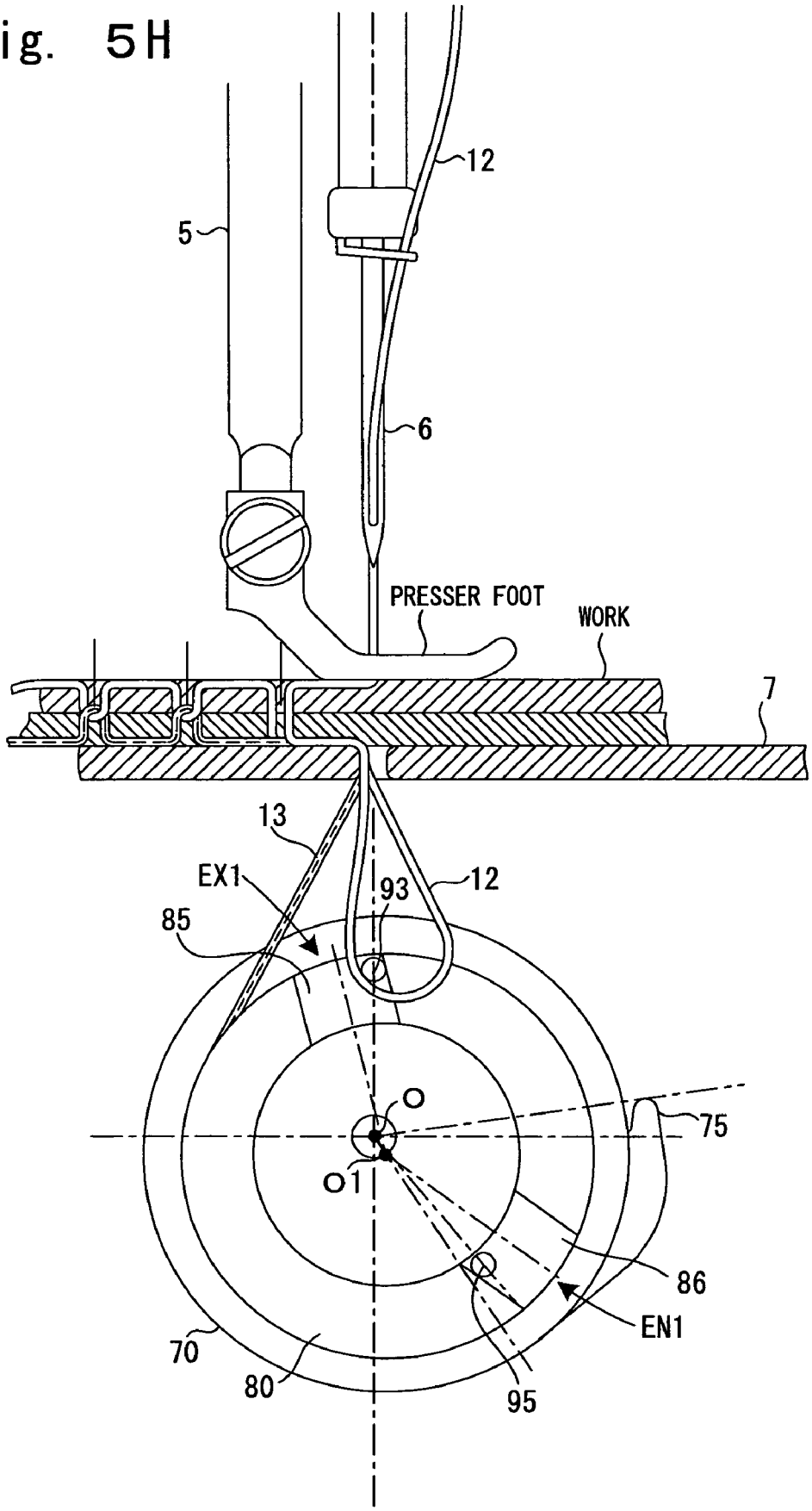
FIG. 5H An action explaining diagram showing an action state of the outer-hook-loop-taker-point type full rotation hook of FIG. 1.
Figure 51:
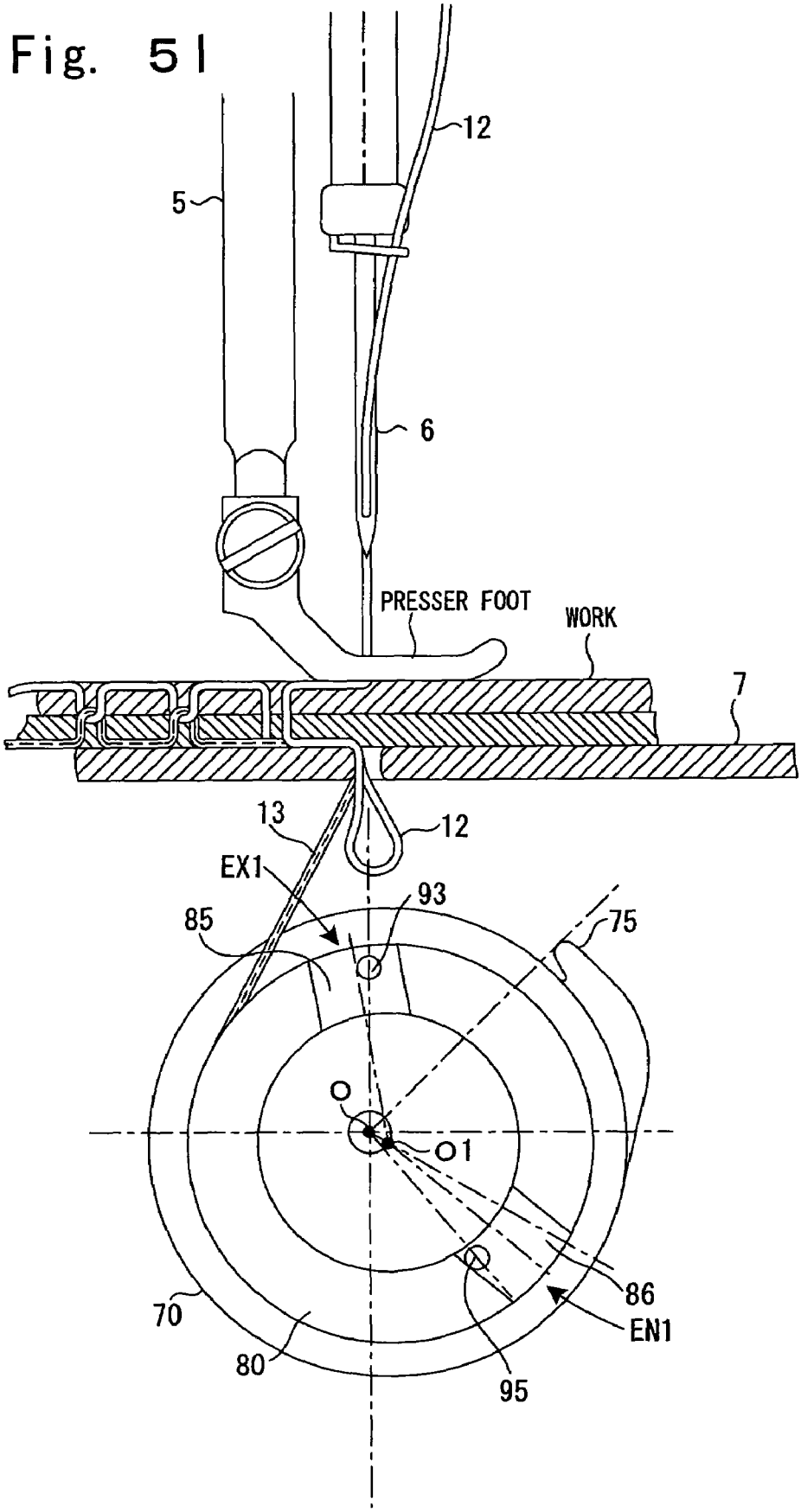

As shown in FIG. 5F, the loop of the upper thread 12 having been guided to below the outer circumference of the inner hook 80 is so guided by the loop-taker point 75 moved by the rotational movement of the outer hook 70 as to reach the lower rotation stopper groove 86 of the inner hook 80 regulated in the eccentric rotational movement by the inner hook stopper 90, so that it passes through the clearance between the lower rotation stopper groove 86 and the lower inner hook stopper 95. This clearance for the upper thread entrance EN1 can be smoothly passed by the loop of the upper thread 12. When the loop of the upper thread 12 thus passes the lower rotation stopper groove 86, a thread take-up lever 14 (as referred to FIG. 4) pulls up the upper thread 12 guided out of the inner hook 80. In this state where the thread take-up lever 14 has pulled up the upper thread 12, the lower inner hook stopper 95 of the inner hook stopper 90 comes into abutment against the lefthand wall of the lower rotation stopper groove 86 of the inner hook 80, as shown in FIGS. 5G and 5H. Here, the upper inner hook stopper 93 of the inner hook stopper 90 remains in abutment against the righthand wall of the upper rotation stopper groove 85 of the inner hook 80.

When the outer hook 70 makes a further rotational movement from the state of FIG. 5H, the upper inner hook stopper 93 of the inner hook stopper 90 abutting against the righthand wall of the upper rotation stopper groove 85 of the inner hook 80 is caused to go bit by bit away from the righthand wall of the upper rotation stopper groove 85 by the revolving displacement of the inner hook 80 being regulated in the eccentrically rotational movement. As a result, the upper thread 12 pulled up by the thread take-up lever 14 passes through the clearance or the upper thread exit EX1 between the upper rotation stopper groove 85 and the upper inner hook stopper 93, and makes an interlace with a lower thread 13 to form a lock stitch in the work. The loop of the upper thread 12 can smoothly pass through the clearance for the upper thread exit EX1. In this sate, moreover, the lower inner hook stopper 95 remains in abutment against the lefthand wall of the lower rotation stopper groove 86. Here, the outer hook 70 makes one more rotation till the needle 6 returns to the position shown in FIG. 5A.

While the outer hook 70 is thus making one rotational movement, the inner hook 80 is caused to revolve by the eccentrically rotational movement so that it is displaced by the eccentricity of the inner hook 80. When the upper thread 12 of the needle 6 is picked up by the loop-taker point 75 of the outer hook 70, and its loop is guided in on the outer circumference of the inner hook 80. At this time, the clearance can be formed between the lower rotation stopper groove 86 and the lower inner hook stopper 95 to smoothly guide in the upper thread 12 on the outer circumference of the inner hook 80. When the outer hook 70 rotates so that the upper thread 12 is guided out from the inner hook 80, the clearance is formed between the upper rotation stopper groove 85 and the upper inner hook stopper 93 at the instant when the thread take-up lever 14 takes up the upper thread 12. As a result, the upper thread 12 can be smoothly pulled up by the thread take-up lever 14 without resistance to the upper thread 12 at the extraction from the rotation hook.

This outer-hook-loop-taker-point type full rotation hook 10 is further described on a specific example.

Figure 6:
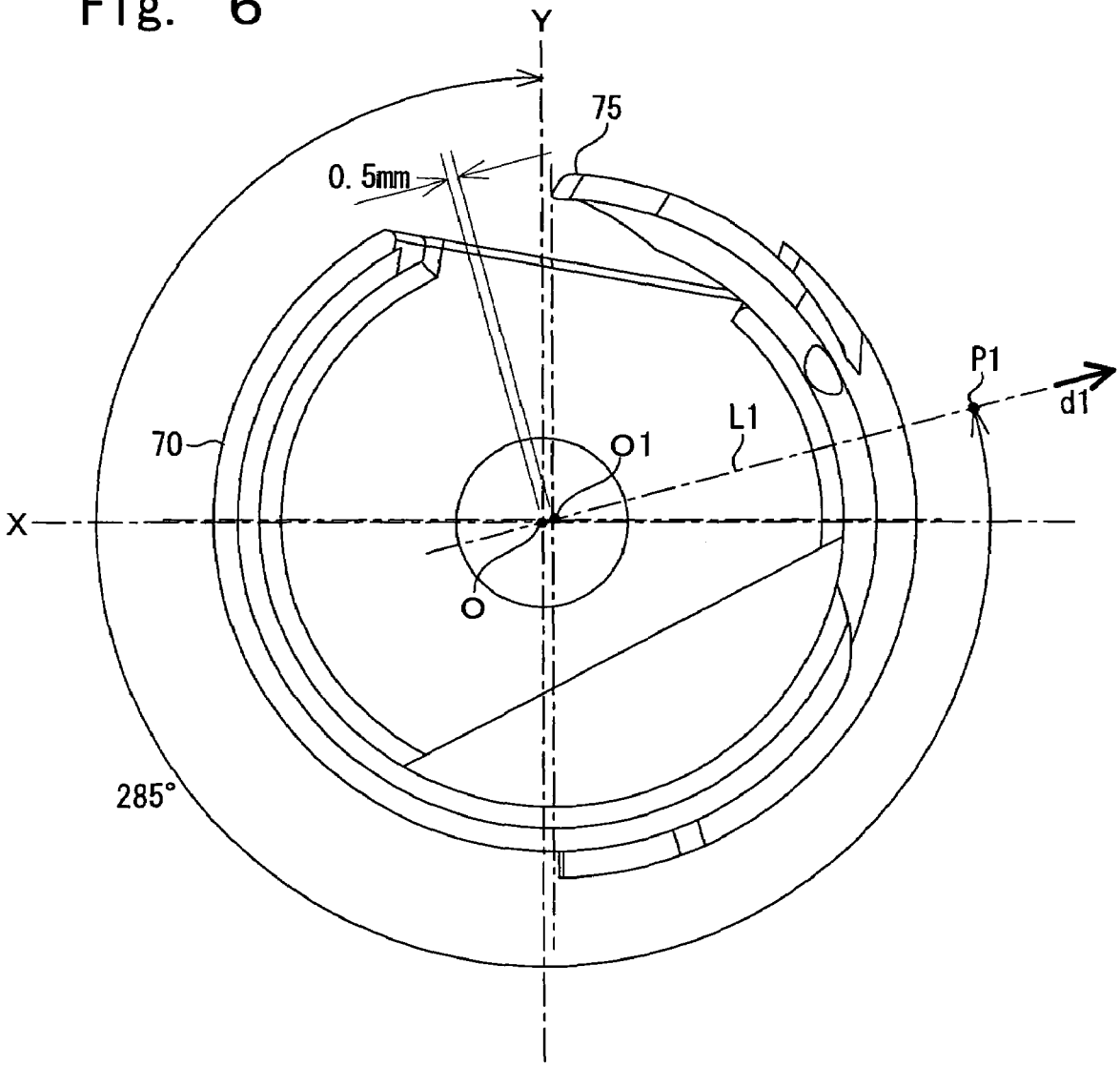
FIG. 6 An explanatory diagram showing a specific example of the outer hook to be used in the outer-hook-loop-taker-point type full rotation hook of FIG. 1.
Figure 7:
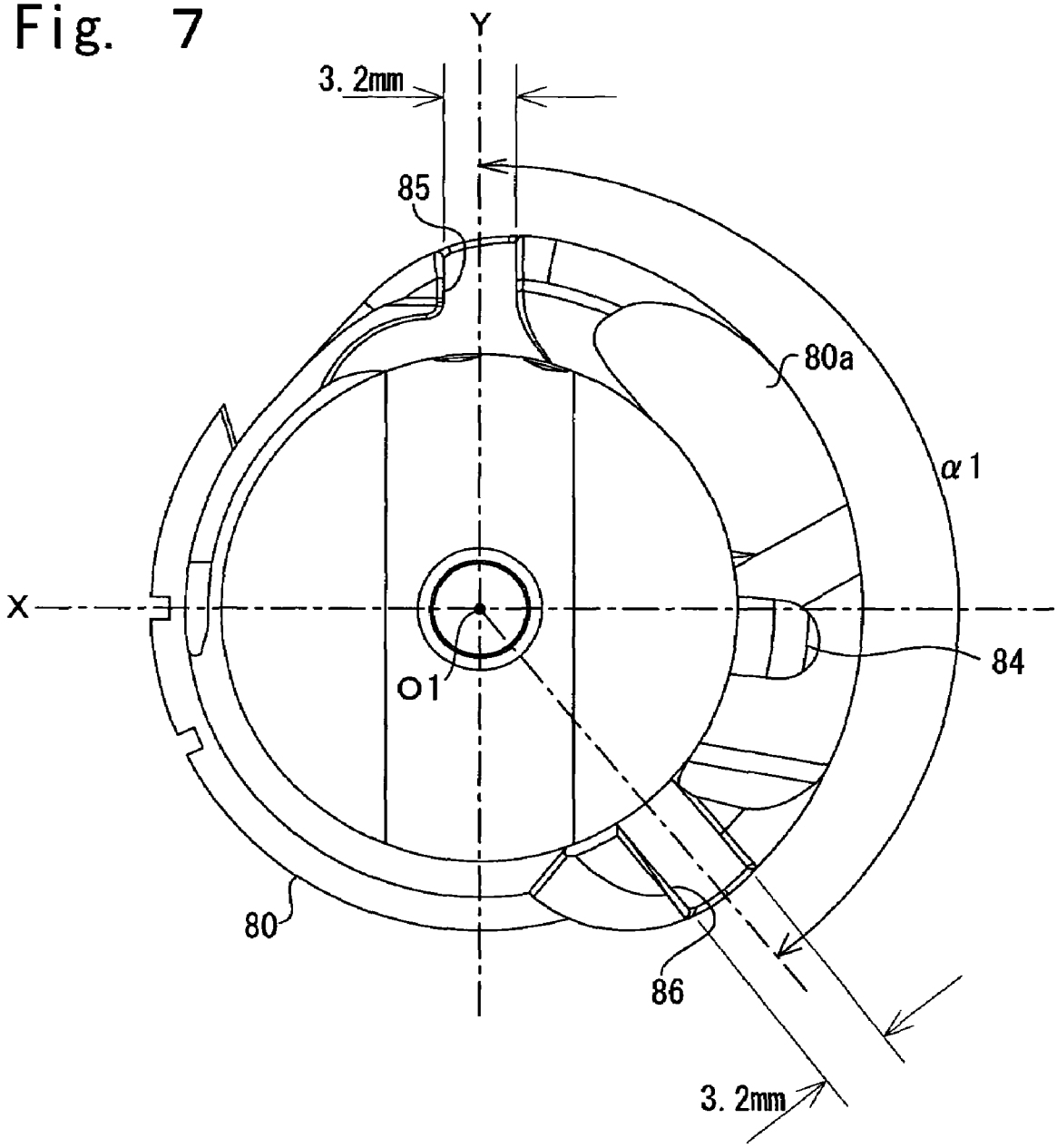
FIG. 7 An explanatory diagram showing a specific example of the arranged state of an upper rotation stopper groove and a lower rotation stopper groove of an outer hook to be used in the outer-hook-loop-taker-point type full rotation hook of FIG. 1.
Figure 8:
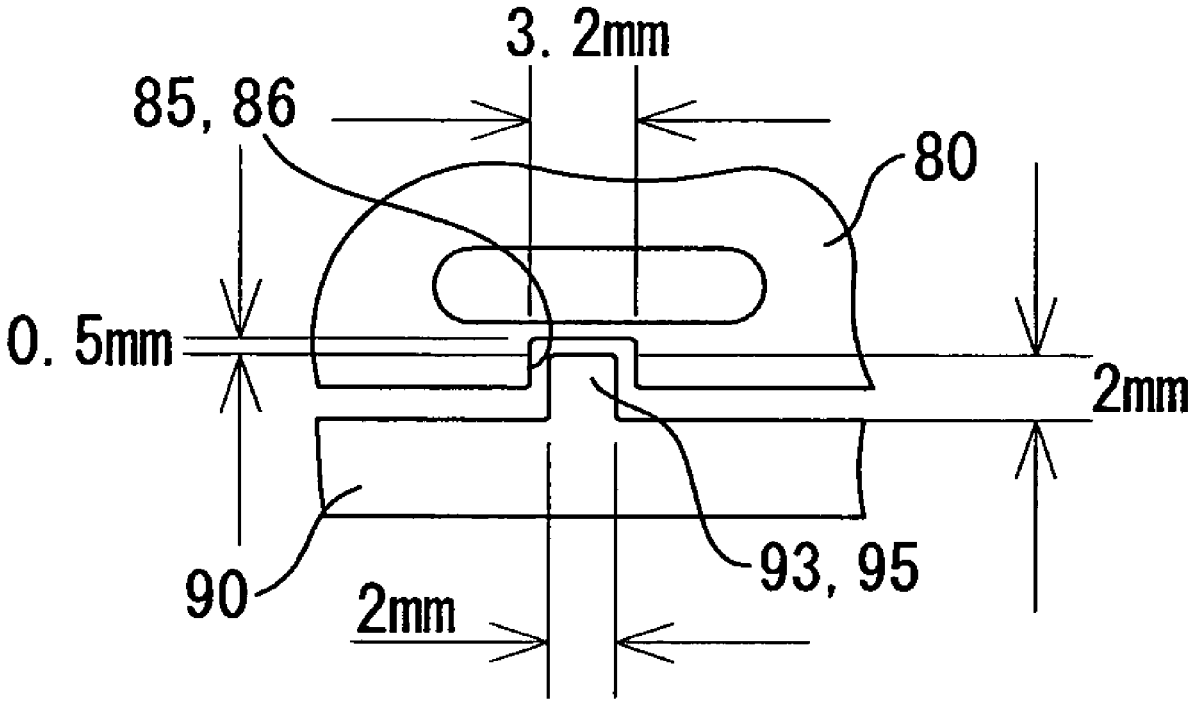
FIG. 8 An explanatory diagram showing specific relations between each of the rotation stopper grooves of the outer hook and each of the inner hook stoppers of the inner hook stopper, which are used in the outer-hook-loop-taker-point type full rotation hook.

In the outer-hook-loop-taker-point type full rotation hook 10 of a general size having its loop-taker point 75 positioned at the upper dead center with respect to the rotation center O of the lower shaft 8, as shown in FIG. 6, the eccentric direction d1 of the rotation center O1 of the inner hook 80 is so positioned on a straight line L1 joining a position P1, which is turned counter-clockwise by 285 degrees from the positive side of a Y-axis on the rotation center O of the lower shaft 8, in front view of FIG. 6, and the rotation center O of the lower shaft 8, as is displaced by 0.5 mm from the rotation center O of the lower shaft 8 to the position P1. As shown in FIG. 7, moreover, the upper inner hook stopper groove 85 and the lower inner hook stopper groove 86 of the inner hook 80 are set to have the angular space α1 of 140 degrees. As shown in FIG. 8, moreover, the upper inner hook stopper 93 and the lower inner hook stopper 95 of the inner hook stopper 90 are formed into a square ridge having a width of 2 mm and a length of 2 mm. Moreover, the upper inner hook stopper groove 85 and the lower inner hook stopper groove 86 of the inner hook 80 are formed into a rectangular recess having a width of 3.2 mm and such a depth as leaves a clearance of 0.5 mm from the end face of the ridge of the upper inner hook stopper 93 and the lower inner hook stopper 95 when the outer-hook-loop-taker-point type full rotation hook 10 is assembled in the bed 3 of the sewing machine body.

Moreover, the outer hook 70 is so fixed on the lower shaft 8 that the loop-taker point 75 reaches, when the needle 6 rises by 2.0 mm from the lower dead center, the axial position of the needle 6 thereby to pick up the loop of the upper thread 12.

Figure 9:
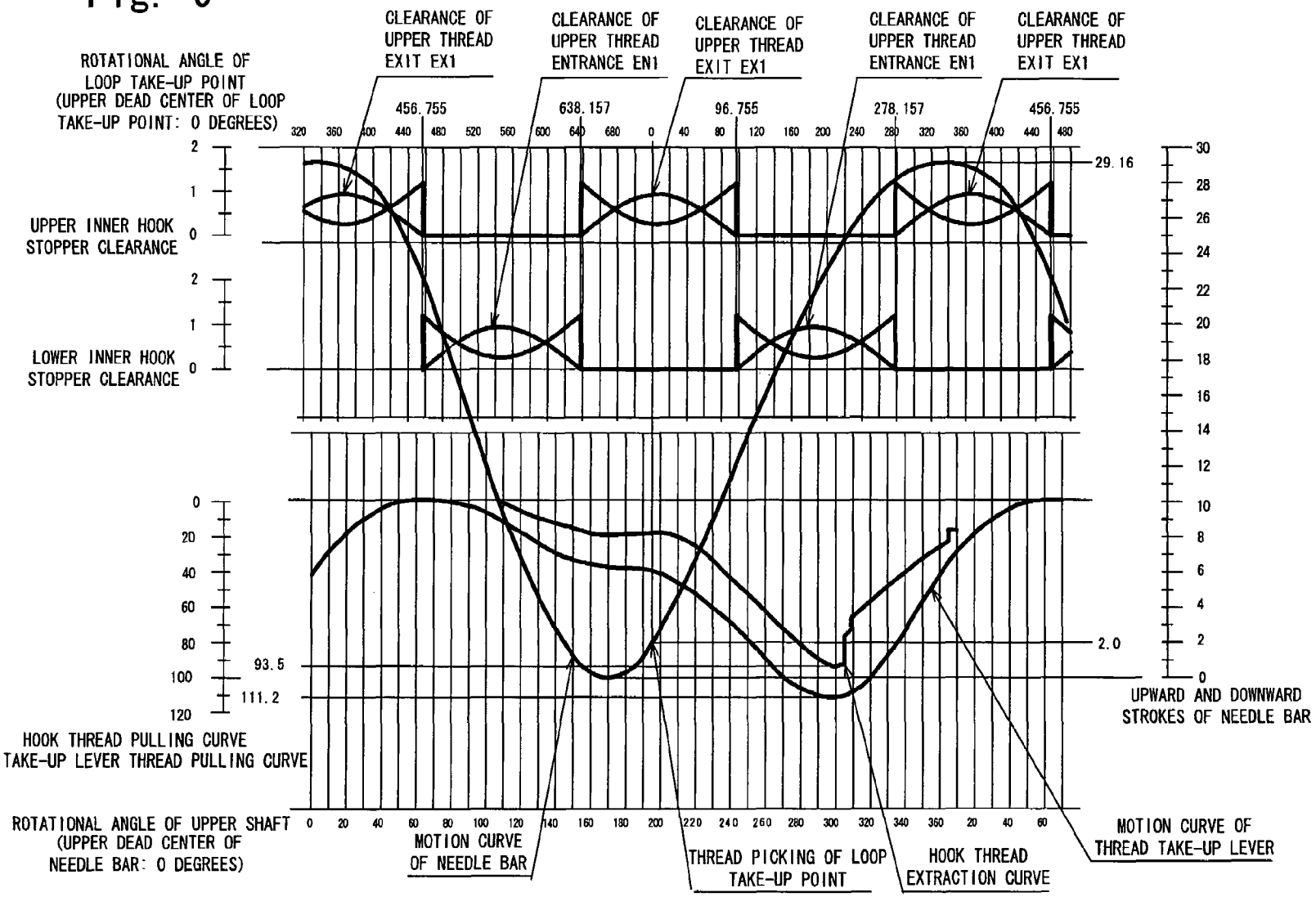
FIG. 9 An action explaining diagram (or a motion diagram) showing the action states of the needle bar, the thread take-up lever, and the upper thread entrance/exit of the rotation hook of the sewing machine, to which the outer-hook-loop-taker-point type full rotation hook of FIG. 1 is applied.

The rotation hook actions of the outer-hook-loop-taker-point type full rotation hook 10 are shown in the motion diagrams of the sewing machine of FIG. 9. In these motion diagrams, the outer-hook-loop-taker-point type full rotation hook 10 takes the state shown in FIG. 5A, when the rotational angle of the loop-taker point 75 of the outer hook 70 is at the upper dead center of 0 degrees, the state shown in FIG. 5C, when the rotational angle is 96.755 degrees, and the state shown in 29I. 5H, when the rotational angle is 278.157 degrees.

When the loop-taker point 75 of the outer hook 70 picks up the loop of the upper thread 12 at the upper dead center of 0 degrees, it is found that the upper thread exit EX1 (i.e., the clearance to be established between the upper rotation stopper groove 85 of the inner hook and the upper inner hook stopper 93 of the inner hook stopper 90) is opened, whereas the upper thread entrance EN1 (i.e., the clearance to be established between the lower rotation stopper groove 86 of the inner hook and the lower inner hook stopper 95 of the inner hook stopper 90) is closed. When the outer hook 70 rotates counter-clockwise from the upper dead center of 0 degrees to 96.755 degrees, the upper thread entrance EN1 and exit EX1 are simultaneously closed. When the outer hook 70 subsequently rotates counter-clockwise, it is found that the inner hook 80 regulated in an eccentrically rotational movement by the lower inner hook stopper 95 is caused by the rotational movement of the outer hook 70 to revolve so that it is displaced by an eccentricity of 0.5 mm thereby to open the upper thread entrance EN1. While this upper thread entrance EN1 is opened (that is, while the loop-taker point is positioned from the angle of 96.755 degrees to 278.157 degrees), the loop-taker point 75 of the outer hook 70 can pass the loop of the upper thread 12 smoothly from the upper thread entrance EN1. When the outer hook 70 subsequently rotates counter-clockwise from 96.755 degrees to 278.157 degrees, both the upper thread entrance EN1 and exit EX1 are simultaneously closed. When the outer hook 70 subsequently rotates counter-clockwise, it is found that the inner hook 80 regulated in an eccentrically rotational movement by the lower inner hook stopper 95 is caused by the rotational movement of the outer hook 70 to revolve so that it is displaced by an eccentricity of 0.5 mm thereby to open the upper thread exit EX1. While this upper thread exit EX1 is opened (that is, while the loop-taker point is positioned from the angle of 278.157 degrees to 456.755 degrees), the loop-taker point 75 of the outer hook 70 can pass the loop of the upper thread 12 smoothly from the upper thread exit EX1.

Here, the positions of the upper rotation stopper groove 85 and the lower rotation stopper groove 86 of the inner hook 80 may be changed within the range of the angular space α1 from 110 degrees to 180 degrees, if the lower rotation stopper groove 86 can be arranged at the position where the loop of the upper thread 12 picked up by the loop-taker point 75 of the outer hook 70 is guided in, after it has been pulled in to the maximum, on the outer circumference of the inner hook 80, and if the upper rotation stopper groove 85 can be arranged at the position where the loop of the upper thread 12 is guided out from the outer circumference of the inner hook 80 and pulled upward of the throat plate 7. In this case, it is needless to say that the upper inner hook stopper 93 and the lower inner hook stopper 95 of the inner hook stopper 90 are arranged at the substantially equal angular spaces.

In the case of the angular space α1 of 180 degrees, for example, when the loop-taker point 75 of the outer hook 70 picks up the loop of the upper thread 12 from the upper dead center of 0 degrees and rotates counter-clockwise by 180 degrees to reach the lowermost point or the lower dead center, the upper thread 12 has been pulled in to the maximum so as to be guided out from the outer circumference of the inner hook 80. Therefore, the lower rotation stopper groove 86 of the inner hook 80 is located at the position which passes the lower dead center slightly so as to release the thread tension applied to the upper thread 12. In the lower rotation stopper groove 86 of the inner hook 80 disposed at that position, the upper thread 12 is released from the thread tension which has been so applied that the upper thread 12 may be guided out from the outer circumference of the inner hook 80. As a result, the upper thread 12 can be easily guided out through the clearance formed between the lower rotation stopper groove 86 of the inner hook 80 and the lower inner hook stopper 95 of the inner hook stopper 90. Moreover, the lower rotation stopper groove 86 of the inner hook 80 is arranged, if it is disposed near the lower dead center of the loop-taker point 75 of the outer hook 70, to oppose the upper inner hook stopper groove 85 with respect to the rotation center O1 of the outer hook 70. As a result, the displacement between the rotation center O of the lower shaft 8 and the rotation center O1 of the outer hook 70 can be reduced according to the angle of the angular space α1, even if the clearances to be formed between the upper rotation stopper groove 85 and the lower rotation stopper groove 86 of the inner hook 80, and the upper inner hook stopper 93 and the lower inner hook stopper 95 of the inner hook stopper 90 to engage with those grooves are equal to those of the case, in which the inner hook 80 used has the upper rotation stopper groove 85 and the lower rotation stopper groove 86 arranged to have the aforementioned angular space α1 smaller than 180 degrees.

On the other hand, the upper rotation stopper groove 85 of the case of the angular space α1 of 180 degrees is arranged at the position where the loop of the upper thread 12 is guided out from the outer circumference of the inner hook 80 and pulled upward of the throat plate 7. In order to prevent the looping (or the twisting) which might otherwise frequently occur in a highly twisted thread or a thread of poor slip after the upper thread 12 was guided out from the outer circumference of the inner hook 80, a projection 76' is formed at the inner hook holder 76, and hooks the loop of the upper thread 12 temporarily at the leaving time. The projection 76' is disposed near the upper dead center of 0 degrees of the loop-taker point 75 of the outer hook 70.

Thus, the angular space α1 or the angle, at which the upper rotation stopper groove 85 and the lower rotation stopper groove 86 of the inner hook 80 are arranged, is set more than 110 degrees but not more than 180 degrees. This is because a more stable tightening of threads is provided in a high-speed rotary sewing machine. Specifically, the loop of the upper thread 12 having been picked up by the loop-taker point 75 of the outer hook 70 is guided in, at the earliest timing after pulled in to the maximum, on the outer circumference of the inner hook 80. If the timing of pulling up the upper thread 12 is then made earlier, the time period for pulling up the upper thread 12 can be elongated to minimize the excess play of the upper thread around the inner hook 80 thereby to realize the stable tightening of the threads.

Here, the outer-hook-loop-taker-point type full rotation hook 10 has been described on the type, which makes two rotations for one cycle of the upward and downward movements of the needle 6. However, the full rotation hook should not be limited thereto, but similar actions and advantages can be obtained even if the full rotation hook makes one rotation for one cycle of the upward and downward movements of the needle 6. In short, the outer-hook-loop-taker-point type full rotation hook 10 may rotate at any speed for one cycle of the upward and downward movements of the needle 6, if the loop of the upper thread 12 picked up by the loop-taker point 75 for each predetermined rotation of the rotationally driven outer hook 70 can be guided in, after it was pulled out to the maximum by the outer circumference of the inner hook 80, on the outer circumference of the inner hook 80 and can be guided out from the outer circumference of the inner hook 80.

Figure 10:
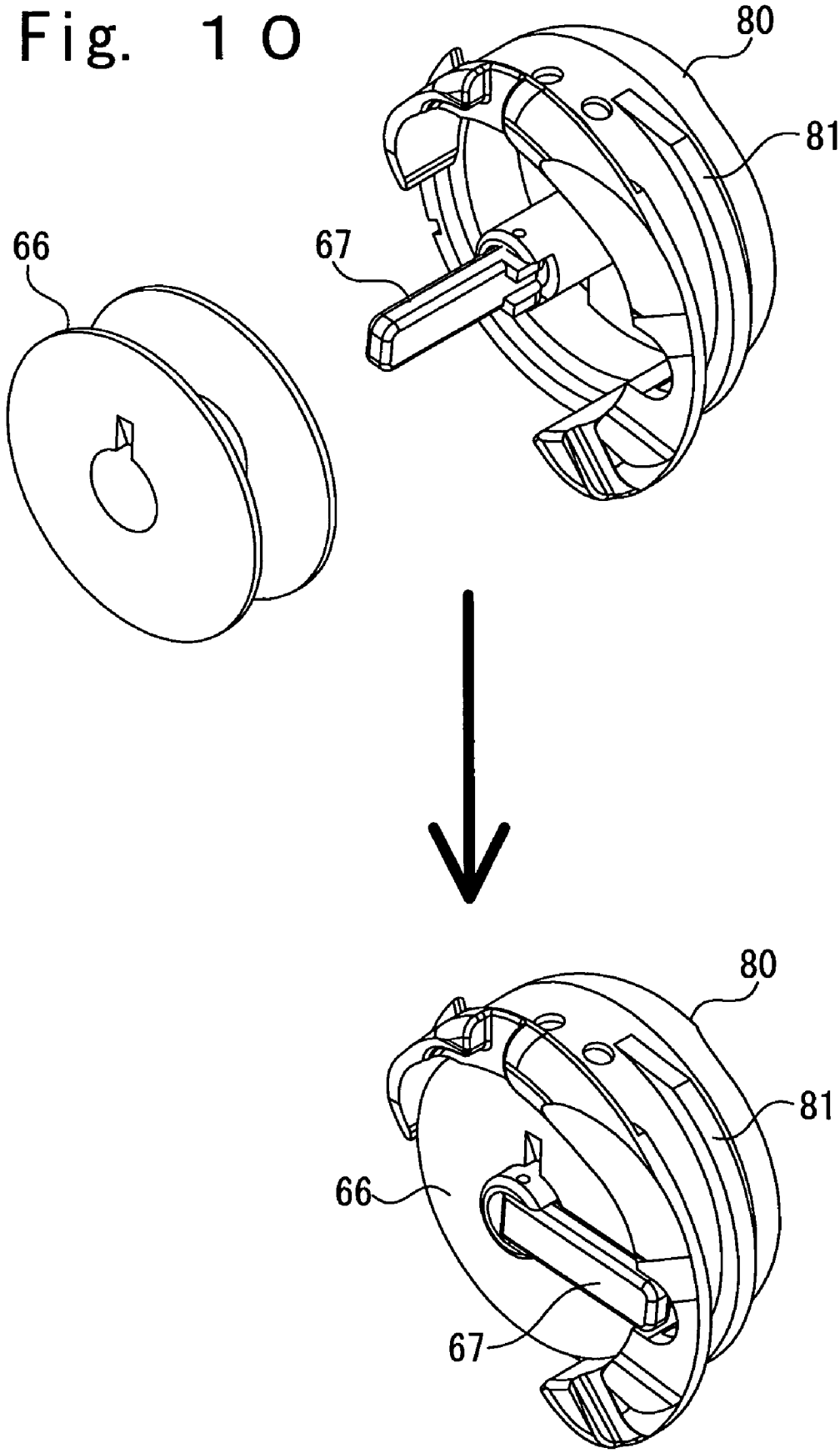
FIG. 10 An explanatory diagram showing the state of a shuttle bobbin to be directly accommodated in the inner hook of the outer-hook-loop-taker-point type full rotation hook of FIG. 1.

Moreover, the shuttle bobbin 66 itself may also be accommodated in the inner hook 80, as shown in FIG. 10. This structure is well known in the art, and the shuttle bobbin 66 is held, after accommodated in the inner hook 80, rotatably by a shuttle bobbin holder lever 67.

Embodiment 2

Inner-Hook-Loop-Taker-Point Type Full Rotation Hook (with Eccentric Driven Portion)

Figure 11:
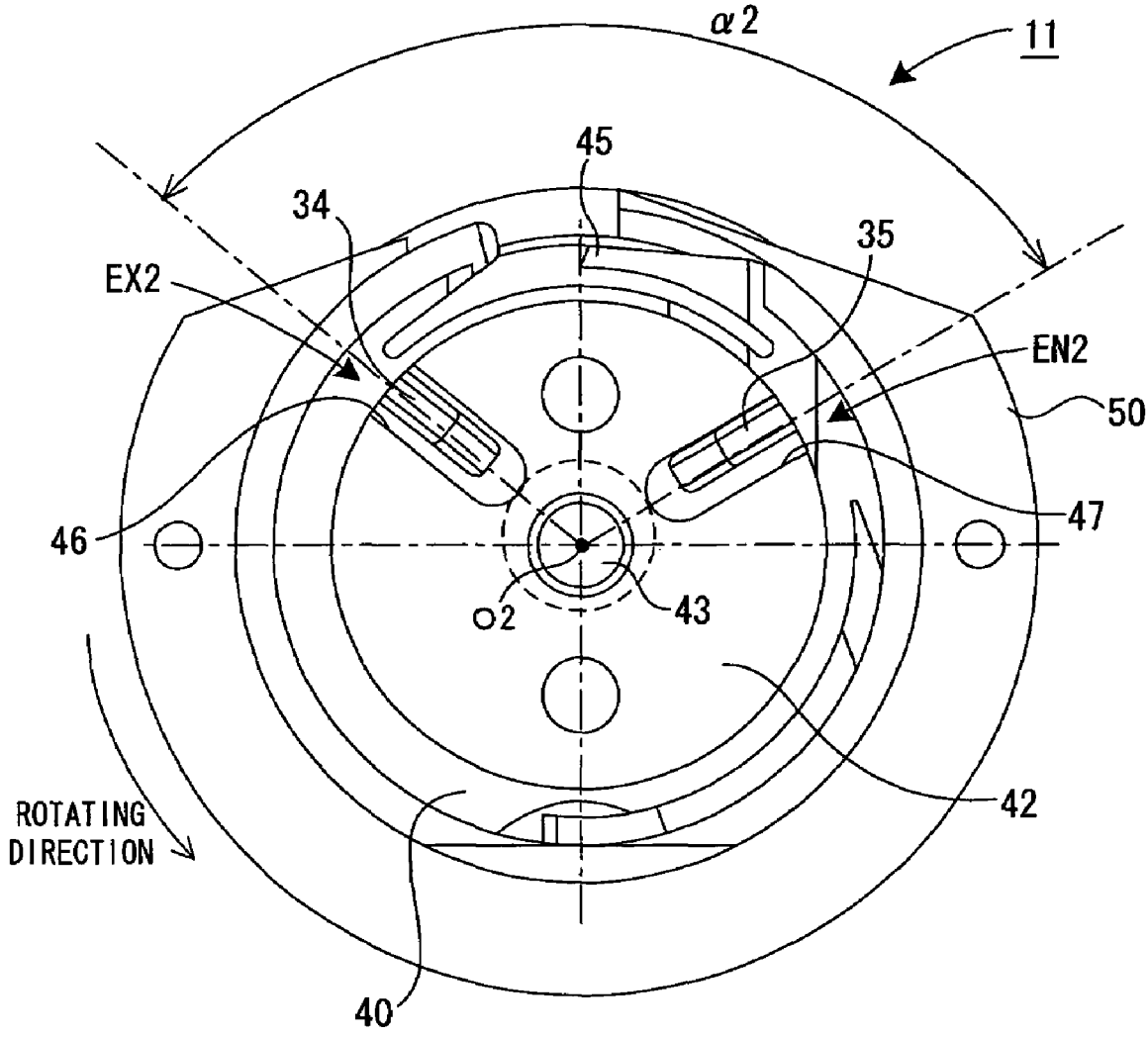
FIG. 11 An explanatory diagram showing one preferred mode of embodiment, in which the seam puckering preventing shuttle device of the sewing machine of the invention is applied to the inner-hook-loop-taker-point type full rotation hook.
Figure 12:
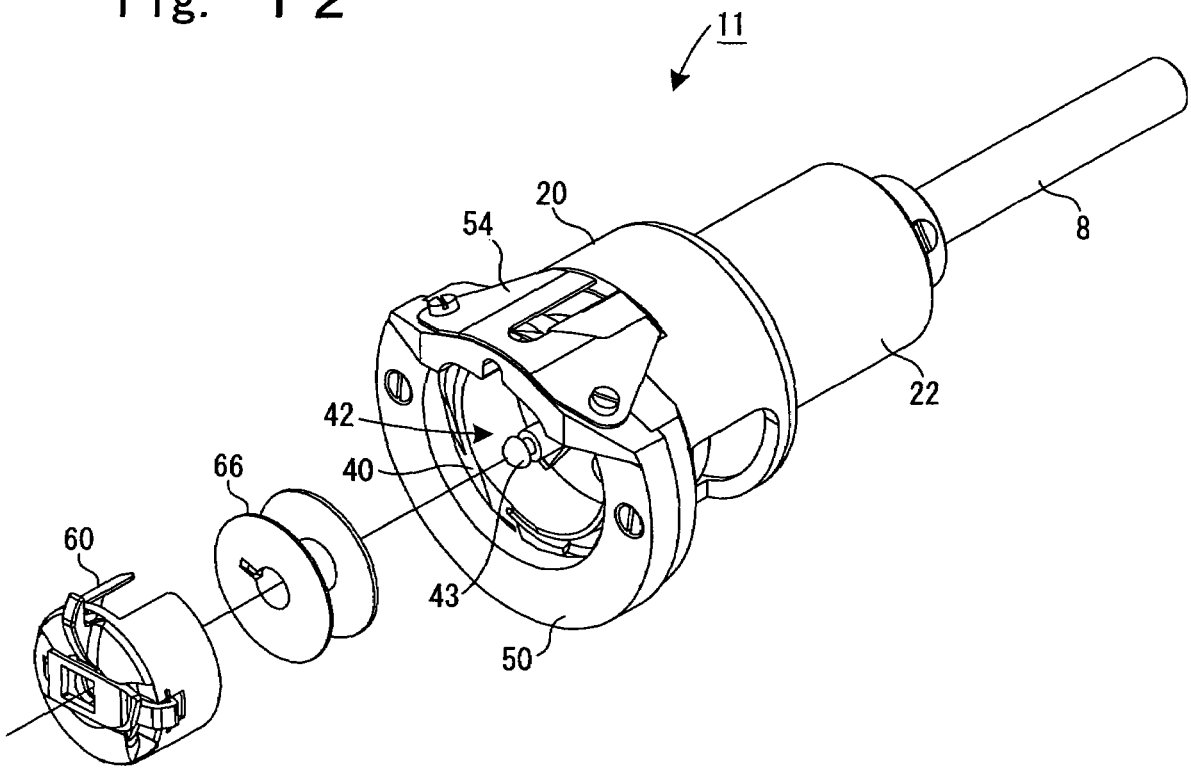
FIG. 12 A perspective view showing the inner-hook-loop-taker-point full rotation hook of FIG. 11.
Figure 13:
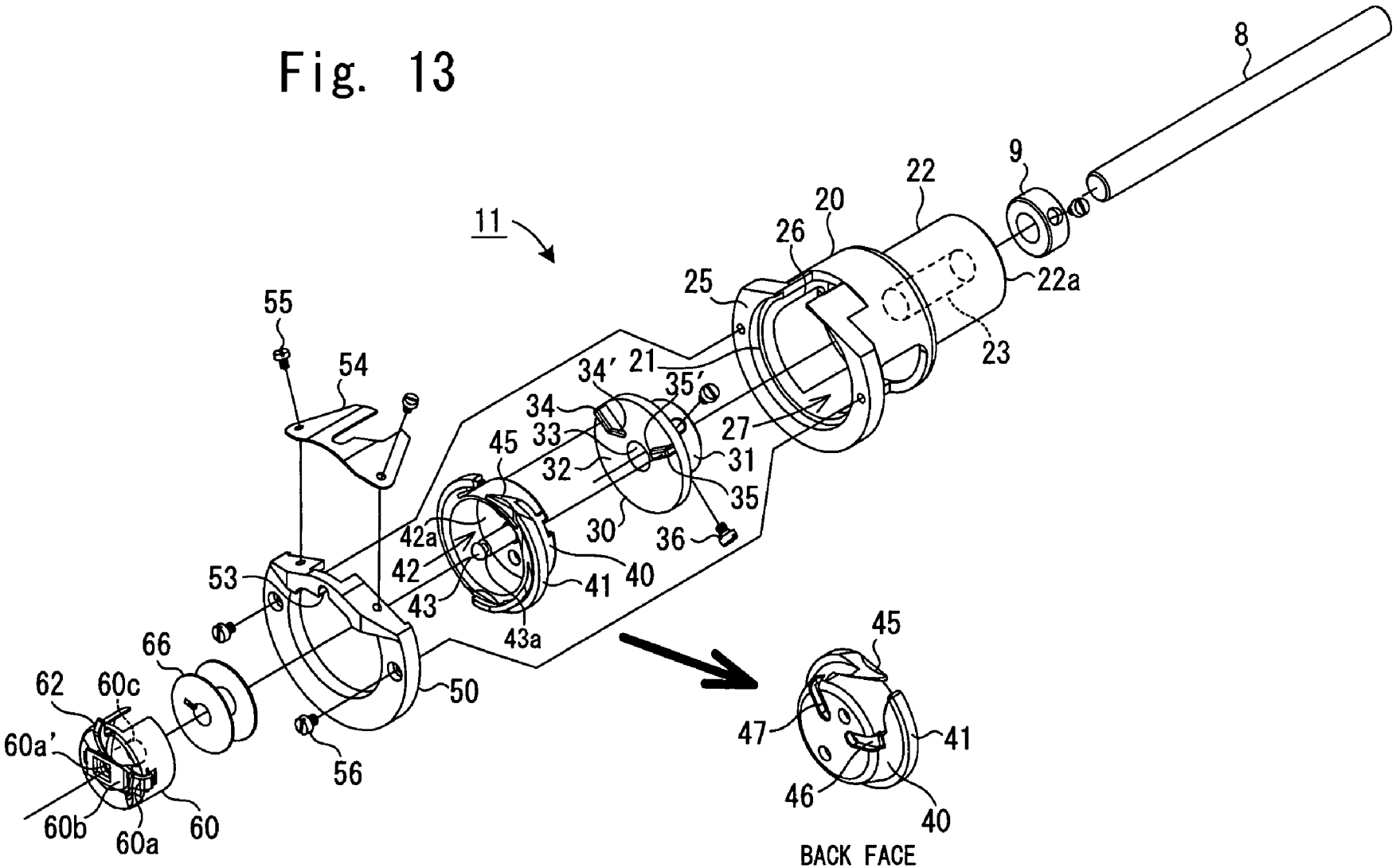
FIG. 13 An exploded perspective view showing the inner-hook-loop-taker-point full rotation hook of FIG. 11.
Figure 29A:
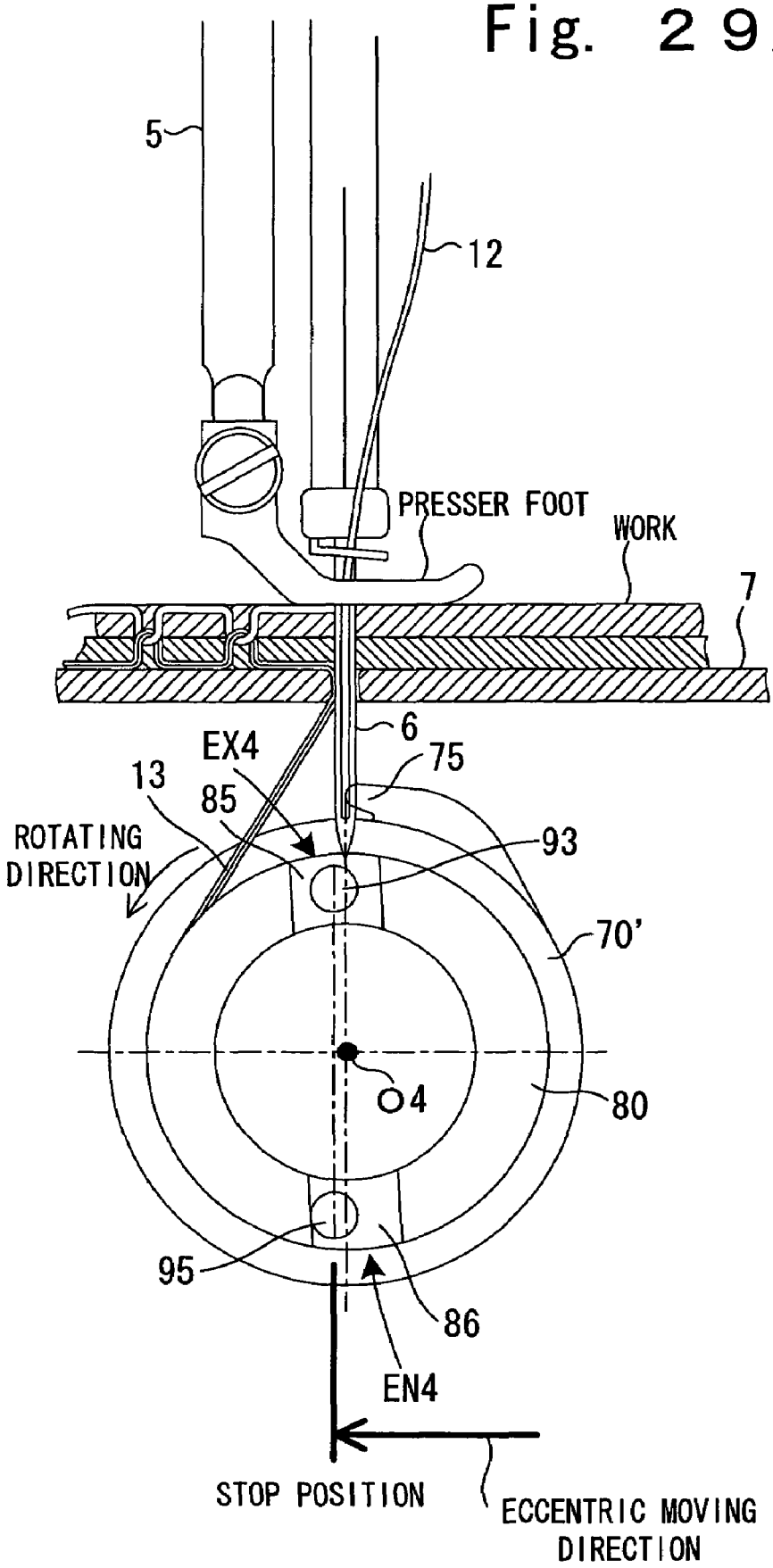
FIG. 29A An action explaining diagram showing an action state of the outer-hook-loop-taker-point type full rotation hook of FIG. 26.

The full rotation hook 1 shown in FIG. 4 may be an inner-hook-loop-taker-point type full rotation hook 11, as shown in FIG. 11, FIGS. 12 and 29I. 13. This full rotation hook 11 includes: a shuttle bobbin case 60 accommodating the shuttle bobbin 60 having a lower thread wound thereon and removably fixed on the frame (not-shown) of the machine body; an inner hook 40 accommodating the shuttle bobbin case 60, having a loop-taker point 45 and driven to rotate by the lower shaft 8 (as referred to FIG. 13) or one part of the rotation driving portion; and an outer hook 20 accommodating the inner hook 40 rotatably and prevented from rotating relative to the frame.

When the inner hook 40 is driven by the lower shaft 8 to rotate counter-clockwise in 29I. 11, the loop-taker point 45 is enabled to pick up the loop of the upper thread 12 to guide it around the outer circumference of the inner hook 40 through a clearance to be formed between the outer hook 20 and the inner hook 40. For conveniences, FIG. 11 presents a diagram, in which the shuttle bobbin case 60 is not accommodated.

Moreover, this inner-hook-loop-taker-point-type full rotation hook 11 includes two first driven portion 46 and second driven portion 47 arranged at circumferentially different positions of the inner hook 40, and is provided with two inner hook driving first projection 34 and inner hook driving second projection 35 acting as driving portions, which are loosely fitted on the driven portions 46 and 47, respectively, for driving the inner hook 40 to rotate. The first driven portion 46 and the second driven portion 47 of the inner hook 40 have their rotation center O2 (FIG. 14A) arranged eccentrically of the rotation center O of the lower shaft 8 or one part of the rotation driving portion, but the inner hook driving first projection 34 and the inner hook driving second projection 35 are arranged to have their rotation center concentric with the rotation center of the lower shaft 8 or one part of the rotation driving portion.

The first driven portion 46 and the second driven portion 47 are arranged to have their rotation center eccentric to the rotation center of the lower shaft 8. When the inner hook driving first projection 34 and the first driven portion 46 of one pair are in the driving state to drive the inner hook 40 to rotate, the inner hook driving second projection 35 and the second driven portion 47 of the other pair form an upper thread entrance EN2 for guiding the loop of the upper thread 12 on the driving portion side of the inner hook 40 (i.e., on the back side of the inner hook 40) before the loop of the upper thread 12 picked up by the look-taker point 45 for each predetermined rotation of the inner hook 40 is pulled out to the maximum by the loop-taker point 45. When the inner hook driving second projection 35 and the second driven portion 47 of one pair are in the driving state to drive the inner hook 40 to rotate, the inner hook driving first projection 34 and the first driven portion 46 of the other pair forms an upper thread exit EX2 for guiding out the loop of the upper thread 12 from the driving side of the inner hook 40 (i.e., on the back side of the inner hook 40). That is, when the inner hook driving first projection 34 and the first driven portion 46 of one pair are in the driving state to drive the inner hook 40 to rotate, the inner hook driving second projection 35 and the second driven portion 47 of one pair form the upper thread entrance EN2 for forming the clearance, through which the loop of the upper thread 12 picked up for each rotation of the inner hook 40 by the loop-taker point 45 is guided in on the outer circumference of the inner hook 40. When the inner hook driving second projection 35 and the second driven portion 47 of one pair are in the driving state to drive the inner hook 40 to rotate, the inner hook driving first projection 34 and the first driven portion 46 of one pair form the upper thread exit EX2 for forming the clearance, through which the loop of the upper thread 12 picked up for each rotation of the inner hook 40 by the loop-taker point 45 is guided out on the outer circumference of the inner hook 40.

This upper thread entrance EN2 is arranged in the phase, where the loop of the upper thread 12 picked up by the loop-taker point 45 is guided in on the outer circumference of the inner hook 40, and the upper thread exit EX2 is arranged in the phase where the loop of the upper thread 12 is guided up on the outer circumference of the inner hook 40 and pulled upward of the throat plate.

The angular space α2 between the upper thread entrance EN2 and the upper thread exit EX2 is set within a range from 90 degrees to 130 degrees. Here, the upper thread entrance EN2 and the upper thread exit EX2 are formed by the clearances which vary as the inner hook 40 rotates. The angular space a2 on the rotation center O2 of the first driven portion 46 and the second driven portion 47 of the inner hook 40 between the upper thread entrance EN2 and the upper thread exit EX2 expresses the value of an opening angle at the time when the clearance between the upper thread entrance EN2 and the upper thread exit EX2 becomes the maximum for the thread passage. Moreover, it has been confirmed in the operation tests of the inventors that the inner-hook-loop-taker-point type full rotation hook 11 normally operated as the hook within the range of 90 degrees to 130 degrees.

The rotation center of the first driven portion 46 and the second driven portion 47 is made eccentric in the opposite direction d2 (as referred to 29I. 15) of the upper dead center of the loop-taker point 45 with respect to the rotation center of the lower shaft 8 or the rotation driving portion.

The inner hook 40 is formed into a bottomed cylindrical shape having a shuttle bobbin case housing 42 on the inner side. The first driven portion 46 and the second drive portion 47 are formed of a long hole (in this embodiment) or a long groove extending circumferentially and radially to predetermined lengths. At the rotation center O2 (as referred to FIG. 11) of the bottom portion 42*a* of the shuttle bobbin case housing 42, there is protruded a stud pin 43, which acts as a center pin for mounting the shuttle bobbin case 60 rotatably. In the outer circumference of the leading end portion of the stud pin 43, a groove 43*a* for fixing the shuttle bobbin case 60 attached in the inner hook 40 is formed over the entire circumference. Here, the shuttle bobbin case 60 has a structure similar to that of the shuttle bobbin case 65 used in the outer-hook-loop-taker-point type full rotation hook 10, but is equipped with a horn 62, which engages with a horn groove 53 formed in a later-described hook cover 50 thereby to block the rotation of the shuttle bobbin case 60.

In the outer circumference of the inner hook 40, there is formed an inner hook race 41, which is so partially cut off along the outer circumference to bulge that it may be fitted in a race groove 21 formed in the later-described outer hook 20. The reason why the inner hook race 41 is thus partially cut away is to guide in the loop of the upper thread on the outer circumference of the inner hook 40 as in the well-known inner-hook-loop-taker-point type full rotation hook.

The inner hook driving first projection 34 and the inner hook driving second projection 35, which are loosely fitted on the first driven portion 46 and the second driven portion 47 of such inner hook 40, are disposed on a disc-shaped inner hook driving plate 32. This inner hook driving plate 32 is equipped with a inner hook driving boss 31, which is holed to have a lower shaft mounting hole 33 to be fitted and fixed on the lower shaft 8 by a fixing member 36 such as screws. The lower shaft mounting hole 33 of the inner hook driving plate 32 has a rotation center concentric with that of the lower shaft 8. Moreover, the inner hook driving first projection 34 and the inner hook driving second projection 35 are made of projections extending to a predetermined length in the circumferential direction of the inner hook driving plate 32.

Moreover, the first driven portion 46 and the second driven portion 47 of the inner hook 40 are arranged at circumferentially different positions of the inner hook 40 with the aforementioned angular space $\alpha 2$ from the rotation center O2 of the inner hook 40. By thus arranging the first driven portion 46 and the second driven portion 47, the loop of the upper thread 12 can be smoothly moved on the outer circumference of the inner hook 40.

The outer hook 20 basically as a structure similar to that of the well-known inner-hook-loop-taker-point-type full rotation hook. This full rotation hook 11 is formed into a bottomed cylinder portion including an inner hook housing 27 on the inner side for accommodating the inner hook 40 and an inner hook driving member 30, and a flange portion 25 on the opening side. The outer hook 20 is equipped with a mounting boss 22 having a lower shaft bore 23 for inserting the lower shaft 8, and the lower shaft bore 23 and the inner hook housing 27 have a rotation center concentric with that of the lower shaft 8. In the opening side of the inner hook housing 27 of the outer hook 20, moreover, there is formed the race groove 21 for rotating the inner hook 40 such that the inner hook race 41 of the inner hook 40 is fitted to slide. The rotation center of the race groove 21 is eccentric to the center of the lower shaft bore 23 so that the inner hook 40 performs a rotational movement at a position eccentric to the lower shaft 8 when the inner hook race 41 of the inner hook 40 rotates in a state sliding in the race groove 21.

The inner hook driving member 30 is inserted from its inner hook driving member boss 31 into the inner hook housing 27 of the outer hook 20, and is fixed on the lower shaft 8 inserted into the lower shaft bore 23 of the mounting boss 22 of the outer hook 20, by the fixing member 36 such as screws. The inner hook driving member 30 accommodated in the inner hook housing 27 of the outer hook 20 can be positionally adjusted by a thrust collar 9, which is arranged on the rear end face 22*a* of the mounting boss 22 and fixed on the lower shaft 8. As a result, the rotational movement of the lower shaft 8 is transmitted to the inner hook driving member 30 without any looseness in the axial direction of the lower shaft 8. Thus, the inner hook 40 is so accommodated in the inner hook housing 27 of the outer hook 20 that the first driven portion 46 and the second driven portion 47 of the inner hook 40 may be loosely fitted on the inner hook driving first projection 34 and the inner hook driving second projection 35 of the inner hook driving member 30, which is accommodated in the inner hook housing 27 of the outer hook 20. Moreover, the hook cover 50 is so fixed on the flange portion 25 of the outer hook 20 by a fixing member 56 such as screws that the inner hook 40 accommodated in the inner hook housing 27 of the outer hook 20 may not come out. This hook cover 50 is formed into such a ring shape as to cover the flange portion 25 of the outer hook 20, and covers the inner hook race 41 of the inner hook 40, when it is fixed on the flange portion 25, so that it can clamp the inner hook race 41 rotatably. In the inner circumference side of the hook cover 50, the horn groove 53 is formed to engage with the horn 62 of the shuttle bobbin case 60.

On the other hand, the outer hook 20 is provided on its opening side with a needle drop notch 26, which is cut to the inner hook housing 27 so that the needle 6 can enter when the inner-hook-loop-taker-point-type full rotation hook 11 is assembled into the bed portion 3 of the sewing machine body. Around the needle drop notch 26 of the outer hook 20, moreover, an upper spring 54 for guiding the upper thread 12 is fixed by a fixing member 55 such as screws.

When the outer hook 20, the inner hook driving member 30 and the inner hook 40 thus constructed are assembled, clearances of predetermined width for functioning as the upper thread entrance EN2 and exit EX2 are formed between the inner hook driving first projection 34 of the inner hook driving member 30 and the first driven portion 46 of the inner hook 40 and between the inner hook driving second projection 35 of the inner hook driving member 30 and the second driven portion 47 of the inner hook 40. Since the rotation center O2 of the first driven portion 46 and the second driven portion 47 of the inner hook 40 is offset with respect to the rotation center of the inner hook driving first projection 34 and the inner hook driving second projection 35 of the inner hook driving member 30, those upper thread entrance EN2 and exit EX2 are so basically constructed that, when the inner hook 40 is rotated as the inner hook driving member 30 rotates, one pair combination of the inner hook driving first projection 34 and the first driven portion 46 comes into contact to transmit the rotational movement of the inner hook driving member 30 whereas the other pair combination of the inner hook driving second projection 35 and the second driven portion 47 does not contact but establishes the clearance not to transmit the rotational movement of the inner hook driving member 30. This structure is an application of the Slotted-link Mechanism. On the other hand, the first driven portion 46 and the second driven portion 47 of the inner hook 40 are formed of a long hole or a long groove extending circumferentially and radially of the inner hook 40 to predetermined lengths, and the inner hook driving first projection 34 and the inner hook driving second projection 35 of the inner hook driving member 30 are formed of projections extending circumferentially of the inner hook driving plate 32 to predetermined lengths. As a result, the inner hook driving first projection 34 and the inner hook driving second projection 35 of the inner hook driving member 30 can be longitudinally allowed to slide by the eccentricity of the first driven portion 46 and the second driven portion 47 of the inner hook 40.

Next, the hook actions of the inner-hook-loop-taker-point type full rotation hook 11, which is provided with those two upper thread entrance and exit EN2 and EX2 and in which the inner hook 40 makes rotational movements relative to the outer hook 20 in synchronism with the needle 6, upon the upper thread 12 are described with reference to FIG. 14. In this action description, the direction is so taken as views 29I. 14 in front.

Here, this inner-hook-loop-taker-point type full rotation hook 11 makes two rotations for one cycle of the upward and downward movements of the needle 6. In FIG. 14 to be used for explaining the hook actions, it is assumed that the inner hook 40 for eccentrically rotational movements rotates eccentrically counter-clockwise when the inner hook driving member 30 makes a rotational movement through the lower shaft 8. For conveniences, the action description is started from the state (FIG. 14A, in which the needle having the upper thread 12 inserted thereinto has risen a predetermined length, e.g., 2 mm from the lower dead center and in which the loop-taker point 45 of the inner hook 40 has been positioned at the upper dead center. At this position, the first driven portion 46 and the second driven portion 47 of the inner hook 40 are arranged substantially symmetrically with respect to the axial line extending in the axial direction of the needle 6 to the needle 6, and the inner hook driving first projection 34 of the inner hook driving member 30 is offset to the wall of the backward rotation side of the first driven portion 46 of the inner hook 40 while having a clearance from the right and left walls of the first driven portion 46 whereas the inner hook driving second projection 35 of the inner hook driving member 30 abuts against the wall on the side of the rotational direction of the second driven portion 47 of the inner hook 40.

For conveniences, moreover, the inner hook driving first projection 34 and the inner hook driving second projection 35 of the inner hook driving member 30 are shown by circles in FIG. 14.

When the needle 6 begins to rise from the aforementioned state, the upper thread 12 inserted into the needle 6 is pressed by the cloth through which the upper thread 12 penetrates together with the needle 6 at the upper face of the thread plate 7 so that it is not raised together with the needle 6 but left to form the loop.

Figure 14A:
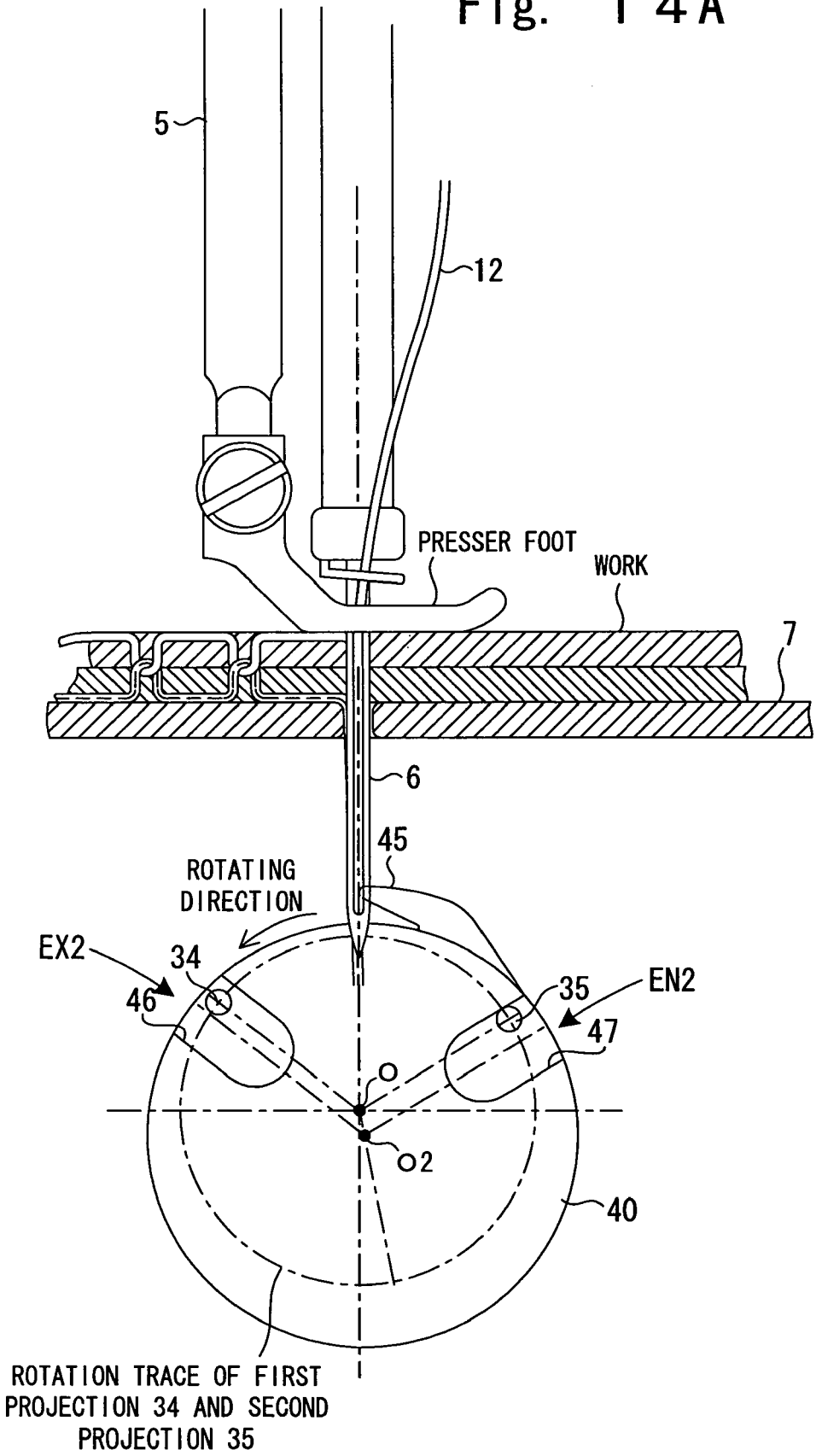
FIG. 14A An action explaining diagram showing an action state of the inner-hook-loop-taker-point type full rotation hook of FIG. 11.
Figure 14B:
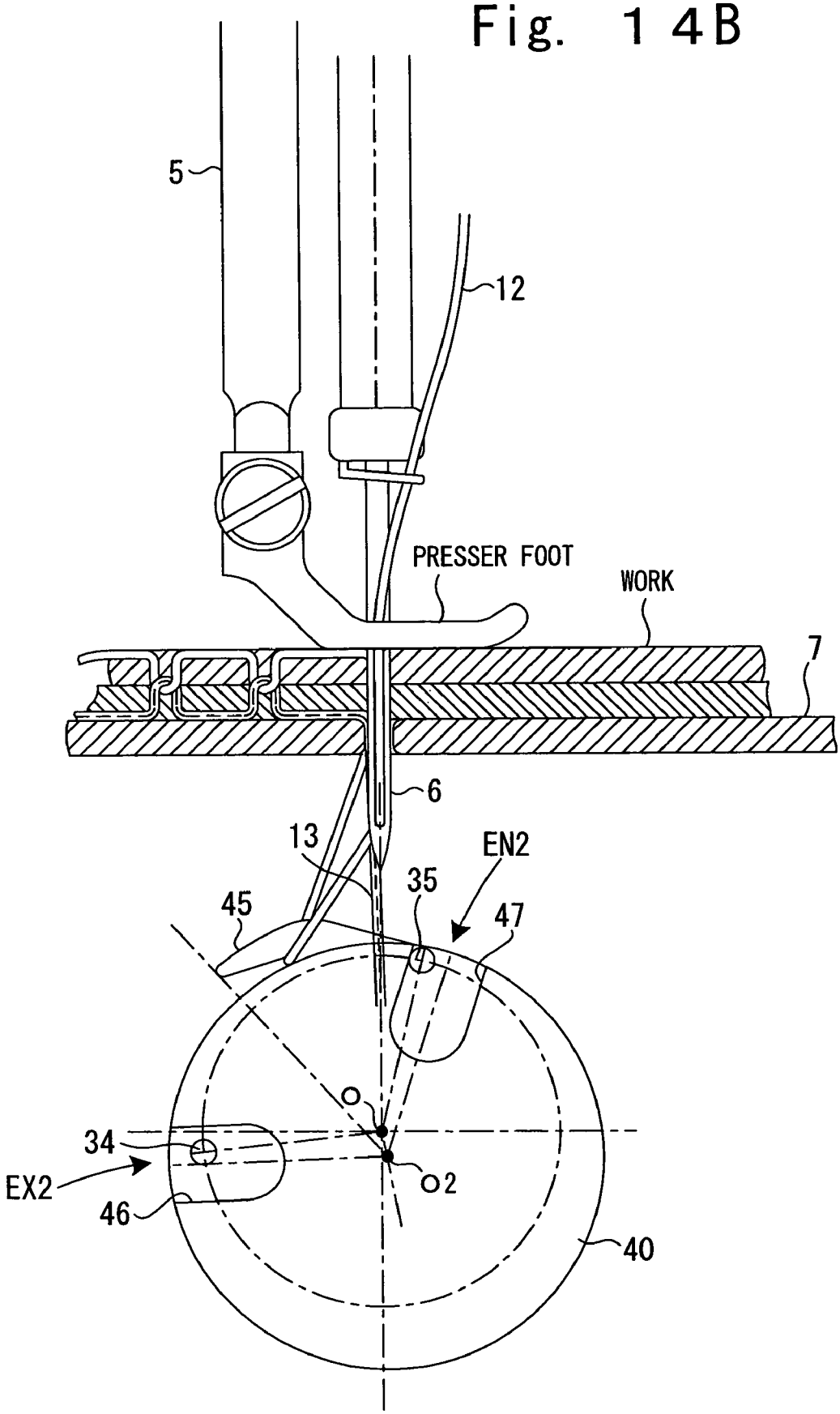
FIG. 14B An action explaining diagram showing an action state of the inner-hook-loop-taker-point type full rotation hook of FIG. 11.
Figure 14C:
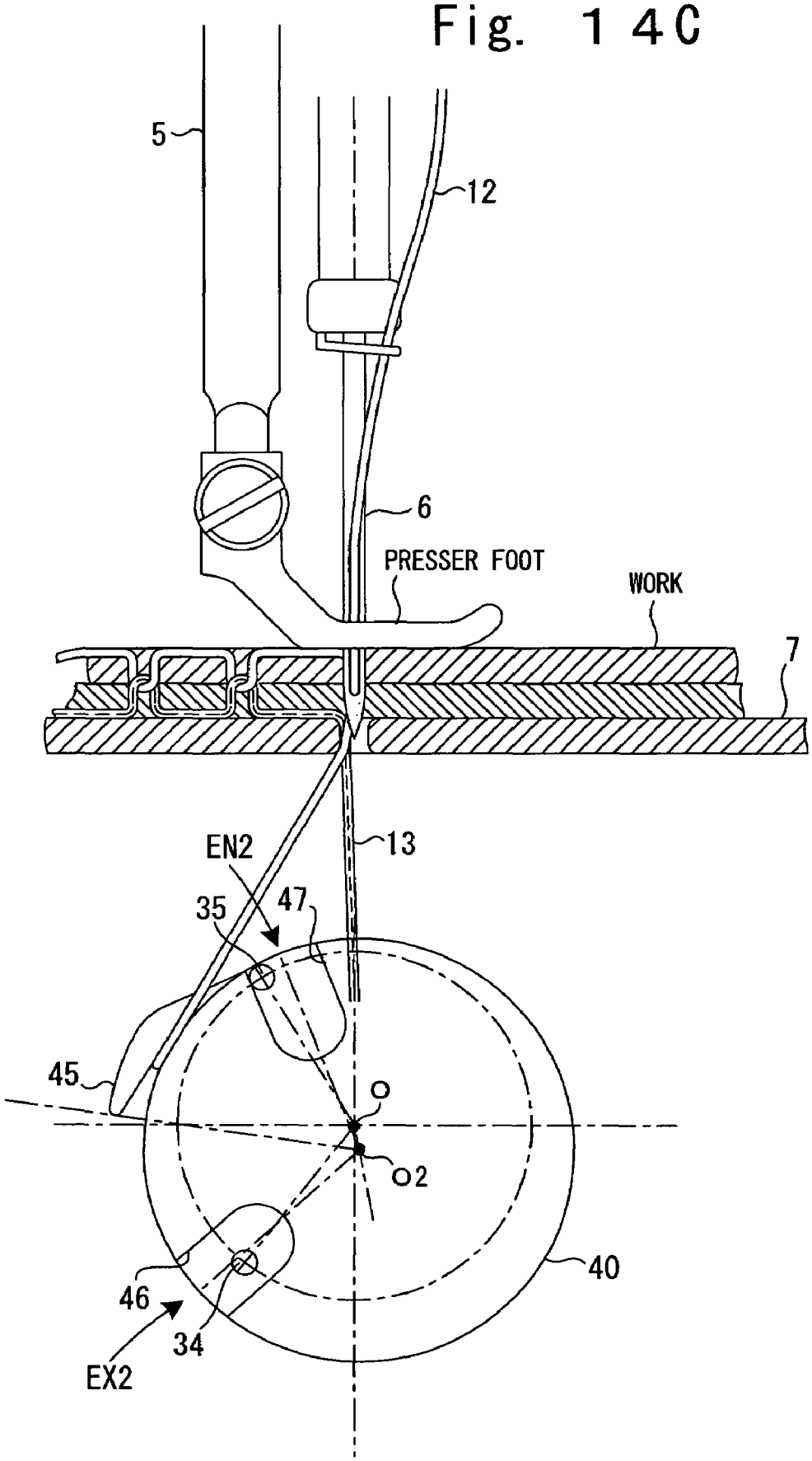
FIG. 14C An action explaining diagram showing an action state of the inner-hook-loop-taker-point type full rotation hook of FIG. 11.

As shown in FIGS. 14B and 14C, the loop of the upper thread 12 is picked up on the outer circumference of the inner hook 40 by the loop-taker point 45 of the inner hook 40 which makes an eccentric rotation in the counter-clockwise direction. At this time, the inner hook 40 is eccentrically rotated in the counter-clockwise direction by the inner hook driving second projection 35 of the inner hook driving member 30 so that the inner hook driving first projection 34 of the inner hook driving member 30 gradually leaves the wall on the rotationally backward side of the first driven portion 46 of the inner hook 40 and comes gradually closer to the wall in the rotational direction.

Figure 14D:
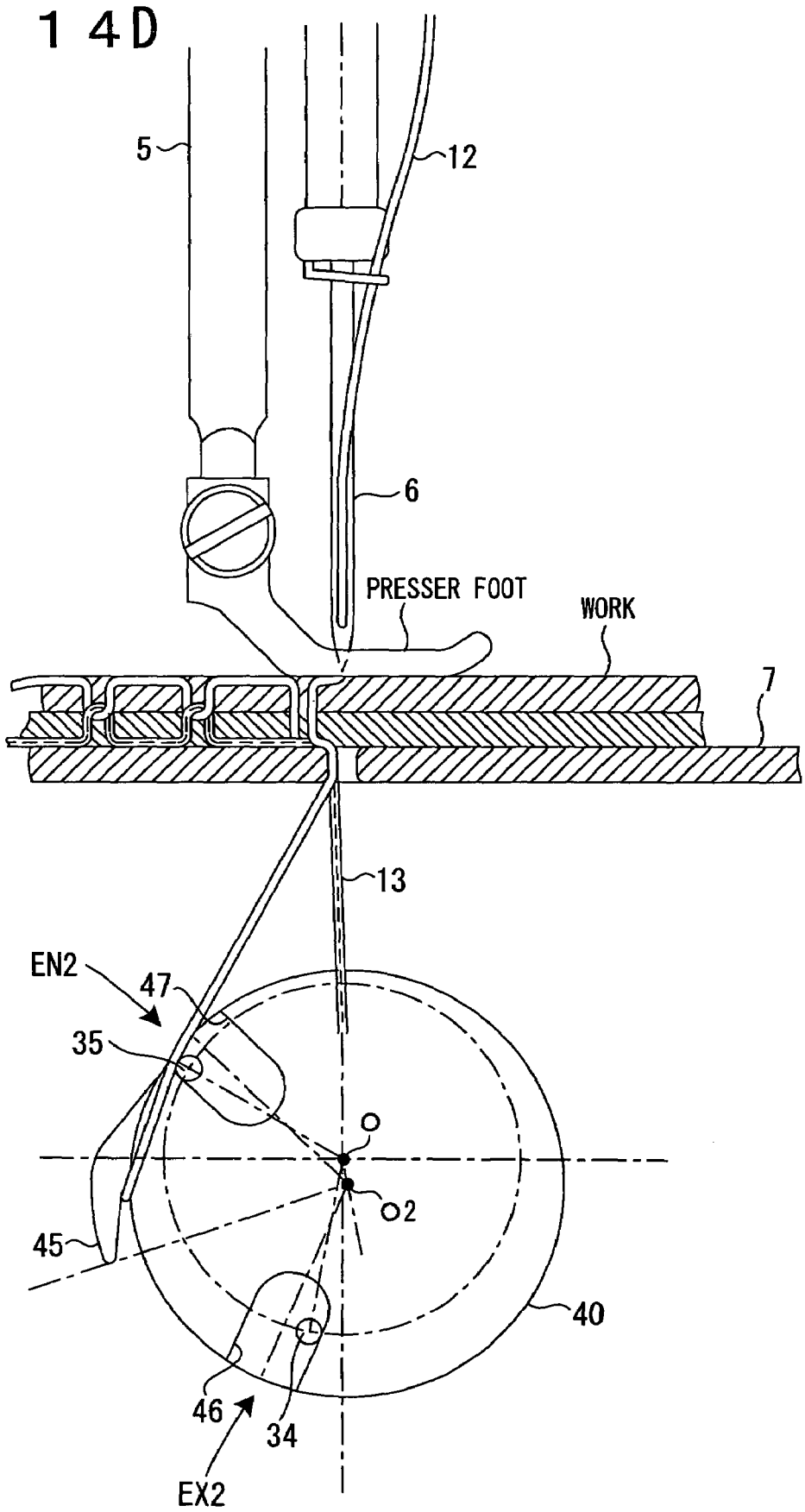
FIG. 14D An action explaining diagram showing an action state of the inner-hook-loop-taker-point type full rotation hook of FIG. 11.
Figure 14E:
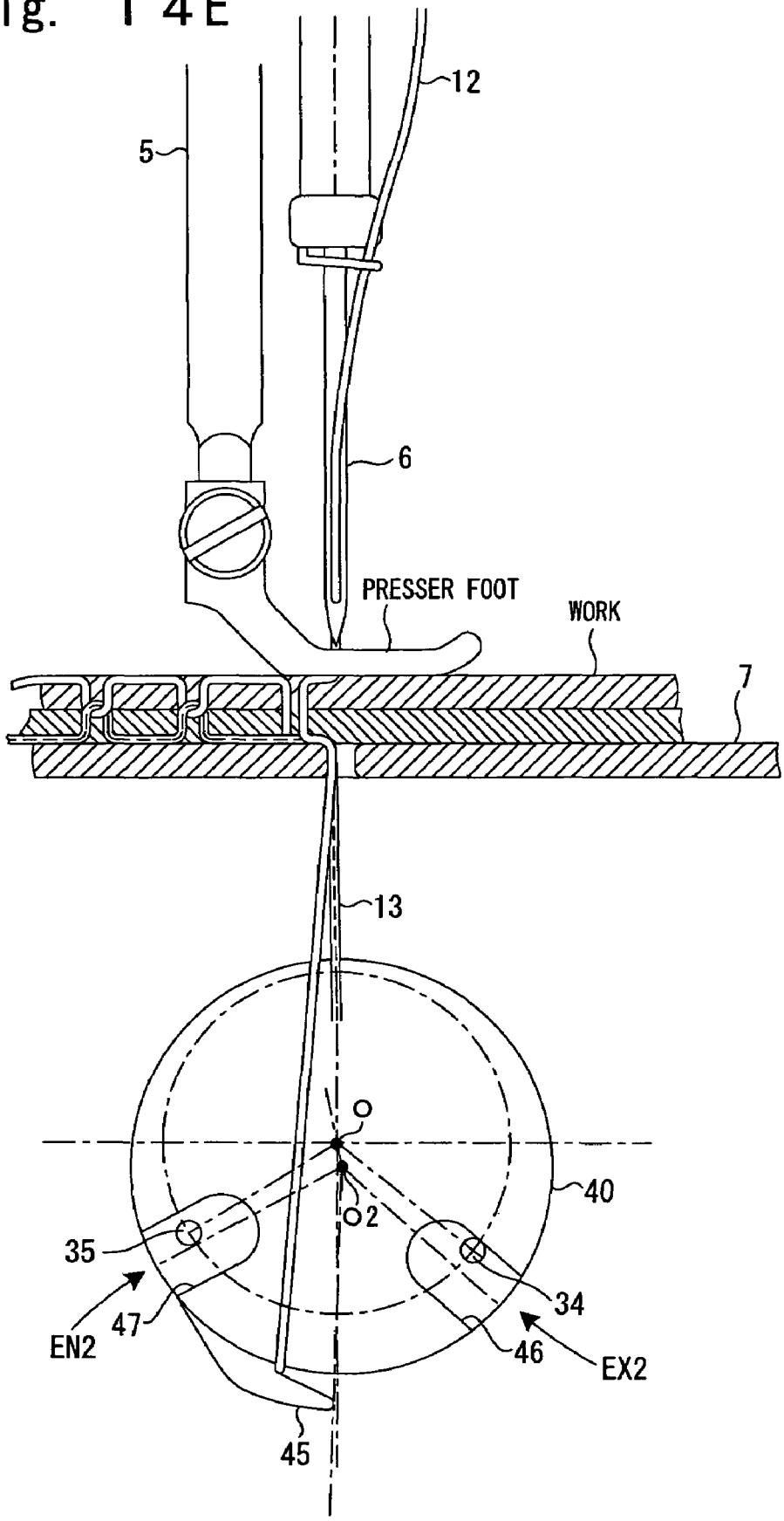
FIG. 14E An action explaining diagram showing an action state of the inner-hook-loop-taker-point type full rotation hook of FIG. 11.

As the loop of the upper thread 12 pulled on the outer circumference of the inner hook 40 is guided downward by the loop-taker point 45 being moved by the eccentric rotational movement of the inner hook 40, as shown in FIGS. 14D and 14E, the inner hook driving first projection 34 of the inner hook driving member 30 comes into the wall on the rotational side of the first driven portion 46 of the inner hook 40, so that the inner hook 40 is eccentrically rotated counter-clockwise by that inner hook driving first projection 34. On the other hand, the inner hook driving second projection 35 of the inner hook driving member 30 gradually leaves the wall on the rotational side of the second driven portion 47 of the inner hook 40. It occurs while the second driven portion 47 of the inner hook 40 and the inner hook driving second projection 35 of the inner hook driving member 30 are rotationally moving on the lower side that the clearance for the upper thread entrance EN2 is formed between the second driven portion 47 and the inner hook driving second projection 35. The loop of the upper thread 12 to be guided downward by the loop-taker point 45 of the inner hook 40 can be passed through the clearance or that upper thread entrance EN2. Here on the inner hook driving second projection 35 of the inner hook driving member 30, there is formed a slope 35', which goes down from the circumference of the inner hook driving plate 32 toward the rotation center. The upper thread 12 is enabled to slide on that slope 35' so that it can be smoothly passed through the clearance of the upper thread entrance EN2.

Figure 14F:
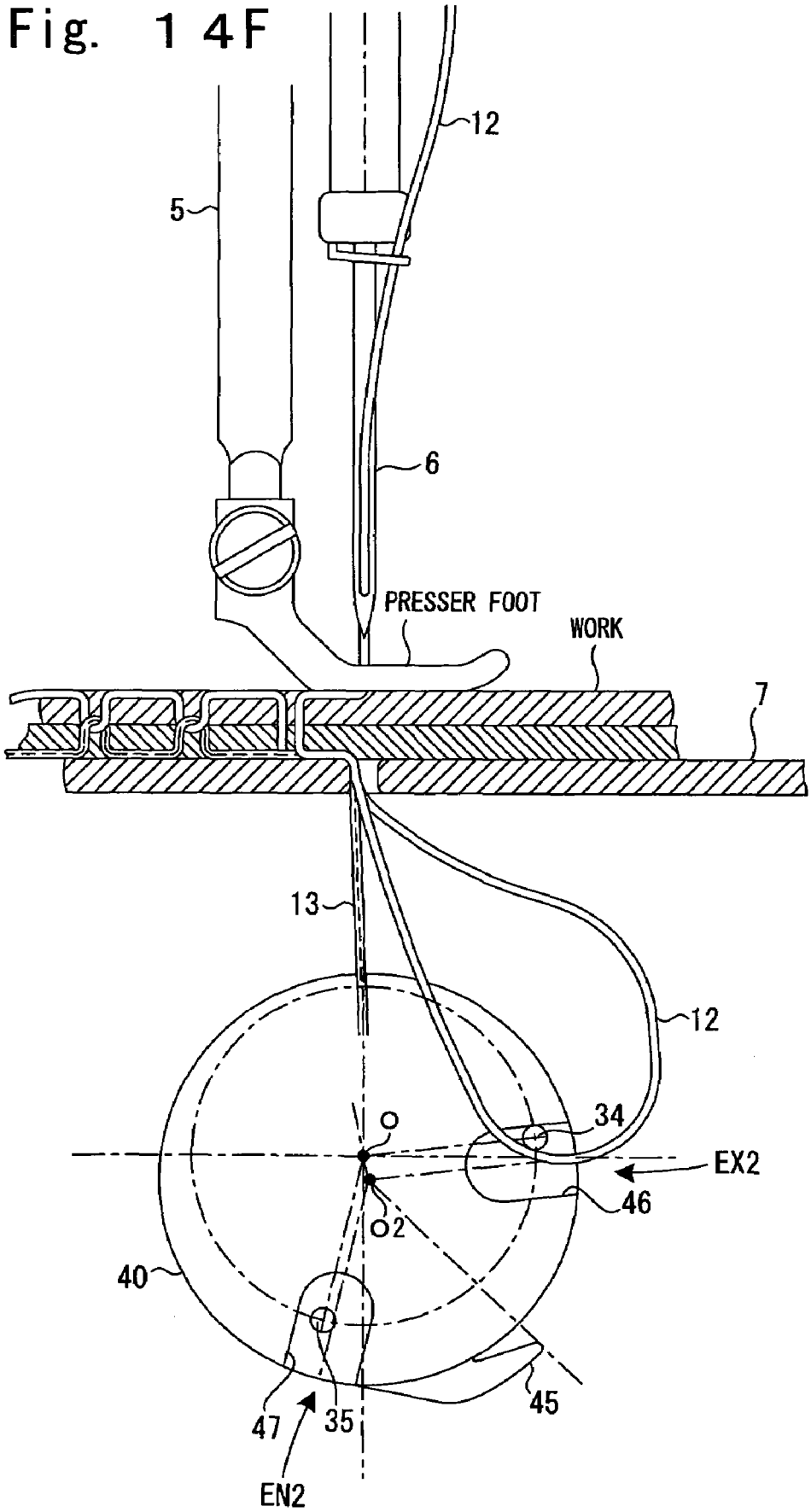
FIG. 14F An action explaining diagram showing an action state of the inner-hook-loop-taker-point type full rotation hook of FIG. 11.
Figure 14G:
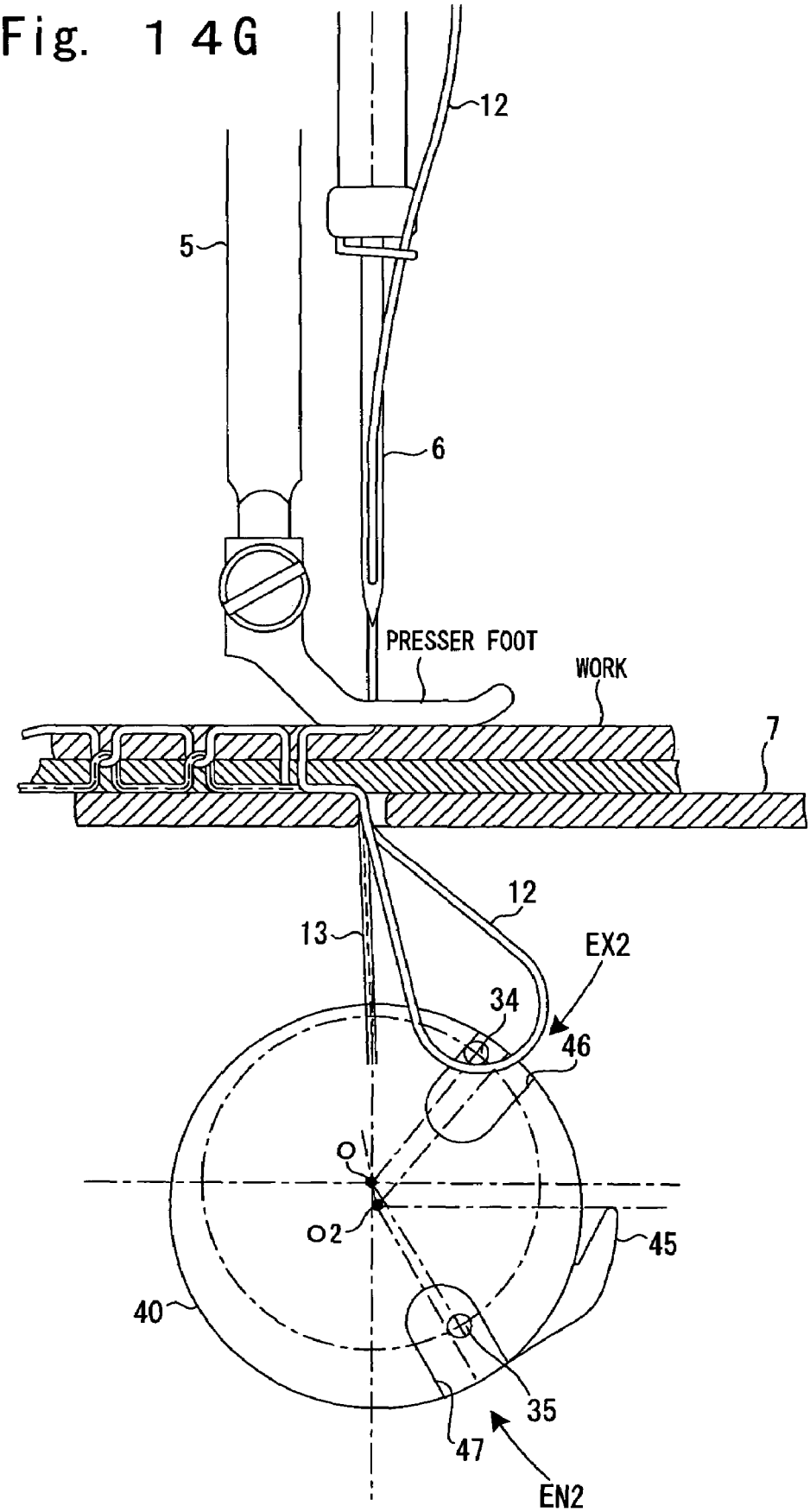
FIG. 14G An action explaining diagram showing an action state of the inner-hook-loop-taker-point type full rotation hook of FIG. 11.

As the loop of the upper thread 12 guided downward of the outer circumference of the inner hook 40 is further guided to the righthand side by the loop-taker point 45 being moved by the eccentrically rotational movement of the inner hook 40, as shown in FIGS. 14F and 14G, the inner hook driving second projection 35 of the inner hook driving member 30 does not abut against the wall on the rotationally backward side of the second driven portion 47 of the inner hook 40 but again comes gradually closer to the wall of the rotational side of the second driven portion 47 of the inner hook 40. Here, the inner hook driving first projection 34 of the inner hook driving member 30 remains in abutment against the wall of the rotational side of the first driven portion 46 of the inner hook 40.

Figure 14H:
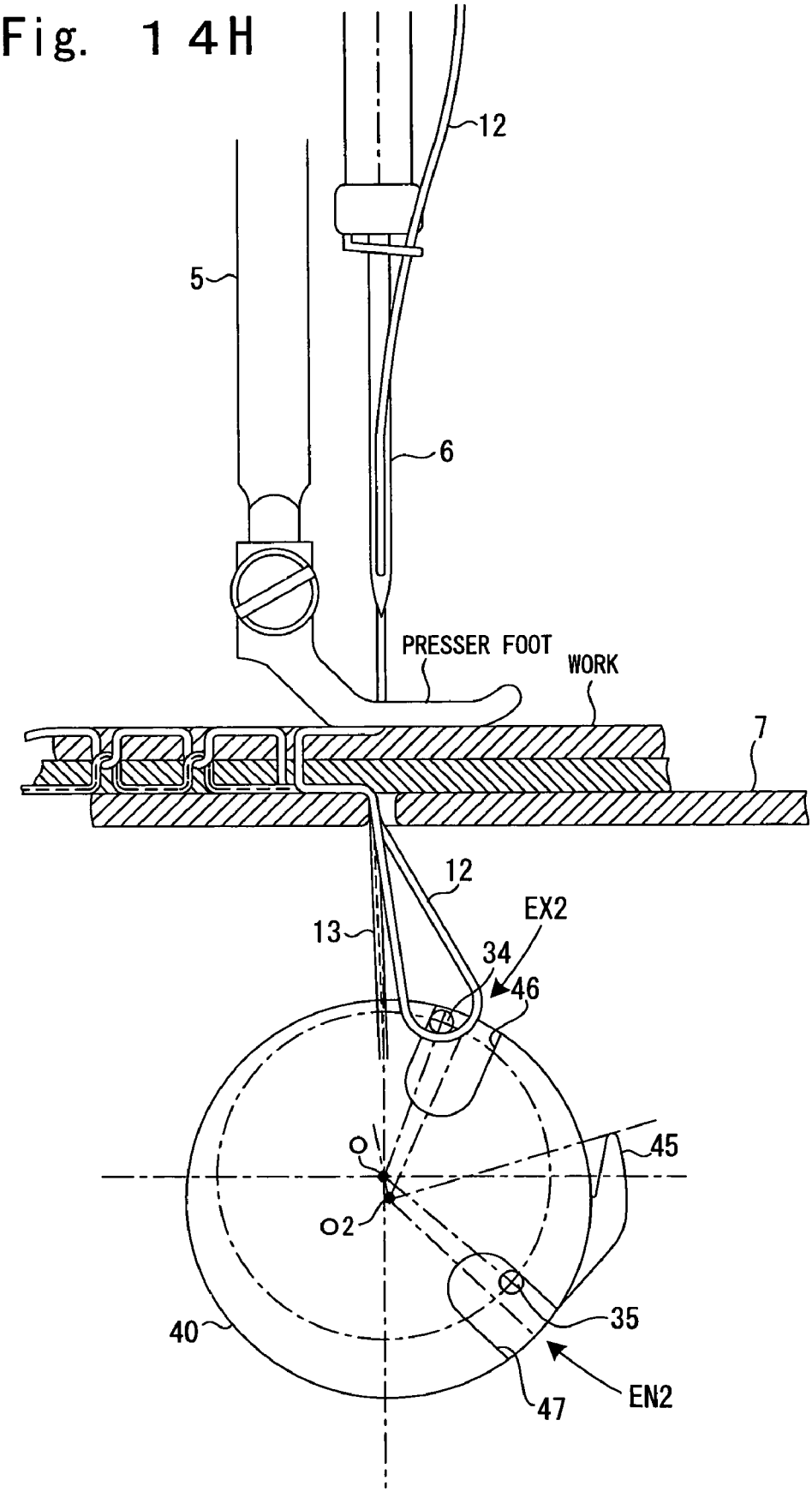
FIG. 14H An action explaining diagram showing an action state of the inner-hook-loop-taker-point type full rotation hook of FIG. 11.
Figure 141:
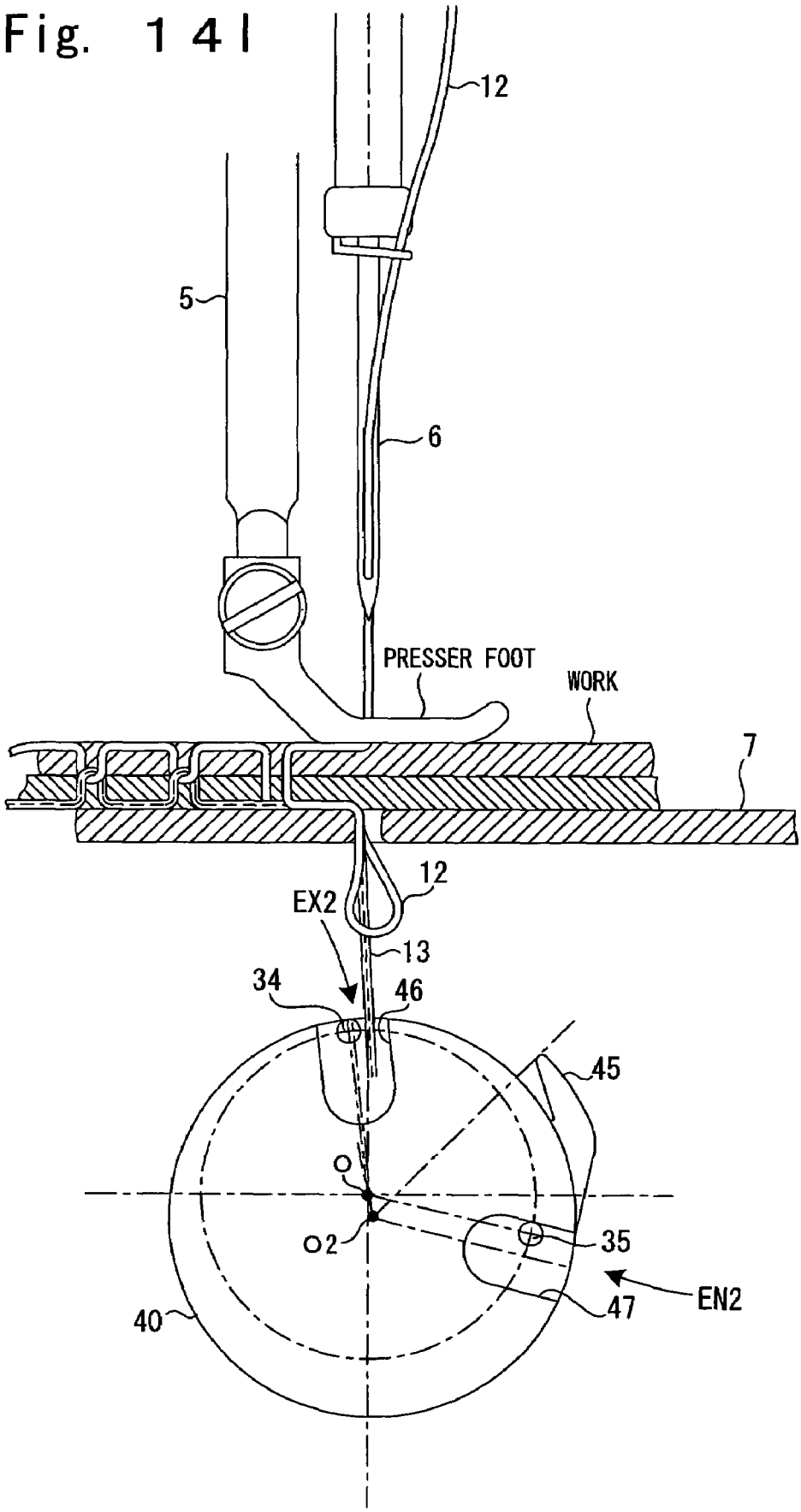

As shown in FIG. 14H, the thread take-up lever 14 (as referred to FIG. 4) pulls up the upper thread 12 guided out from the inner hook 40. In this state, however, the inner hook driving first projection 34 and the inner hook driving second projection 35 of the inner hook driving member 30 are still in abutment against the walls on the rotational side of the first driven portion 46 and the second driven portion 47 of the inner hook 40, respectively, to rotate the inner hook 40 eccentrically.

As the inner hook 40 performs a further eccentrically rotational movement from the state of FIG. 14H, the inner hook driving first projection 34 of the inner hook driving member 30 gradually leaves the wall on the rotational side of the first driven portion 46 of the inner hook 40, as shown in FIG. 14I. As a result, the clearance for the upper thread exit EX2 is formed between the first driven portion 46 of the inner hook 40 and the inner hook driving first projection 34 of the inner hook driving member 30 so that the upper thread 12 pulled up by the thread take-up lever 14 passes through the clearance for that upper thread exit EX2 and interlaces with the lower thread 13 thereby to form lock stitches in the work. Like the inner hook driving second projection 35, the inner hook driving first projection 34 of the inner hook driving member 30 is equipped with a slope 34', which goes down from the circumference of the inner hook driving plate 32 toward the rotation center. The upper thread 12 can slide on the slope 34' so that it can be smoothly passed through the clearance for the upper thread exit EX2. Here, the inner hook driving member 30 and the inner hook 40 perform one more rotation till the needle 6 returns to the position shown in FIG. 14A.

Thus, while the inner hook driving member 30 is performing one rotational movement, the inner hook 40 performs an eccentrically rotational movement with a displacement of the eccentricity. When the upper thread 12 of the needle 6 is picked by the loop-taker point 45 of the inner hook 40 so that the loop of the upper thread 12 is guided in on the outer circumference of the inner hook 40, the clearance can be formed between the second drive portion 47 of the inner hook 40 and the second projection 35 of the inner hook driving member 30 thereby to guide in the upper thread 12 smoothly on the outer circumference of the inner hook 40. When the inner hook 40 performs the eccentric rotation so that the upper thread 12 is guided out from the inner hook 40, the clearance can be formed between the first driven portion 46 of the inner hook 40 and the first projection 34 of the inner hook driving member 30 when the thread take-up lever 14 takes up the upper thread 12 thereby to pull up the upper thread 12 by the thread take-up lever 14 without any resistance at the extraction from the rotation hook.

This inner-hook-loop-taker-point type full rotation hook 11 is further described on a specific example.

Figure 15:
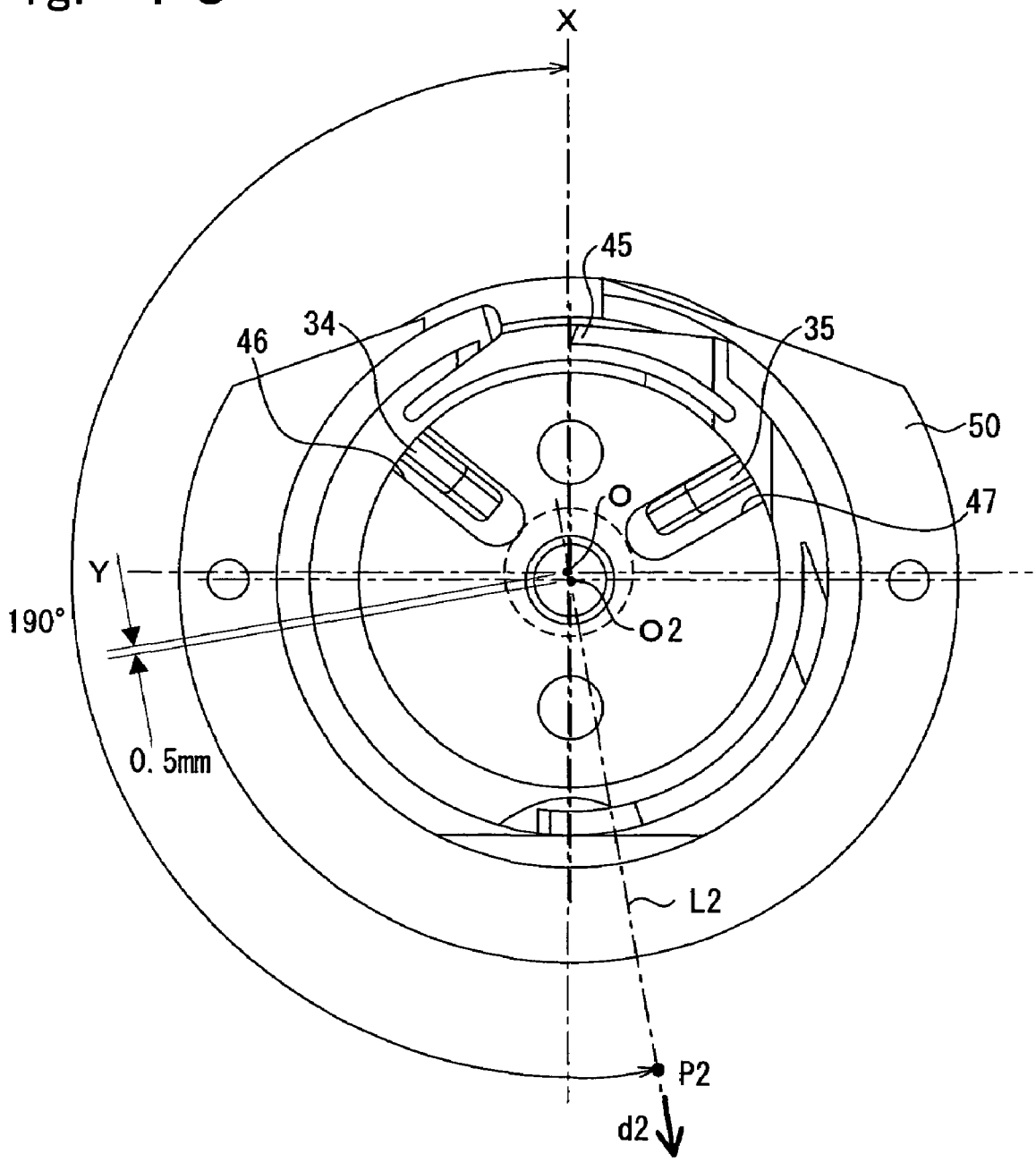
FIG. 15 An explanatory diagram showing a specific example of the inner hook to be used in the inner-hook-loop-taker-point type full rotation hook of FIG. 11.

In the inner-hook-loop-taker-point type full rotation hook 11 of a general size, as shown in FIG. 15, the upper thread entrance EN2 is arranged in the phase where the loop of the upper thread 12 picked up by the loop-taker point 45 is guided in on the outer circumference of the inner hook 40, and the upper thread exit EX2 is arranged in the phase where the loop of the upper thread 12 is guided out from the outer circumference of the inner hook 40 and pulled upward of the throat plate 7.

The angular space $\alpha 2$ between the upper thread entrance EN2 and the upper thread exit EX2 is arranged at an angle of 90 degrees to 130 degrees at circumferential different positions across the upper dead center of the loop-taker point 45.

The rotation center O2 of the first driven portion 46 and the second driven portion 47 is eccentric to the rotation center O of the lower shaft 8 or the rotation driving portion in the opposite direction of the upper dead center of the loop-taker point.

In case the loop-taker point 45 is positioned at the upper dead center with respect to the rotation center O of the lower shaft 8, the eccentric direction d2 of the rotation center O2 of the inner hook 40 is located, as FIG. 15 is viewed in front, on a straight line L2 joining a position P2 rotated counter-clockwise by 190 degrees from the positive side of a Y-axis with respect to the rotation center O of the lower shaft 8 and the rotation center O of the lower shaft 8, and at a displacement of 0.5 mm from the rotation center O of the lower shaft 8 to the position P2. In case the loop-taker point 45 to rotate counter-clockwise, as FIG. 16A is viewed in front, is positioned at the upper dead center, on the other hand, the first driven portion 46 is disposed on a straight line L11 joining a position P11 rotated counter-clockwise by 50 degrees from the positive side of the Y-axis on the rotation center O2 of the inner hook 40 and the rotation center O2 of the inner hook 40, and the second drive portion 47 is disposed on a straight line L12 joining a position P12 rotated clockwise by 60 degrees from the positive side of the Y-axis on the rotation center O2 of the inner hook 40 and the rotation center O2 of the inner hook 40. In short, the first driven portion 46 and the second driven portion 47 are set to have an angular space $\alpha 2$ of 110 degrees.

Moreover, the inner hook driving first projection 34 and the inner hook driving second projection 35 of the inner hook driving member 30 are also set to have the angular space of 110 degrees on the rotation center of the inner hook driving member 30. Still moreover, the first driven portion 46 and the second driven portion 47 of the inner hook 40 have a long hole of a width of 3.5 mm (FIG. 16), the inner hook driving first projection 34 and the inner hook driving second projection 35 of the inner hook driving member 30 to engage with those first driven portion 46 and second driven portion 47 are set to have a width of 2.2 mm. Here, those inner hook driving first projection 34 and inner hook driving second projection 35 of the inner hook driving member 30 are fitted by about 1.5 mm when engaging with the first driven portion 46 and the second driven portion 47 of the inner hook 40.

On the other hand, the inner hook driving member 30 to be fixed on the lower shaft 8 is so rotationally timed that the loop-taker point 45 may reach the axial position of the needle 6 to pick up the loop of the upper thread 12 when the needle 6 rises by 2.0 mm from the lower dead center.

Figure 17:
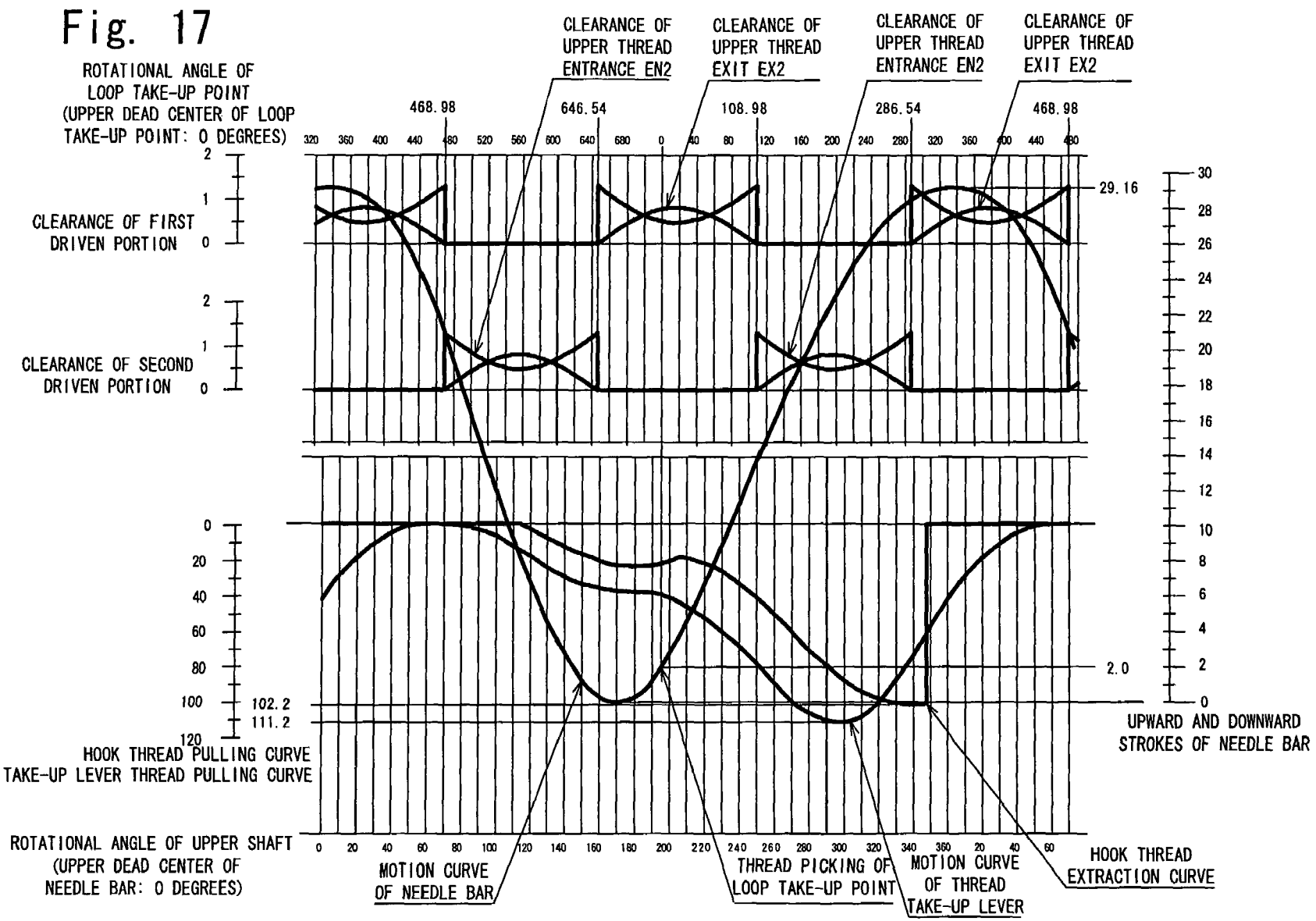
FIG. 17 An action explaining diagram (or a motion diagram) showing the action states of the needle bar, the thread take-up lever, and the upper thread entrance/exit of the rotation hook of the sewing machine, to which the inner-hook-loop-taker-point type full rotation hook of FIG. 11 is applied.

The rotation hook actions of the inner-hook-loop-taker-point type full rotation hook 11 are shown in the motion diagrams of the sewing machine of FIG. 17. In these motion diagrams, the inner-hook-loop-taker-point type full rotation hook 11 takes the state shown in FIG. 14A, when the rotational angle of the loop-taker point 45 of the inner hook 40 is at the upper dead center of 0 degrees, the state shown in FIG. 5D, when the rotational angle is 108.98 degrees, and the state shown in FIG. 14H, when the rotational angle is 286.54 degrees.

When the loop-taker point 45 of the inner hook 40 picks up the loop of the upper thread 12 at the upper dead center of 0 degrees, it is found that the upper thread exit EX2 (i.e., the clearance to be established between the first driven portion 46 of the inner hook 40 and the inner hook driving first projection 34 of the inner hook driving member 30) is opened, whereas the upper thread entrance EN2 (i.e., the clearance to be established between the second driven portion 47 of the inner hook 40 and the inner hook driving second projection 35 of the inner hook driving member 30) is closed. When the inner hook 40 rotates counter-clockwise from the upper dead center of 0 degrees to 108.98 degrees, the upper thread entrance EN2 and exit EX2 are simultaneously closed. When the inner hook 40 subsequently rotates counter-clockwise, it is found that the inner hook driving member 30 performs the rotational movement and the inner hook 40 is displaced and performs the eccentrically rotational movement with an eccentricity of 0.5 mm thereby to open the upper thread entrance EN2. While this upper thread entrance EN2 is opened (that is, while the loop-taker point 45 is positioned from the angle of 108.98 degrees to 286.54 degrees), the loop-taker point 45 of the inner hook 40 can pass the loop of the upper thread 12 smoothly from the upper thread entrance EN2. When the inner hook 40 subsequently rotates counter-clockwise from 108.98 degrees to 286.54 degrees, both the upper thread entrance EN2 and exit EX2 are simultaneously closed. When the inner hook 40 subsequently rotates counter-clockwise, it is found that the inner hook driving member 30 performs a rotational movement and that the inner hook 40 is displaced by an eccentricity of 0.5 mm for the eccentrically rotational movement thereby to open the upper thread exit EX2. While this upper thread exit EX2 is opened (that is, while the loop-taker point is positioned from the angle of 286.54 degrees to 468.98 degrees), the loop-taker point 45 of the inner hook 40 can pass the loop of the upper thread 12 smoothly from the upper thread exit EX2.

Here, the inner-hook-loop-taker-point type full rotation hook 11 has been described on the type, which makes two rotations for one cycle of the upward and downward movements of the needle 6. However, the full rotation hook should not be limited thereto, but similar actions and advantages can be obtained even if the full rotation hook makes one rotation for one cycle of the upward and downward movements of the needle 6. In short, the inner hook 40 of the inner-hook-loop-taker-point type full rotation hook 11 may rotate at any speed for one cycle of the upward and downward movements of the needle 6, if the loop of the upper thread 12 picked up by the loop-taker point 45 for each predetermined rotation of the rotationally driven inner hook 40 can be guided in, after it was pulled out to the maximum by the outer circumference of the inner hook 45, on the outer circumference of the inner hook 40 and can be guided out from the outer circumference of the inner hook 40.

Figure 18:
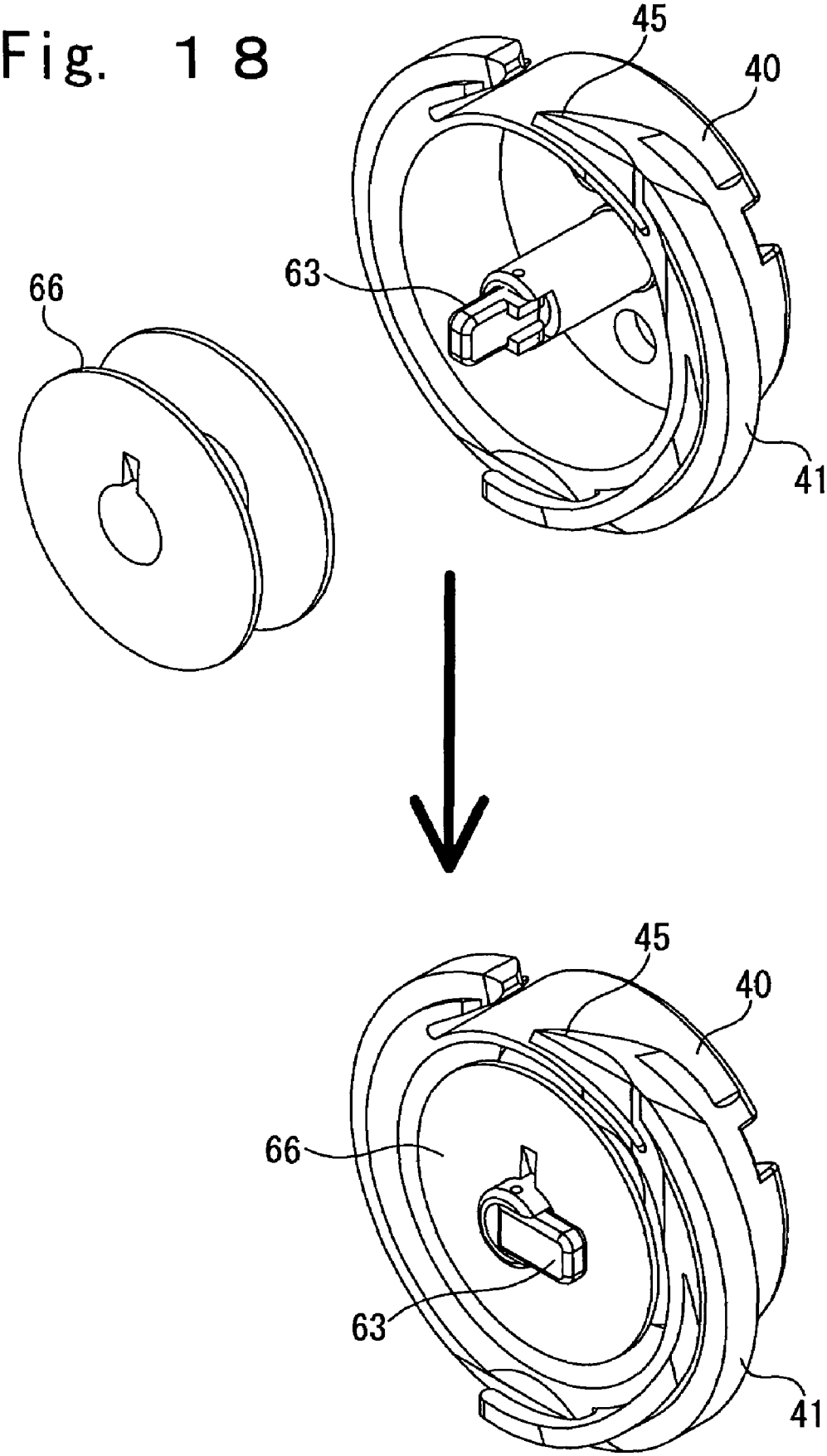
FIG. 18 An explanatory diagram showing the state of a shuttle bobbin to be directly accommodated in the inner hook of the inner-hook-loop-taker-point type full rotation hook.

Moreover, the shuttle bobbin 66 itself may also be accommodated in the inner hook 40, as shown in FIG. 18. This structure is well known in the art, and the shuttle bobbin 66 is held, after accommodated in the inner hook 40, rotatably by a shuttle bobbin holder lever 63.

According to the structures of the outer-hook-loop-taker-point type full rotation hook 10 and the inner-hook-loop-taker-point-type full rotation hook 11 thus far described in connection with Embodiments 1 and 2, the upper thread can be guided in and out on the rotation hook without using any complicated mechanism such as an opener mechanism, so that the structures can be used in any rotation hook such as a vertical rotation hook or a horizontal rotation hook. Moreover, the upper thread picked up by the hook loop-taker point to be interlaced with the lower thread can be passed through the upper thread entrance and exit without any excess thread resistance when it is guide in and out on the outer circumference of the inner hook having the lower thread wound thereon. This makes the upper thread tension unnecessary for extracting the upper thread against the thread resistance which has been caused in the prior art at the time of passing through the rotation hook. As a result, the work can be sewn by the upper thread tension at the value of such a slight thread tension as is necessary for pulling in the lower thread into the work so as to position the interlace point of the upper and lower threads at the thickness center of the work. For example, extremely thin gauzes can be sewn together by setting the lower thread tension of 10 grams and the upper thread tension of 15 grams.

Therefore, the upper thread tension, which is the addition of the general lower thread tension of 10 grams to 15 grams and the thread tension of about 5 grams necessary for tightening the threads at an interlace point, does not return the upper thread one stitch before the sewn-up portion. As a result, the upper thread does not tighten the cloth more the necessary so that the seam puckering, as might otherwise occur in the cloth, can be prevented to provide high-quality stitches.

Embodiment 3

Outer-Hook-Loop-Taker-Point Type Full Rotation Horizontal Hook (with Eccentric Inner Hook)

Figure 19:
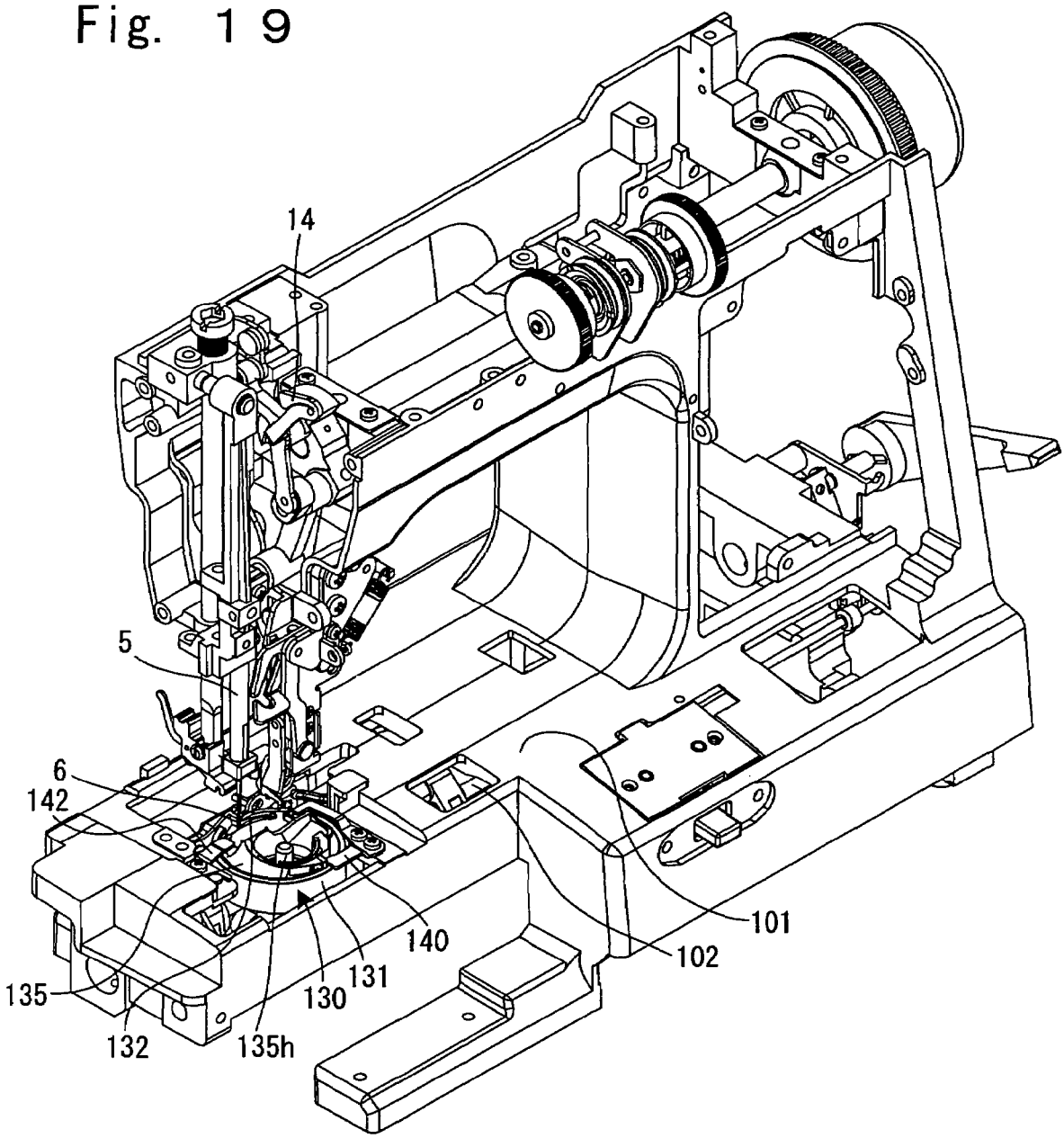
FIG. 19 A perspective view showing the entirety of the sewing machine, in which the outer-hook-loop-taker-point type full-rotation horizontal rotation hook is applied to the seam puckering preventing shuttle device of the sewing machine of the invention.
Figure 22:
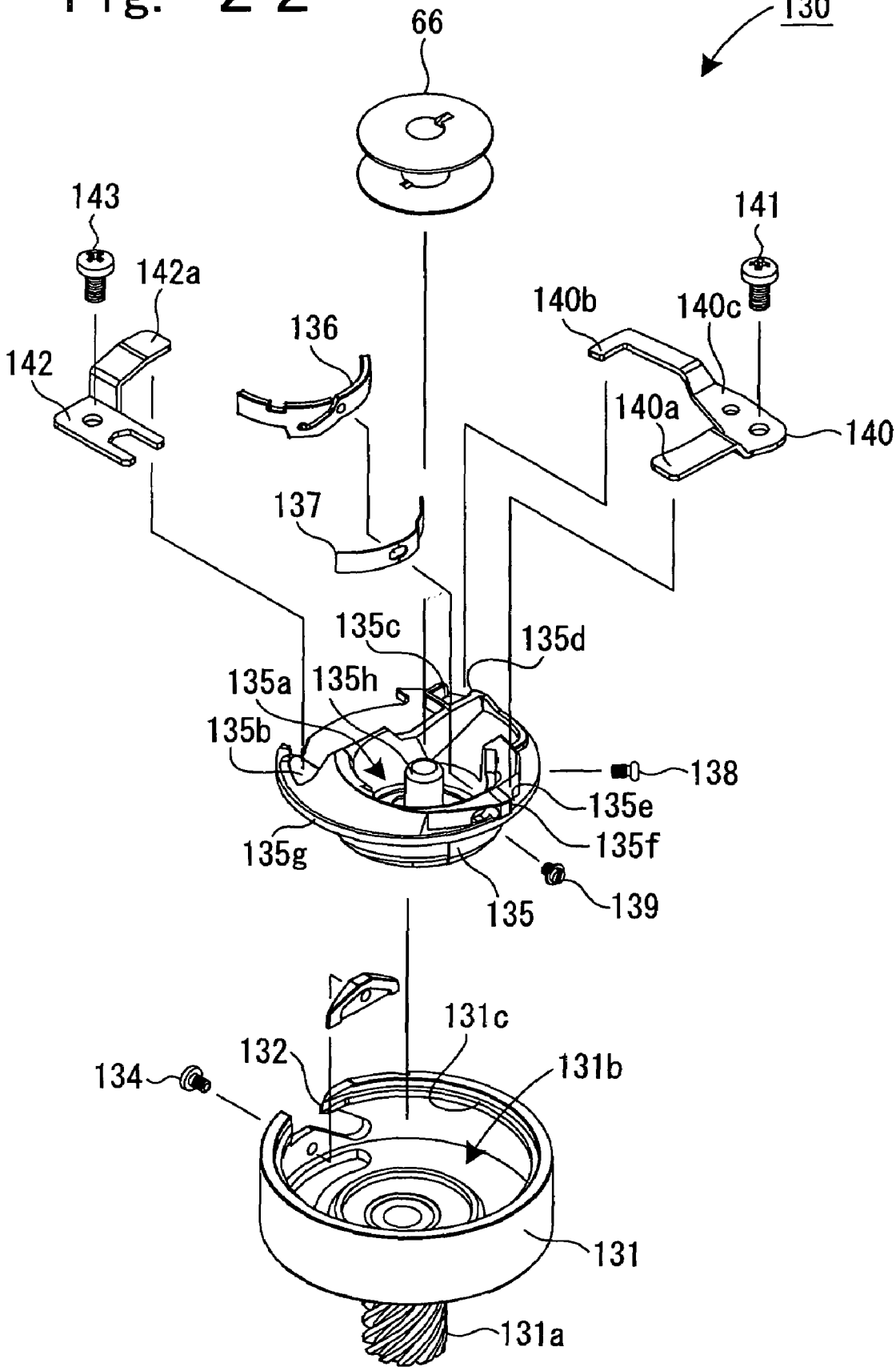
FIG. 22 An exploded perspective view showing the outer-hook-loop-taker-point type full-rotation horizontal rotation hook of FIG. 20.

This embodiment relates to a full rotation horizontal hook 130, which is suited for a home sewing machine, as shown in FIG. 19, by making use of the eccentric relation between the outer hook and the inner hook which is a feature of the Embodiments 1 and 2 thus far described. Of the drawings to be used for explaining this full rotation horizontal hook 130, FIG. 19 to FIG. 21, FIG. 23 and FIG. 24 excepting FIG. 22 present diagrams, in which the shuttle bobbin 66 is not accommodated, for conveniences.

As shown in FIG. 19 to FIG. 22, the full rotation horizontal hook 130 is disposed between the throat plat (not-shown) mounted in the bed 101 of the sewing machine body, and includes an inner hook 135 which accommodates the shuttle bobbin 66 (as referred to FIG. 22) having the lower thread 13 (as referred to FIG. 23) wound thereon and removably fixed to the frame (not-shown) of the sewing machine body and which is prevented from rotating relative to the frame by an inner hook stopper 140; and an outer hook 131 which accommodates the inner hook 135 and has a loop-taker point 132 and which is rotated by a lower shaft 102 or one part of the rotation driving portion. The inner hook 135 is so assembled as does not come out from the outer hook 131 by an inner hook holder 142. The loop-taker point 132 rotates counter-clockwise in this embodiment.

The inner hook 135 has its rotation center arranged eccentrically of the rotation center of a driven side gear 131*a* of a later-described hook driving screw gear (not shown) or the motion conversion mechanism of the rotation driving portion. As a result, an upper thread entrance EN3 and an upper thread exit EX3 are formed at such circumferentially different positions between the inner hook stopper 140 and the inner hook 135 as to form the clearance, through which the loop of the upper thread 12 picked up by the loop-taker point 132 for every rotation of the rotationally driven outer hook 131 is guided in and out the circumference of the inner hook 135 after it was pulled out to the maximum by the outer circumference of the inner hook 135.

Figure 20:
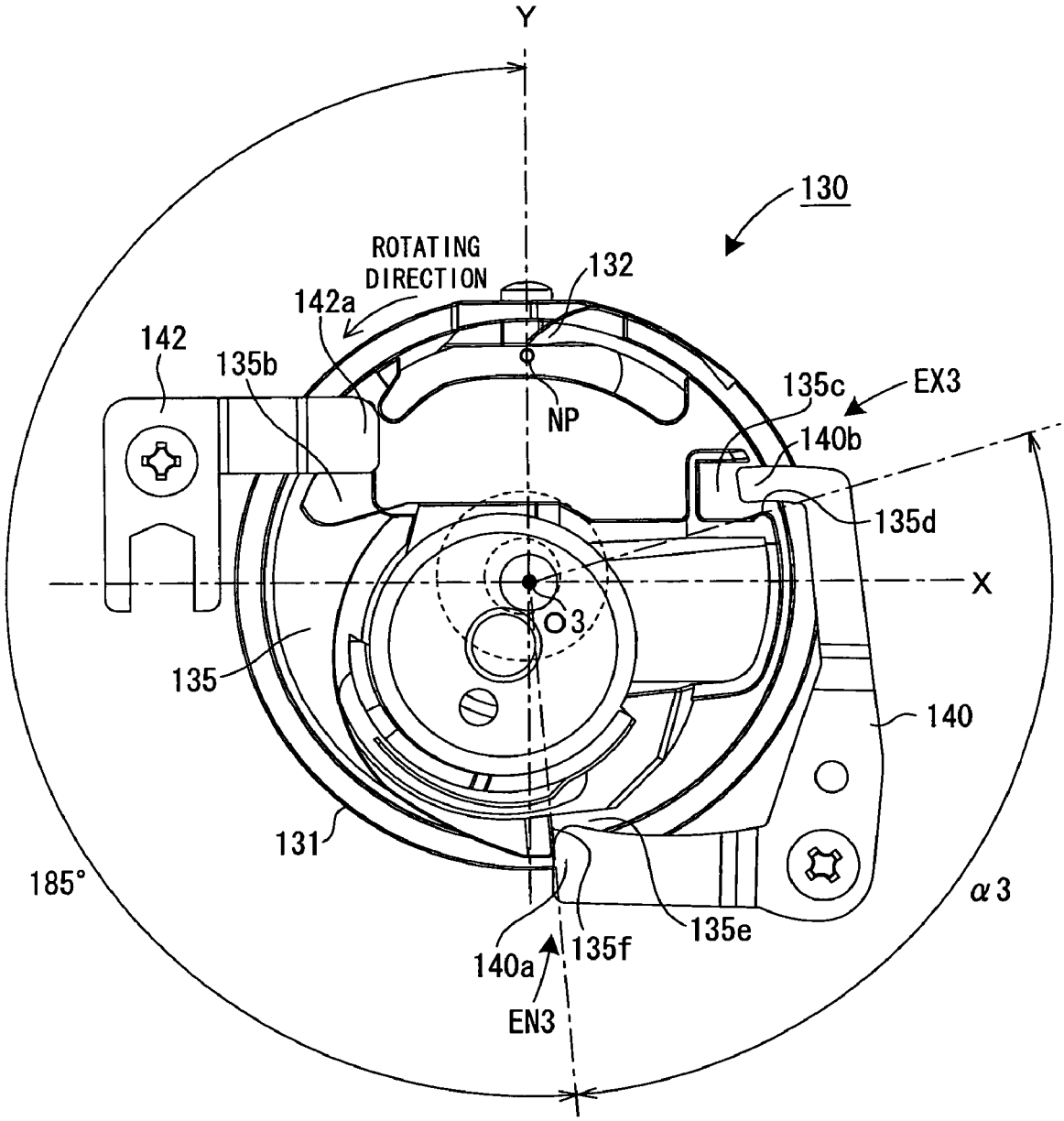
FIG. 20 An explanatory view showing one preferred mode of embodiment, in which the seam puckering preventing shuttle device of the sewing machine of the invention is applied to the outer-hook-loop-taker-point type full-rotation horizontal rotation hook.
Figure 21:
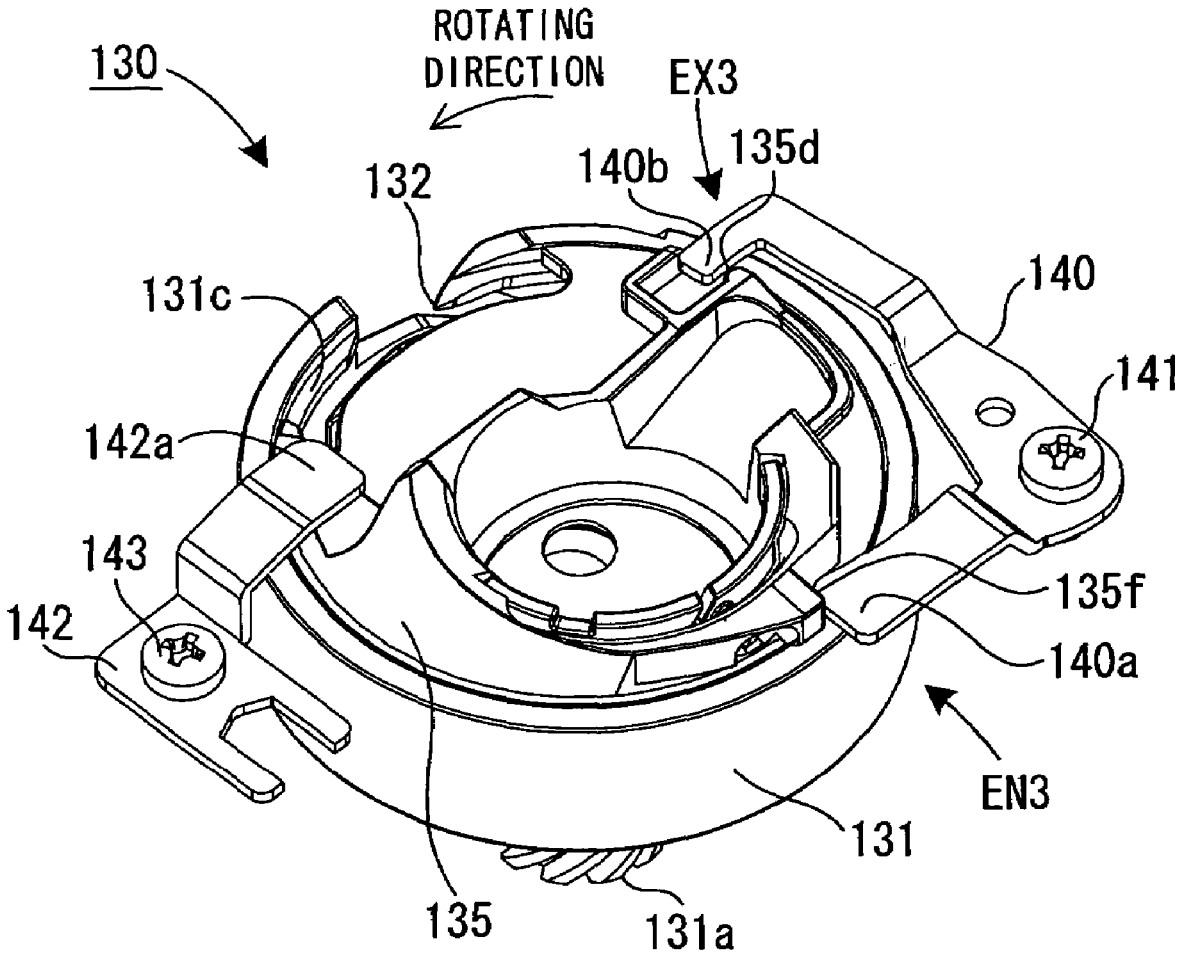
FIG. 21 A perspective view showing the outer-hook-loop-taker-point type full-rotation horizontal rotation hook of FIG. 20.

This upper thread entrance EN3 is arranged at the position, as located within a range of 180 degrees to 210 degrees from the needle drop point NP of the needle 6 in the rotational direction of the loop-taker point 132, where the loop of the upper thread 12 picked up by the loop-taker point 132 is guided in on the outer circumference of the inner hook 135, and the upper thread exit EX3 is arranged at the position, as located at an angular space $\alpha$3 of 90 degrees to 180 degrees from the upper thread entrance point of the upper thread entrance EN3, where the loop of the upper thread 12 is guided out from the outer circumference of the inner hook 135 and pulled upward of the throat plate. In the example of FIG. 20, the position of arranging the upper thread entrance EN3 is set to 185 degrees, and the angular space $\alpha$3 of the upper thread exit EX3 is set to 110 degrees. Here, the upper thread entrance EN3 and the upper thread exit EX3 are formed by the clearance varying with the rotation of the outer hook 131. The angular space $\alpha$3 on the rotation center O3 of the inner hook 135 between the upper thread entrance EN3 and the upper thread exit EX3 expresses the angular space value of the abutting point of the upper thread entrance EN3 and the upper thread exit EX3. Moreover, the upper thread entrance point of the upper thread entrance EN3 implies the rotation stopper wall 135*f* of a first inner hook stopper recess 135*e* for the inner hook stopper 140*a* of the later-described inner hook stopper 140 to abut against thereby to clog the clearance of the upper thread entrance EN3. In the upper thread exit EX3, too, the upper thread exit point is exemplified by the rotation stopper wall 135*d* of a second inner hook stopper recess 135*c* for the inner hook stopper portion 140*b* of the later-described inner hook stopper 140 to abut against thereby to clog the clearance of the upper thread exit EX3. In the operation tests of the inventors, it has been confirmed that the full rotation horizontal hook 130 normally operated as the hook within the range of 90 degrees to 180 degrees. If the outer-hook-loop-taker-point type full rotation horizontal hook 130 takes an ordinary construction, it is preferred considering the thread guide that the angular space be set at 110 degrees.

The rotation center O3 of the inner hook 135 is offset in the direction d3 (as referred to FIG. 24) between the upper thread entrance EN3 and the upper thread exit EX3 with respect to the rotation center O of the driven side gear 131*a* or the rotation driving portion.

The outer hook 131 is horizontally rotated from the lower shaft 102 through the hook driving screw gear or the motion conversion mechanism of the rotation driving portion. The hook driving screw gear turns the rotational movement from the lower shaft 102 into the vertical direction, and then transmits the turned rotational movement to the outer hook 131. The driven side gear 131*a* is fixed on the outer hook 131 and is disposed below the throat plate (not-shown) disposed on the bed 101 of the sewing machine body, and a prime mover side gear (not-shown) is fitted and fixed on the lower shaft 102.

The loop-taker point 132 is enabled, when the outer hook 131 is rotated counter-clockwise in FIG. 20 by the lower shaft 102, to pick up the loop of the upper thread 12 (as referred to FIG. 23B) to guide it to lap on the outer circumference of the inner hook 135 through the clearance formed between the outer hook 131 and the inner hook 135.

The inner hook 135 is formed into a bottomed cylindrical shape having a shuttle bobbin housing 135*a*, and is equipped on its opening side with an inner hook holder receiver 135*b* to engage with an inner hook holder portion 142*a* of the later-described inner hook holder 142, and the inner hook stopper recesses 135*c* and 135*e* to engage with the two inner hook stopper portions 140*a* and 140*b* of the inner hook stopper 140. Here, the inner hook stopper 140 is formed generally into a C-shape, which is equipped with the first inner hook stopper portion 140*a* at its one arm portion and the second inner hook stopper portion 140*b* at its other arm portion. This inner hook stopper 140 is fixed at a predetermined position of the frame located in the bed 101 of the sewing machine body by a fixing member 141 such as screws.

The first inner hook stopper recess 135*e* is equipped with the rotation stopper wall 135*f*, which abuts against the first inner hook stopper portion 140*a* to clog the clearance of the upper thread entrance EN3, and the second inner hook stopper recess 135*c* is equipped with the rotation stopper wall 135*d*, which abuts against the second inner hook stopper portion 140*b* to clog the clearance of the upper thread exit EX3. The first inner hook stopper recess 135*e* is arranged at the position, where the loop of the upper thread 12 picked up by the loop-taker point 132 of the outer hook 131 is guided in on the outer circumference of the inner hook 135, and the second inner hook stopper recess 135*c* is arranged at the position, where the loop of the upper thread 12 is guided out on the outer circumference of the inner hook 135. Moreover, the rotation stopper wall 135*f* of the first inner hook stopper recess 135*e* and the rotation stopper wall 135*d* of the second inner hook stopper recess 135*c* are arranged at circumferentially different positions of the inner hook 135 and at the aforementioned angular space α3 from the rotation center O3 of the inner hook 135. By thus arranging the first inner hook stopper recess 135*e* and the second inner hook stopper recess 135*c*, the loop of the upper thread 12 can be smoothly moved on the outer circumference of the inner hook 135.

In the outer circumference of the inner hook 135, there is formed an inner hook race 135*g*, which is so partially cut off along the outer circumference to bulge that it may be fitted in the race groove 131*c* formed in the later-described outer hook 131. The reason why the inner hook race 135*g* is thus partially cut away is to guide in the loop of the upper thread on the outer circumference of the inner hook 135 as in the well-known outer-hook-loop-taker-point type full rotation horizontal hook.

The outer hook 131 has a construction similar to that of the well-known outer-hook-loop-taker-point type full rotation horizontal hook, in which the rotation center is concentric with the rotation center O of the driven side gear 131*a* or one part of the rotation driving portion. As a result, the outer hook 131 and its loop-taker point 132 rotate concentrically with the driven side gear 131*a*.

This outer hook 131 is equipped on its inner side with an inner hook housing 131*b* for accommodating the inner hook 135. This inner hook housing 131*b* is equipped on its opening side with a race groove 131*c* for rotating the inner hook race 135*g* of the inner hook 135 in a fitted sliding state. This race groove 131*c* is disposed at a position eccentric to the driven side gear 131*a* or one part of the rotation driving portion. As a result, when the inner hook race 135*g* of the inner hook 135 is fitted in the race groove 131*c* of the outer hook 131, the rotation center O3 of the inner hook 135 to be mounted in the outer hook 131 is eccentric to the rotation center of the driven side gear 131*a* or one part of the rotation driving portion, because the race groove 131*c* and the inner hook race 135*g* are concentric in their rotation centers. Thus, the inner hook 135 has its rotation center O3 eccentric to the driven side gear 131*a* or one part of the rotation driving portion. As a result, the inner hook 135 performs an eccentrically rotational movement with respect to the rotation center of the driven side gear 131*a*.

Moreover, after the inner hook 135 was accommodated in the inner hook housing 131*b* of the outer hook 131, the inner hook holder 142 is so fixed by a fixing member 143 such as screws at a predetermined position of the frame located in the bed 101 of the sewing machine body that the inner hook 135 may not come out. This inner hook holder 142 can rotate the inner hook 135 such that the inner hook race 135*g* may not come out from the race groove 131*c* of the outer hook 131.

When the outer hook 131, the inner hook 135, the inner hook stopper 140 and the inner hook holder 142 thus constructed are assembled, predetermined clearances are formed between the first inner hook stopper recess 135*e* and the first inner hook stopper portion 140*a* and between the second inner hook stopper recess 135*c* and the second inner hook stopper portion 140*b*. These clearances function as the upper thread entrance EN3 and exit EX3. As a result, the upper thread entrance EN3 is arranged at the position, where the loop of the upper thread 12 picked up by the loop-taker point 132 is guided in on the outer circumference of the inner hook 135, and the upper thread exit EX3 is arranged at the position, where the loop of the upper thread 12 is guided out on the outer circumference of the inner hook 135 and pulled upward of the throat plate 7. Moreover, the upper thread entrance EN3 and the upper thread exit EX3 are arranged to have the angular space α3 of 110 degrees.

Here, the inner hook holder receiver 135*b* of the inner hook 135 and the inner hook holder portion 142*a* of the inner hook holder 142 are also set to form a predetermined clearance.

On the inner wall of the shuttle bobbin housing portion 135*a* of the inner hook 135, there is arranged by a fixing screw 138 a thread tension guide plate 136, which is caused by a thread tension spring 137 and an adjust screw 139 to adjust the tension of the lower thread 13 and to guide the lower thread 13 pulled out from the shuttle bobbin 66 to the needle drop portion.

Next, the rotation hook actions of the outer-hook-loop-taker-point type full rotation horizontal hook 130, which is equipped with those two upper thread entrance EN3 and exit EX3 and in which the outer hook 131 performs the rotational movement with respect to the inner hook 135 in synchronism with the needle 6, upon the upper thread 12 are described with reference to FIG. 23. FIG. 23 is a top plan view showing the outer-hook-loop-taker-point type full rotation horizontal hook 130 taken upward in the vertical direction. In this action description, the direction is so taken as views FIG. 23 in front.

Here in FIG. 23 to be used for describing the rotation hook actions, it is assumed that the outer hook 131 rotates counter-clockwise. It is also assumed the upper dead center of the loop-taker point 132 of the outer hook 131 is the point where the loop-taker point 132 is positioned in the direction of the needle drop point NP of the needle 6. For conveniences, moreover, it is assumed that the description on the actions are started from the instant and from the state (FIG. 23A). At this instant, the needle 6 having the upper thread 12 inserted thereinto rises by 2.0 mm from the lower dead center to pick up the loop of the upper thread 12. In that state, moreover, the loop-taker point 132 of the outer hook 131 is so positioned at the upper dead center as to reach the axial position of the needle 6. At the position, the first inner hook stopper portion 140*a* of the inner hook stopper 140 abuts against the rotation stopper wall 135*f* of the first inner hook stopper recess 135*e* of the inner hook 135 for the eccentric movement, and the clearance is formed between the rotation stopper wall 135*d* of the second inner hook stopper recess 135*c* of the inner hook 135 and the second inner hook stopper portion 140*b* of the inner hook stopper 140. On the other hand, a clearance is ordinarily exists between the inner hook holder portion 142*a* of the inner hook holder 142 and the inner hook holder receiver 135*b* of the inner hook 135. Moreover, the eccentrically rotational trace (or the revolution) of the rotation center O3 of the inner hook 135 of the outer-hook-loop-taker-point type full rotation horizontal hook 130 is eccentric to the rotation center O of the driven side gear 131*a*, like the eccentrically rotational trace (or the revolution) of the rotation center O1 of the inner hook 80 of the outer-hook-loop-taker-point type full rotation hook 10 of Embodiment 1, as shown in FIG. 5.

Figure 23A:
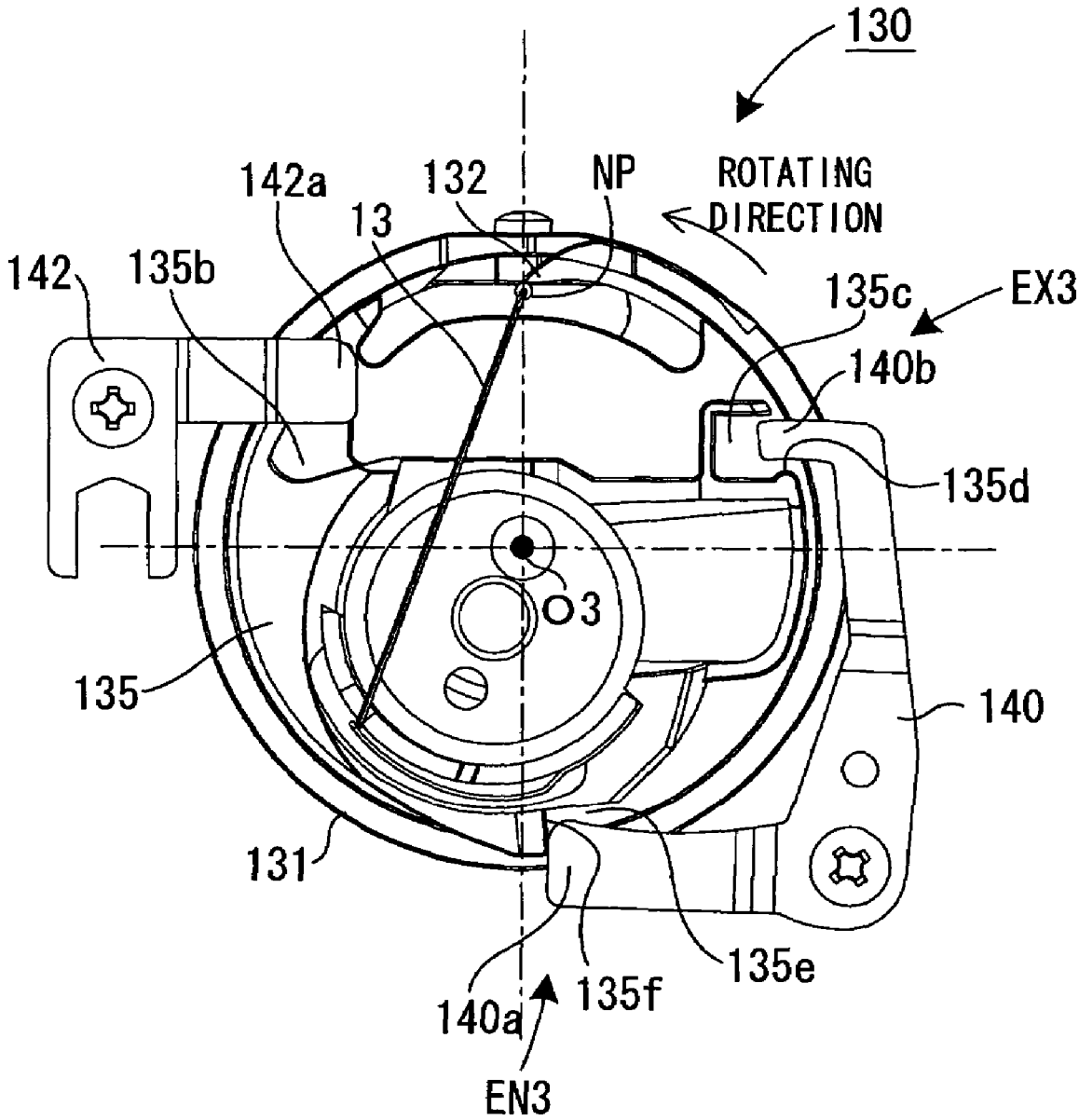
FIG. 23A An action explaining diagram showing an action state of the outer-hook-loop-taker-point type full-rotation horizontal rotation hook of FIG. 20.
Figure 23B:
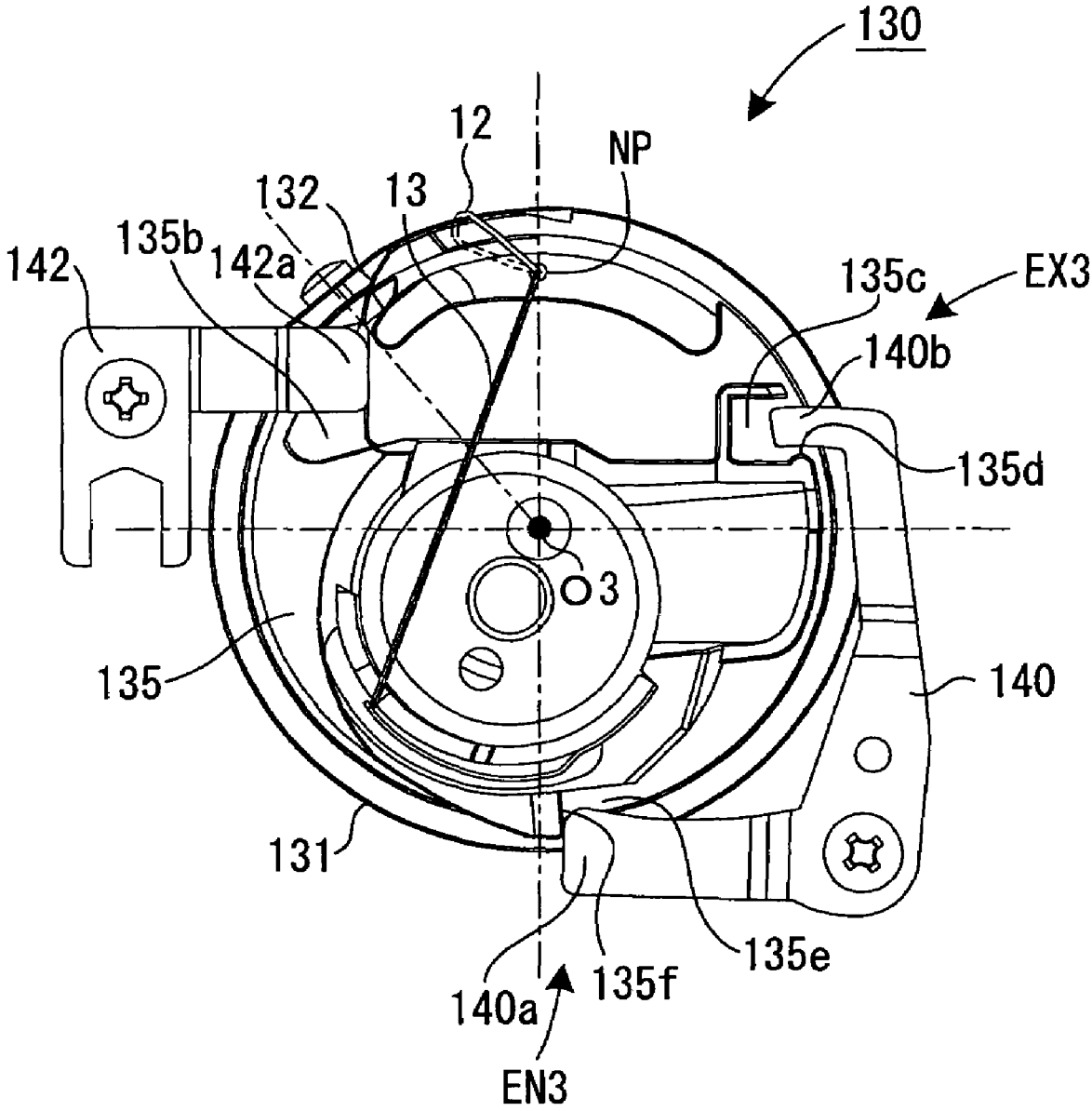
FIG. 23B An action explaining diagram showing an action state of the outer-hook-loop-taker-point type full-rotation horizontal rotation hook of FIG. 20.
Figure 23C:
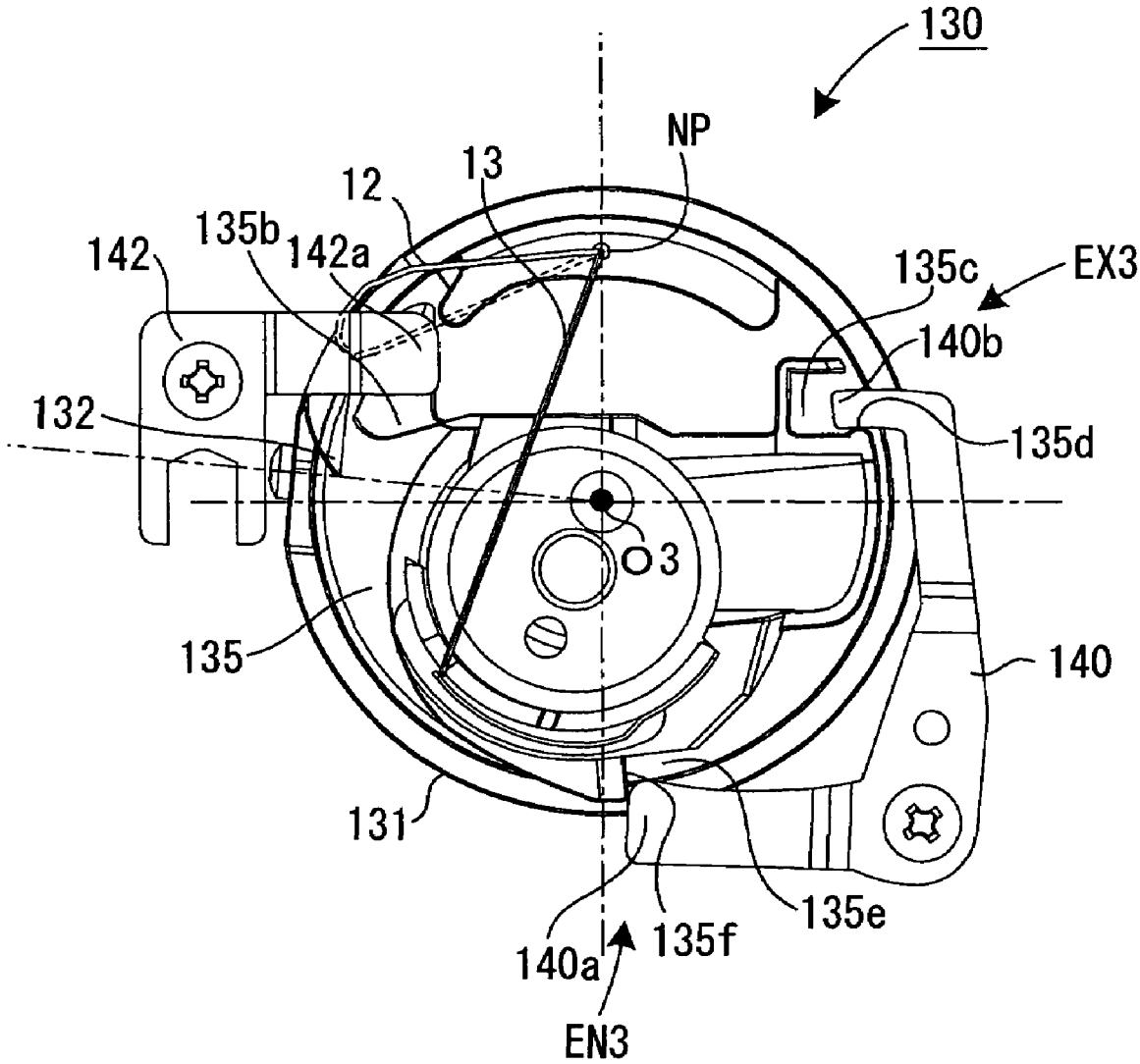
FIG. 23C An action explaining diagram showing an action state of the outer-hook-loop-taker-point type full-rotation horizontal rotation hook of FIG. 20.

When the needle 6 starts to rise from the state described above, the upper thread 12 inserted into the needle 6 is not raised with the needle 6 but left while being pressed by the cloth through which the upper thread 12 penetrates together with the needle 6 at the upper face of the throat plate, thereby to form a loop. This loop of the upper thread 12 is picked up on the outer circumference of the inner hook 135 by the loop-taker point 132 of the outer hook 131 rotating counter-clockwise, as shown in FIGS. 23B and 23C. At this time, the inner hook 135, which is eccentrically accommodated in the outer hook 131, is eccentrically rotated counter-clockwise by the slight friction between the inner hook race 135*g* and the race groove 131*c* of the outer hook 131. As a result, the clearance between the rotation stopper wall 135*d* of the second inner hook stopper recess 135*c* of the inner hook 135 and the second inner hook stopper portion 140*b* of the inner hook stopper 140 is gradually reduced so that the second inner hook stopper portion 140*b* of the inner hook stopper 140 comes into abutment against the rotation stopper wall 135*d* of the inner hook stopper recess 135*c*.

Between the inner hook holder portion 142*a* of the inner hook holder 142 and the inner hook holder receiver 135*b* of the inner hook 135, there is ordinarily left the clearance, through which the loop of the upper thread picked up and pulled on the outer circumference of the inner hook 135 by the loop-taker point 132 of the outer hook 131 can smoothly pass.

Figure 23D:
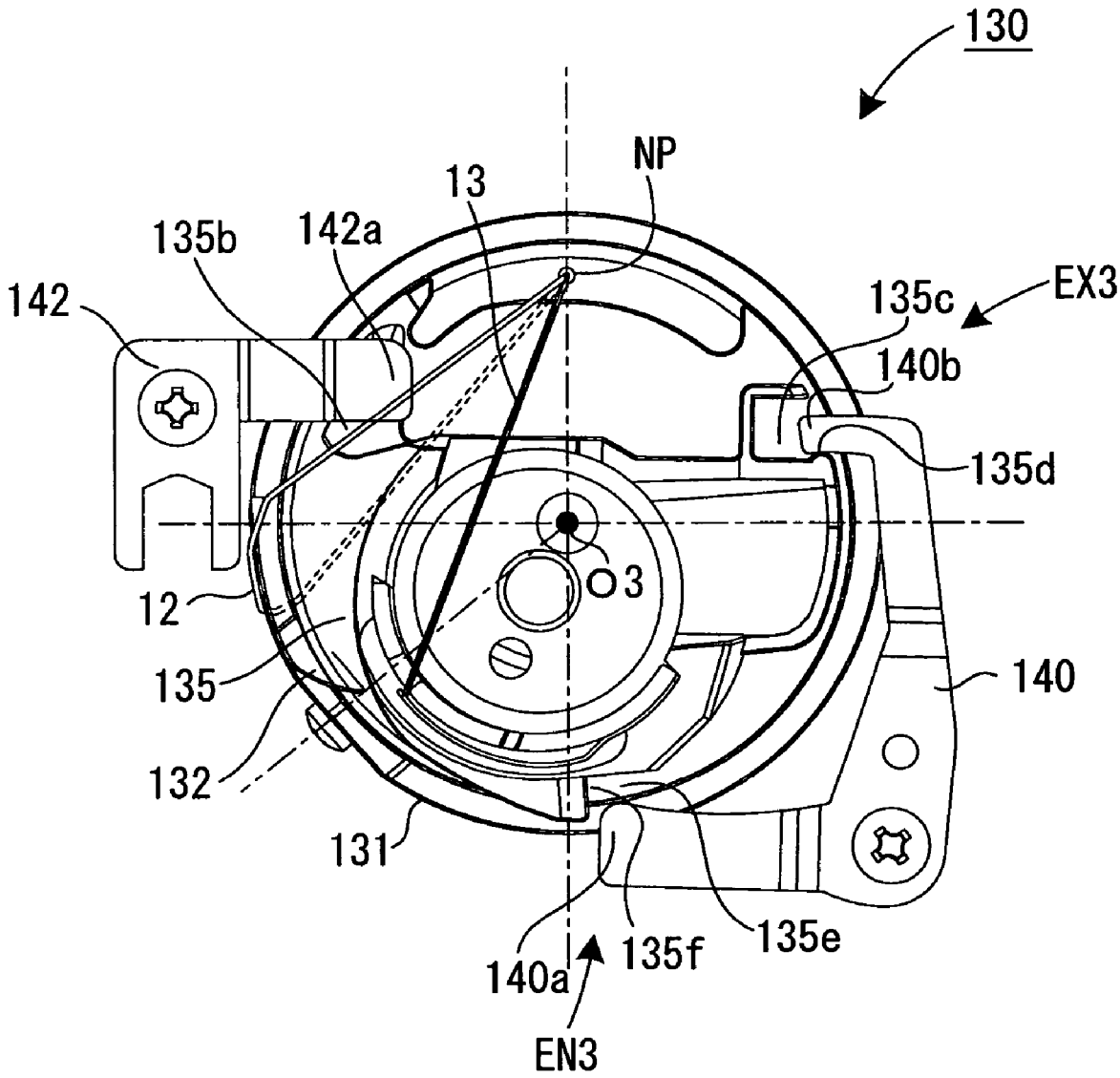
FIG. 23D An action explaining diagram showing an action state of the outer-hook-loop-taker-point type full-rotation horizontal rotation hook of FIG. 20.
Figure 23E:
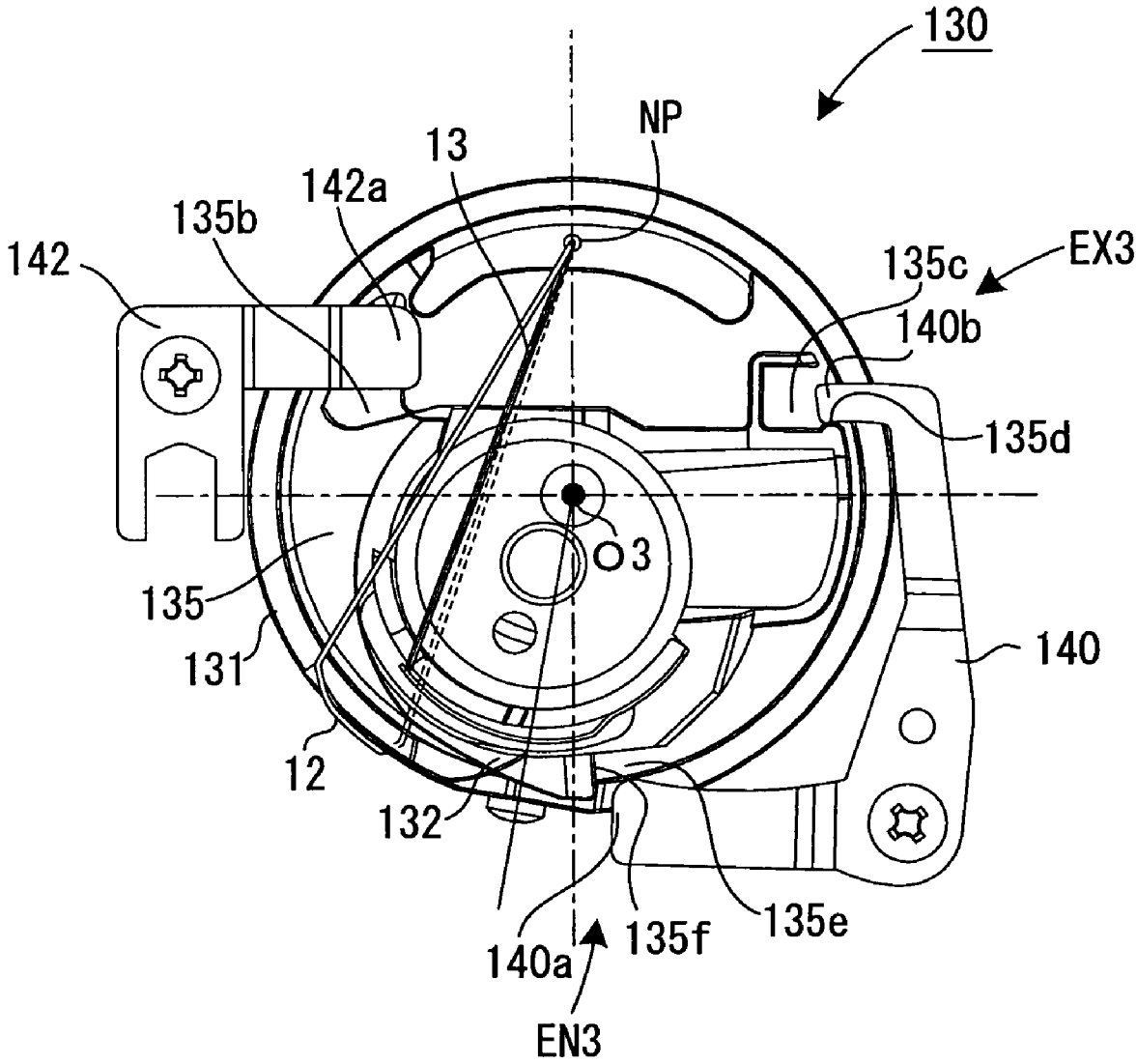
FIG. 23E An action explaining diagram showing an action state of the outer-hook-loop-taker-point type full-rotation horizontal rotation hook of FIG. 20.

As the loop of the upper thread 12 thus pulled on the outer circumference of the inner hook 135 is guided on the outer circumference of the inner hook 135 by the loop-taker point 132 being moved by the rotational movement of the outer hook 131, as shown in FIGS. 23D and 23E, the first inner hook stopper portion 140*a* of the inner hook stopper 140 abutting against the rotation stopper wall 135*f* of the first inner hook stopper recess 135*e* of the inner hook 135 gradually leaves the rotation stopper wall 135*f* of the inner hook stopper recess 135*e*. This is because the inner hook 135 regulated in the eccentrically rotational movement by the inner hook stopper 140 is caused to revolve by the rotational movement of the outer hook 131 and is displaced by the eccentricity of the inner hook 135. Here, the second inner hook stopper portion 140*b* of the inner hook stopper 140 remains in abutment against the rotation stopper wall 135*d* of the inner hook stopper recess 135*c* of the inner hook 135.

Figure 23F:
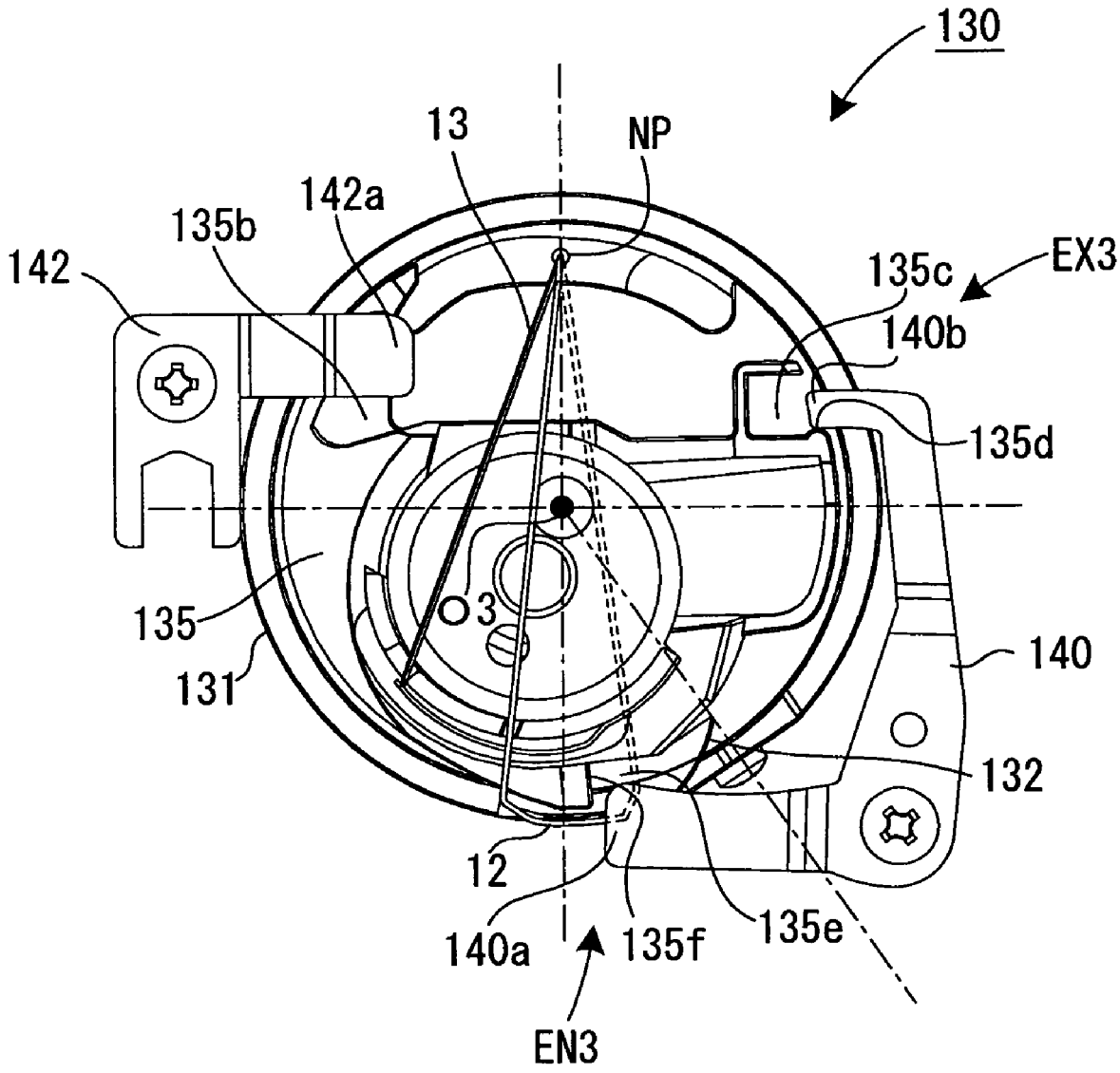
FIG. 23F An action explaining diagram showing an action state of the outer-hook-loop-taker-point type full-rotation horizontal rotation hook of FIG. 20.
Figure 23G:
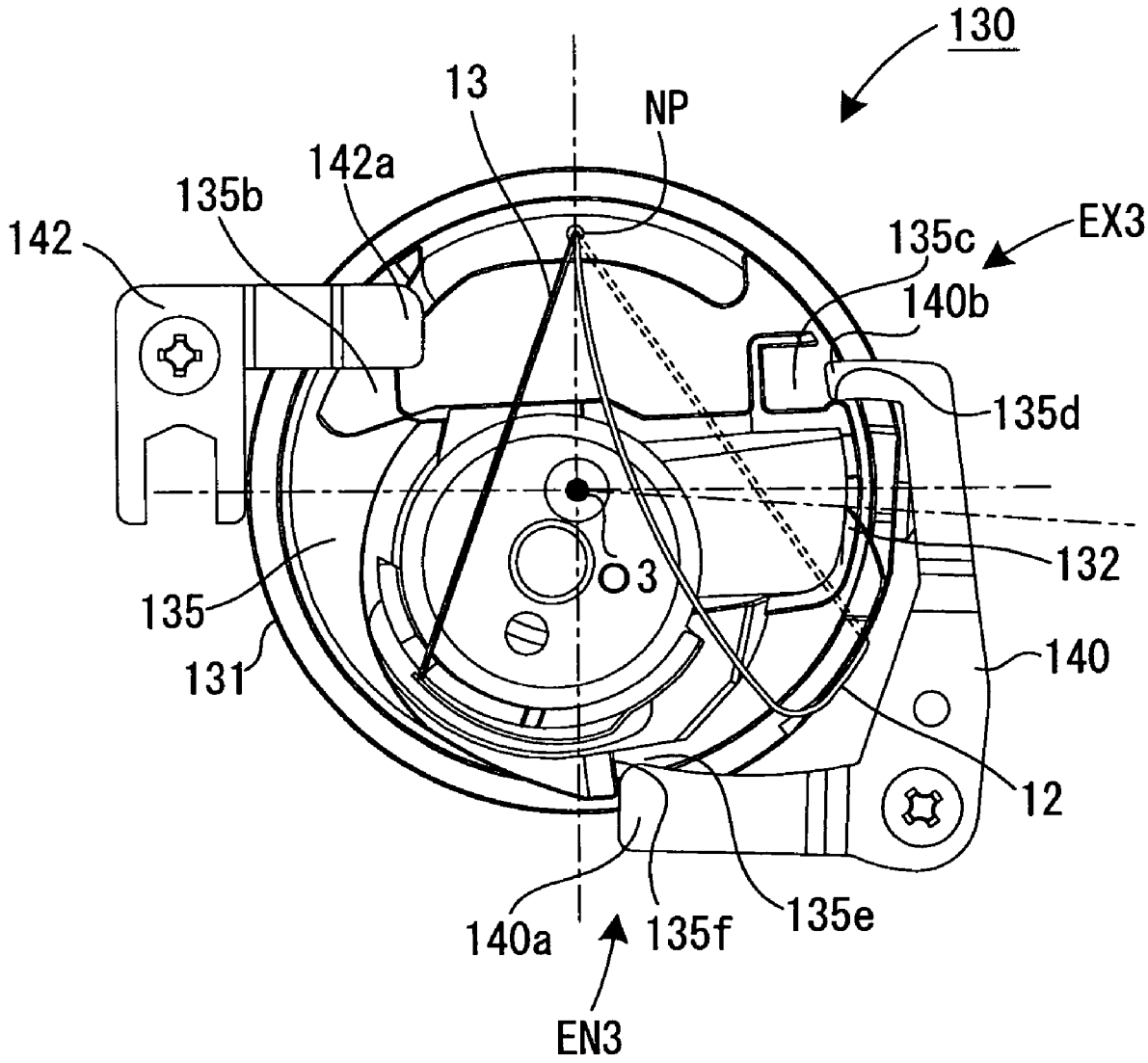
FIG. 23G An action explaining diagram showing an action state of the outer-hook-loop-taker-point type full-rotation horizontal rotation hook of FIG. 20.
Figure 23H:
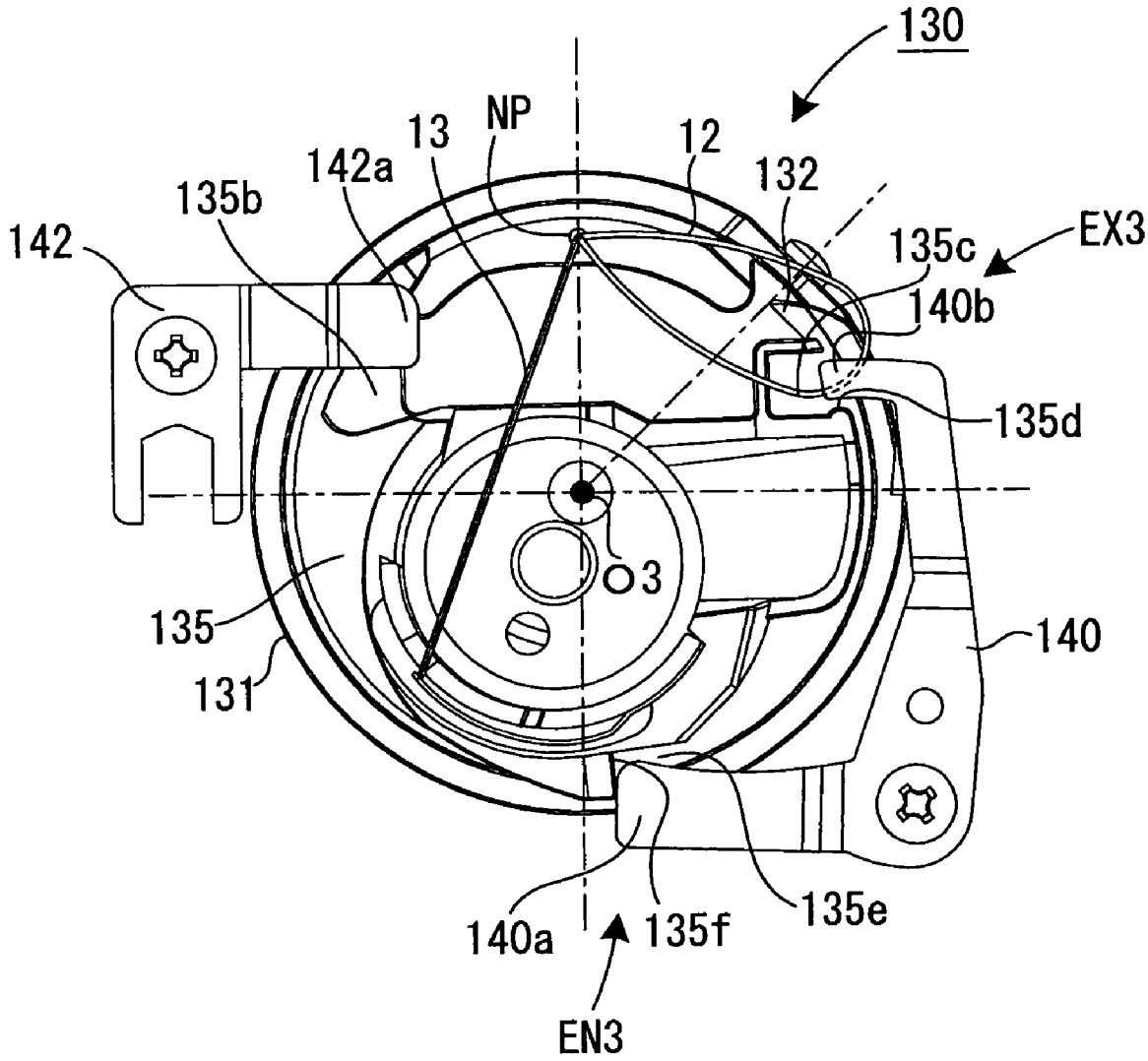
FIG. 23H An action explaining diagram showing an action state of the outer-hook-loop-taker-point type full-rotation horizontal rotation hook of FIG. 20.
Figure 231:
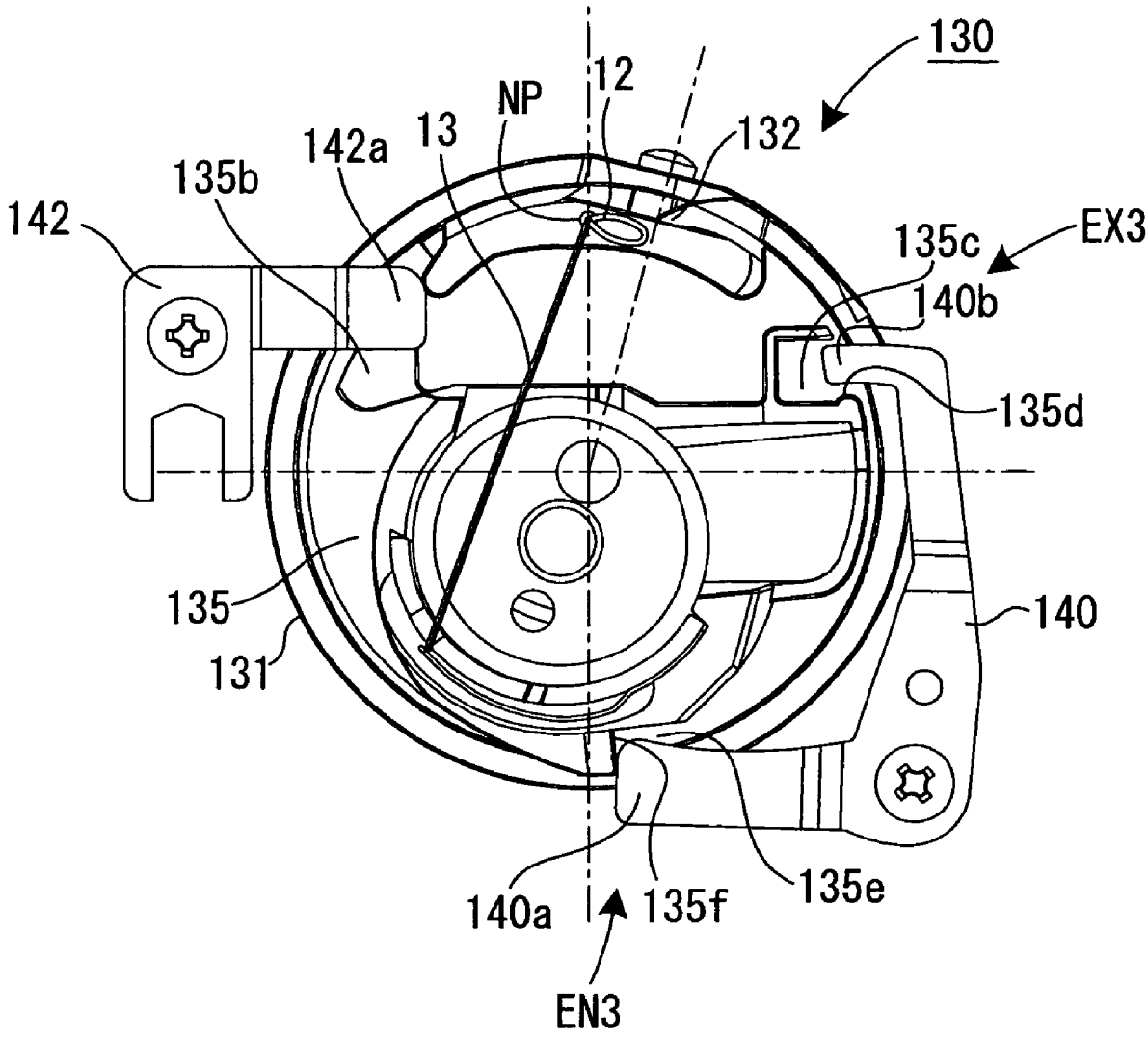

The loop of the upper thread 12 guided to below the outer circumference of the inner hook 135 is further guided, as shown in FIG. 23F, by the loop-taker point 132 being moved by the rotational movement of the outer hook 131, to the first inner hook stopper recess 135*e* of the inner hook 135, which is regulated in the eccentrically rotational movement by the inner hook stopper 140. The loop of the upper thread 12 thus guided passes through the clearance between the rotation stopper wall 135*f* of the first inner hook stopper recess 135*e* and the first inner hook stopper portion 140*a* of the inner hook stopper 140. The loop of the upper thread 12 can smoothly pass through the clearance for the upper thread entrance EN3. When the loop of the upper thread 12 thus leaves the upper thread entrance EN3, the thread take-up lever 14 (as referred to FIG. 19) pulls up the upper thread 12 guided out through the inner hook 135. In this state where the thread take-up lever 14 is pulling up the upper thread 12, as shown in FIG. 23G, the first inner hook stopper portion 140*a* of the inner hook stopper 140 comes into abutment against the rotation stopper wall 135*f* of the second inner hook stopper recess 135*e* of the inner hook 135. Here, the second inner hook stopper portion 140*b* of the inner hook stopper 140 also remains in abutment against the rotation stopper wall 135*d* of the second inner hook stopper recess 135*c* of the inner hook 135.

As the outer hook 131 further performs the rotational movement from the state of FIG. 23G, the second inner hook stopper portion 140*b* of the inner hook stopper 140 abutting against the rotation stopper wall 135*d* of the second inner hook stopper recess 135*c* of the inner hook 135 is gradually brought apart from the rotation stopper wall 135*d* of the second inner hook stopper recess 135*c* by the displacement in the revolution of the inner hook 135 regulated in the eccentrically rotational movement. As a result, the upper thread 12 pulled up by the thread take-up lever 14 passes through the clearance between the rotation stopper wall 135*d* of the second inner hook stopper recess 135*c* and the second inner hook stopper portion 140*b* of the inner hook stopper 140, and interlaces with the lower thread 13 to form lock stitches in the work. The loop of the upper thread 12 can smoothly pass through the clearance of the upper thread exit EX3. In this state, the first inner hook stopper portion 140*a* of the inner hook stopper 140 remains in abutment against the rotation stopper wall 135*f* of the first inner hook stopper recess 135*e* of the inner hook 135. Here, the outer hook 131 performs one more rotation till the needle 6 returns to the position, as indicated in FIG. 23A.

Thus, while the outer hook 131 is performing one rotational movement, the inner hook 135 is caused to revolve by the eccentrically rotational movement so that it is displaced by its eccentricity. When the upper thread 12 of the needle 6 is picked up by the loop-taker point 132 of the outer hook 131 so that its loop is guided in on the outer circumference of the inner hook 135, the clearance can be formed between the rotation stopper wall 135*f* of the first inner hook stopper recess 135*e* of the inner hook 135 and the first inner hook stopper portion 140*a* of the inner hook stopper 140 thereby to guide in the upper thread 12 smoothly on the outer circumference of the inner hook 135. When the outer hook 131 rotates so that the upper thread 12 is guided out from the inner hook 135, the clearance is formed, when the thread take-up lever 14 takes up the upper thread 12, between the rotation stopper wall 135*d* of the second inner hook stopper recess 135*c* of the inner hook 135 and the second inner hook stopper portion 140*b* of the inner hook stopper 140 so that the upper thread 12 can be pulled up without any resistance to the extraction of the upper thread 12 by the thread take-up lever 14.

This outer-hook-loop-taker-point type full rotation horizontal hook 130 is further described on a specific example.

Figure 24:
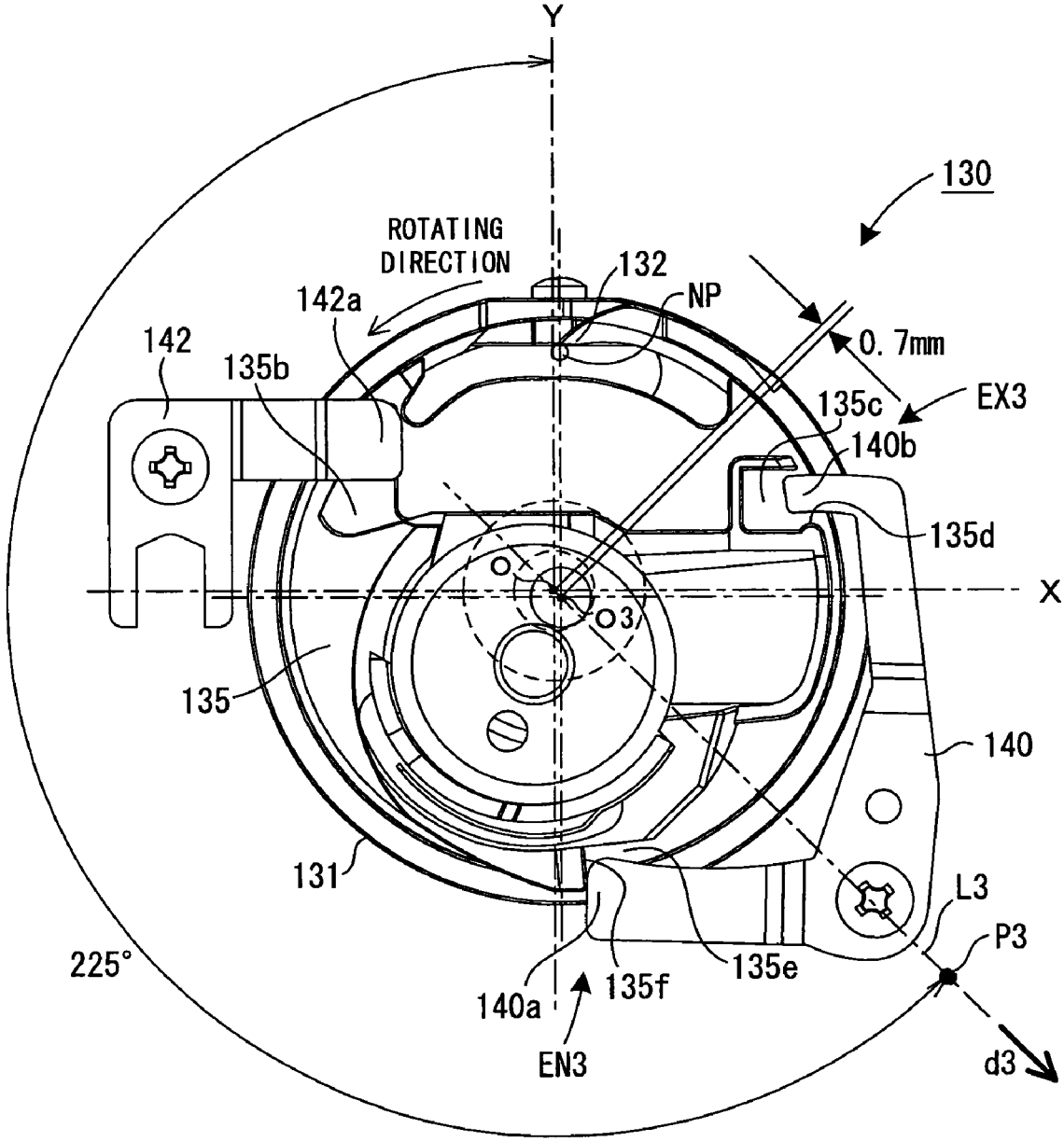
FIG. 24 An explanatory diagram showing a specific example of the outer-hook-loop-taker-point type full-rotation horizontal rotation hook of FIG. 20.

In the outer-hook-loop-taker-point type full rotation horizontal hook 130 of an ordinary size, as shown in FIG. 24, the eccentric direction d3 of the rotation center O3 of the outer hook 131 is located, in case the loop-taker point 132 is positioned at the upper dead center with respect to the rotation center O of the driven gear 131*a*, at the position, which lies on a straight line L3 joining the position P3 rotated counter clockwise by 225 degrees from the positive side of the Y-axis on the rotation center O of the drive gear 131*a* and the rotation center O of the driven gear 131*a*, as FIG. 24 is viewed in front, and which is displaced by 0.7 mm from the rotation center O of the driven gear 131*a* to the position P3. FIG. 24 presents a top plan view showing the outer-hook-loop-taker-point type full rotation horizontal hook 130 taken upward in the vertical direction.

As shown in FIG. 20, the rotation stopper wall 135*f* of the first inner hook stopper recess 135*e* of the inner hook 135 and the rotation stopper wall 135*d* of the second inner hook stopper recess 135*c* are set to have the angular space α3 of 110 degrees. Moreover, the clearance between the bottom face of the first inner hook stopper recess 135*e* of the inner hook 135 and the lower face of the first inner hook stopper portion 140*a* of the inner hook stopper 140, and the clearance between the bottom face of the second inner hook stopper recess 135*c* of the inner hook 135 and the lower face of the second inner hook stopper portion 140*b* of the inner hook stopper 140 are individually set to 0.5 mm. Moreover, the outer hook 131 is so rotated by the lower shaft 102 or one part of the rotation driving portion that the loop-taker point 132 reaches, when the needle 6 rises 2.0 mm from the lower dead center, the axial position of the needle 6 thereby to pick up the loop of the upper thread 12.

Figure 25:
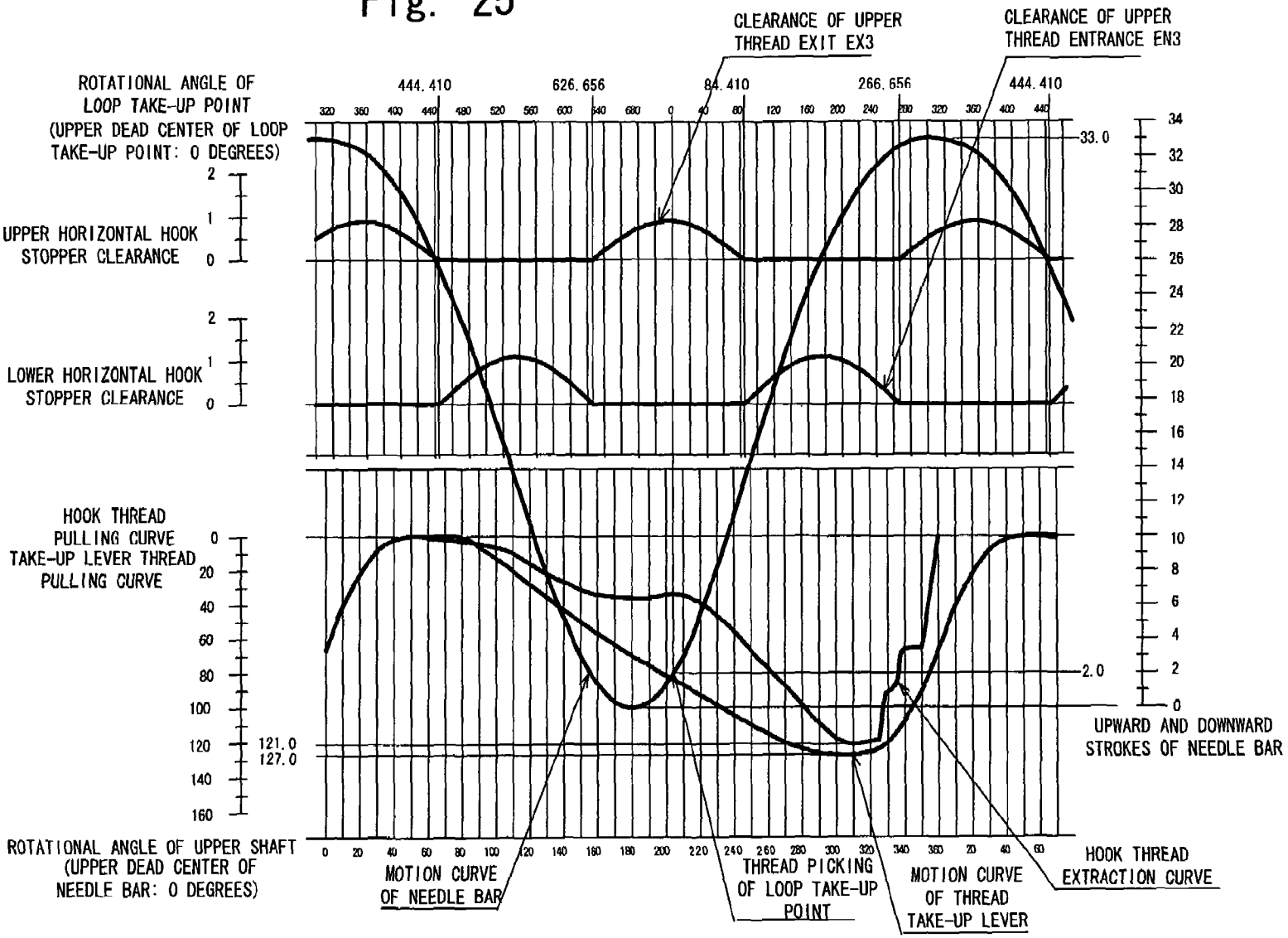
FIG. 25 An action explaining diagram (or a motion diagram) showing the action states of the needle bar, the thread take-up lever, and the upper thread entrance/exit of the rotation hook of the sewing machine, to which the outer-hook-loop-taker-point type full-rotation horizontal rotation hook of FIG. 20 is applied.

The rotation hook actions of the outer-hook-loop-taker-point type full rotation horizontal hook 130 are shown in the motion diagrams of the sewing machine of FIG. 25. In these motion diagrams, the outer-hook-loop-taker-point type full rotation horizontal hook 130 takes the state shown in FIG. 23A, when the rotational angle of the loop-taker point 132 of the outer hook 131 is at the upper dead center of 0 degrees, the state shown in FIG. 23B, when the rotational angle is 40 degrees, the state shown in FIG. 23C, when the rotational angle is 84.410 degrees, the state shown in FIG. 23D, when the rotational angle is 130 degrees, the state shown in FIG. 23E, when the rotational angle is 170 degrees, the state shown in FIG. 23F, when the rotational angle is 215 degrees, the state shown in FIG. 23G, when the rotational angle is 266.656 degrees, the state shown in FIG. 23H, when the rotational angle is 315 degrees, and the state shown in FIG. 23I, when the rotational angle is 345 degrees.

When the loop-taker point 132 of the outer hook 131 picks up the loop of the upper thread 12 at the upper dead center of 0 degrees, it is found that the upper thread exit EX3 (i.e., the clearance to be established between the rotation stopper wall 135*d* of the second inner hook stopper recess 135*c* of the inner hook 135 and the second inner hook stopper 140*b* of the inner hook stopper 140) is opened, whereas the upper thread entrance EN3 (i.e., the clearance to be established between the rotation stopper wall 135*f* of the first inner hook stopper recess 135*e* of the inner hook 135 and the first inner hook stopper portion 140*a* of the inner hook stopper 140) is closed. When the outer hook 131 rotates counter-clockwise from the upper dead center of 0 degrees to 84.410 degrees, the upper thread entrance EN3 and exit EX3 are simultaneously closed. When the outer hook 131 subsequently rotates counter-clockwise, it is found that the inner hook 135 regulated in an eccentrically rotational movement by the inner hook stopper 140 is caused by the rotational movement of the outer hook 131 to revolve so that it is displaced by an eccentricity of 0.7 mm thereby to open the upper thread entrance EN3. While this upper thread entrance EN3 is opened (that is, while the loop-taker point is positioned from the angle of 84.410 degrees to 266.656 degrees), the loop-taker point 132 of the outer hook 131 can pass the loop of the upper thread 12 smoothly from the upper thread entrance EN3. When the outer hook 131 subsequently rotates counter-clockwise to 266.656 degrees, both the upper thread entrance EN3 and exit EX3 are simultaneously closed. When the outer hook 131 subsequently rotates counter-clockwise, it is found that the inner hook 135 regulated in an eccentrically rotational movement by the lower inner hook stopper 140 is caused by the rotational movement of the outer hook 131 to revolve so that it is displaced by an eccentricity of 0.7 mm thereby to open the upper thread exit EX3. While this upper thread exit EX3 is opened (that is, while the loop-taker point is positioned from the angle of 266.656 degrees to 444.410 degrees), the loop-taker point 132 of the outer hook 131 can pass the loop of the upper thread 12 smoothly from the upper thread exit EX3.

Here, the outer-hook-loop-taker-point type full rotation horizontal hook 130 has been described on the type, which makes two rotations for one cycle of the upward and downward movements of the needle 6. However, the full rotation hook should not be limited thereto, but similar actions and advantages can be obtained even if the full rotation hook makes one rotation for one cycle of the upward and downward movements of the needle 6. In short, the outer-hook-loop-taker-point type full rotation horizontal hook 130 may rotate at any speed for one cycle of the upward and downward movements of the needle 6, if the loop of the upper thread 12 picked up by the loop-taker point 132 for each predetermined rotation of the rotationally driven outer hook 131 can be guided in, after it was pulled out to the maximum by the outer circumference of the inner hook 135, on the outer circumference of the inner hook 135 and can be guided out from the outer circumference of the inner hook 135.

In case the seam puckering preventing shuttle device of the sewing machine of the invention is applied to the full rotation horizontal rotation hook, as shown in FIG. 19, the inner hook 135 may include a shuttle bobbin support pin 135*h*, which is erected at the center of the shuttle bobbin housing portion 135*a* for holding the shuttle bobbin 66.

Thus, the inner hook 135 has the shuttle bobbin support pin 135*h* and holds the shuttle bobbin 66 so that it can prevent the shuttle bobbin 66 from rotating while being inscribed with the inner wall of the inner hook 135 and its lower thread 13 from being rewound. The inner hook 135 can also prevent the shuttle bobbin from rotating while being inscribed with the inner wall of the upward diverging shuttle bobbin housing portion 135*a* (as referred to FIG. 22) and from floating.

Embodiment 4

Outer-Hook-Loop-Taker-Point Type Full Rotation Hook (with Reciprocating Inner Hook Stopper)

This embodiment relates to a full rotation hook, in which an inner hook and an outer hook are concentrically arranged without any eccentric relation thereby to apply the reciprocating movements to an inner hook stopper for holding the inner hook.

Figure 26:
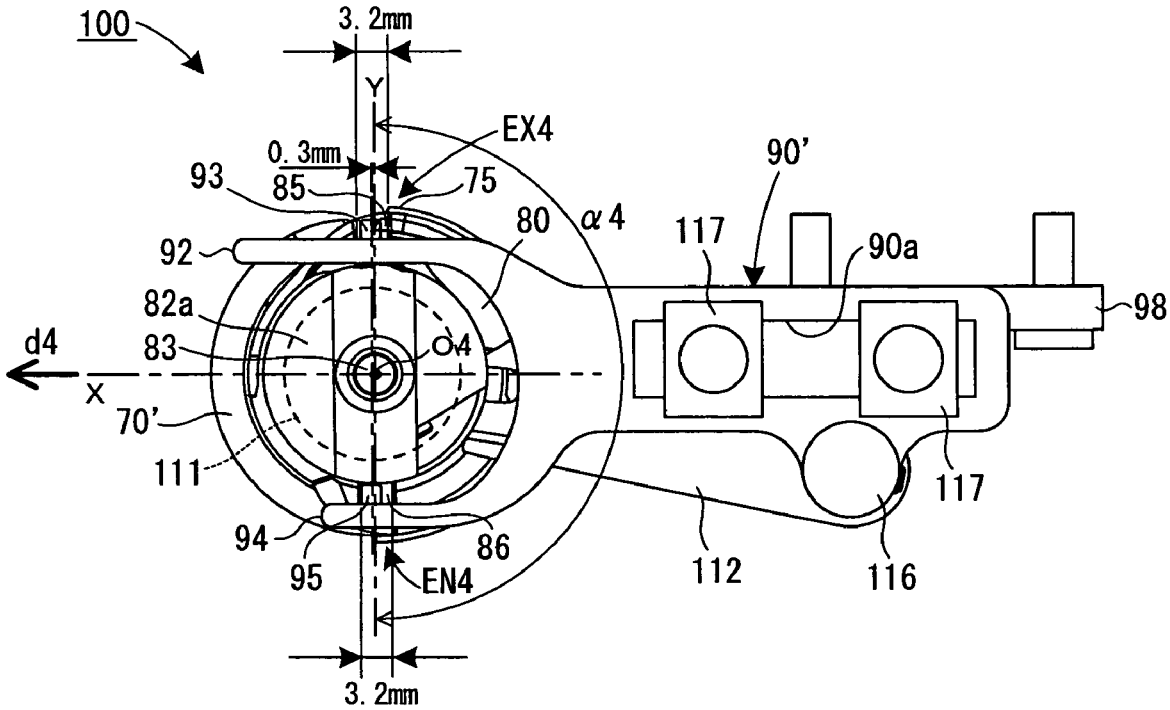
FIG. 26 An explanatory view showing one preferred mode of embodiment, in which the seam puckering preventing shuttle device of the sewing machine of the invention is applied to the outer-hook-loop-taker-point type full rotation hook (or the inner hook stopper reciprocating movements).
Figure 27:
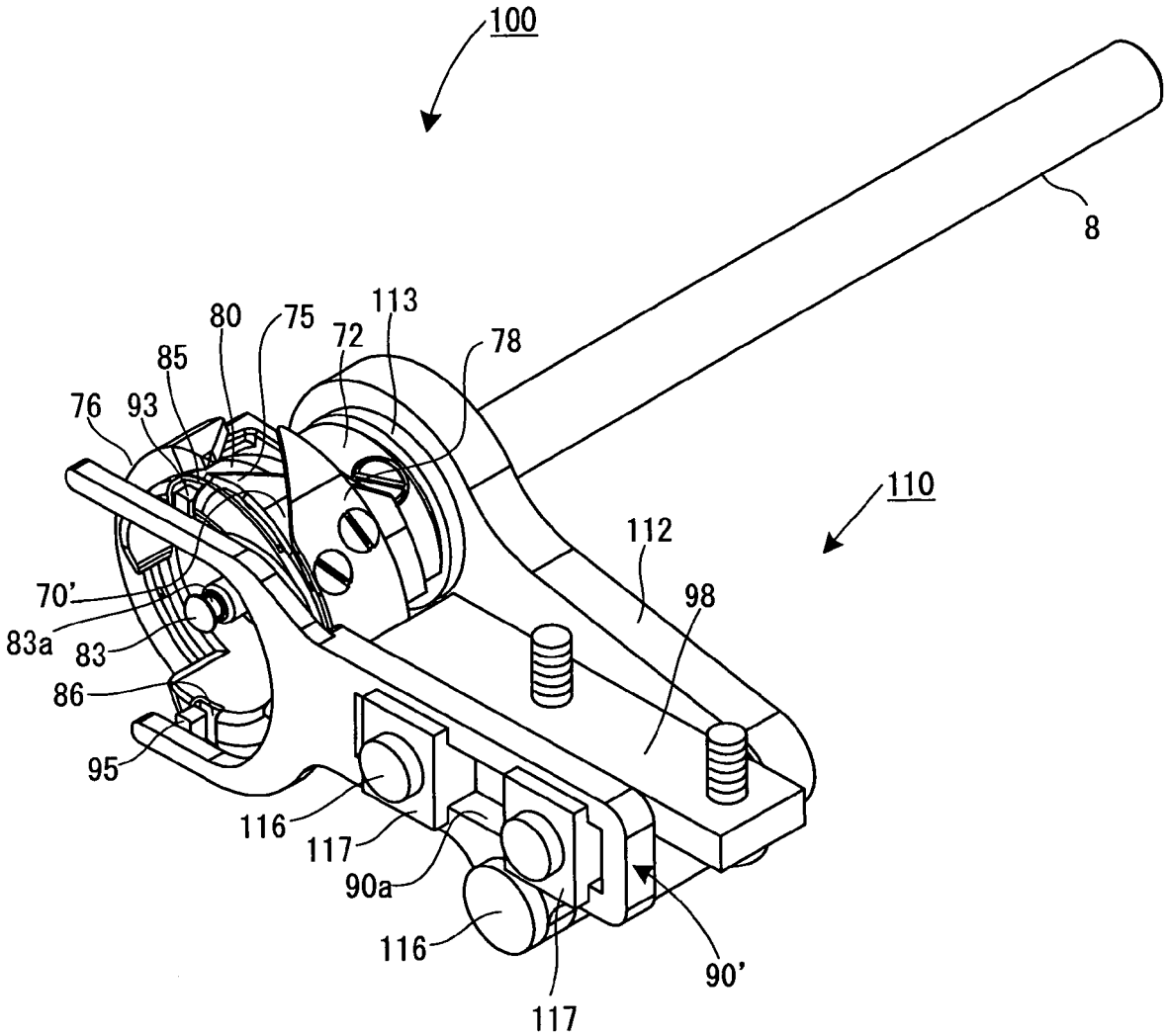
FIG. 27 A perspective view showing the outer-hook-loop-taker-point type full rotation hook of FIG. 26.
Figure 28:
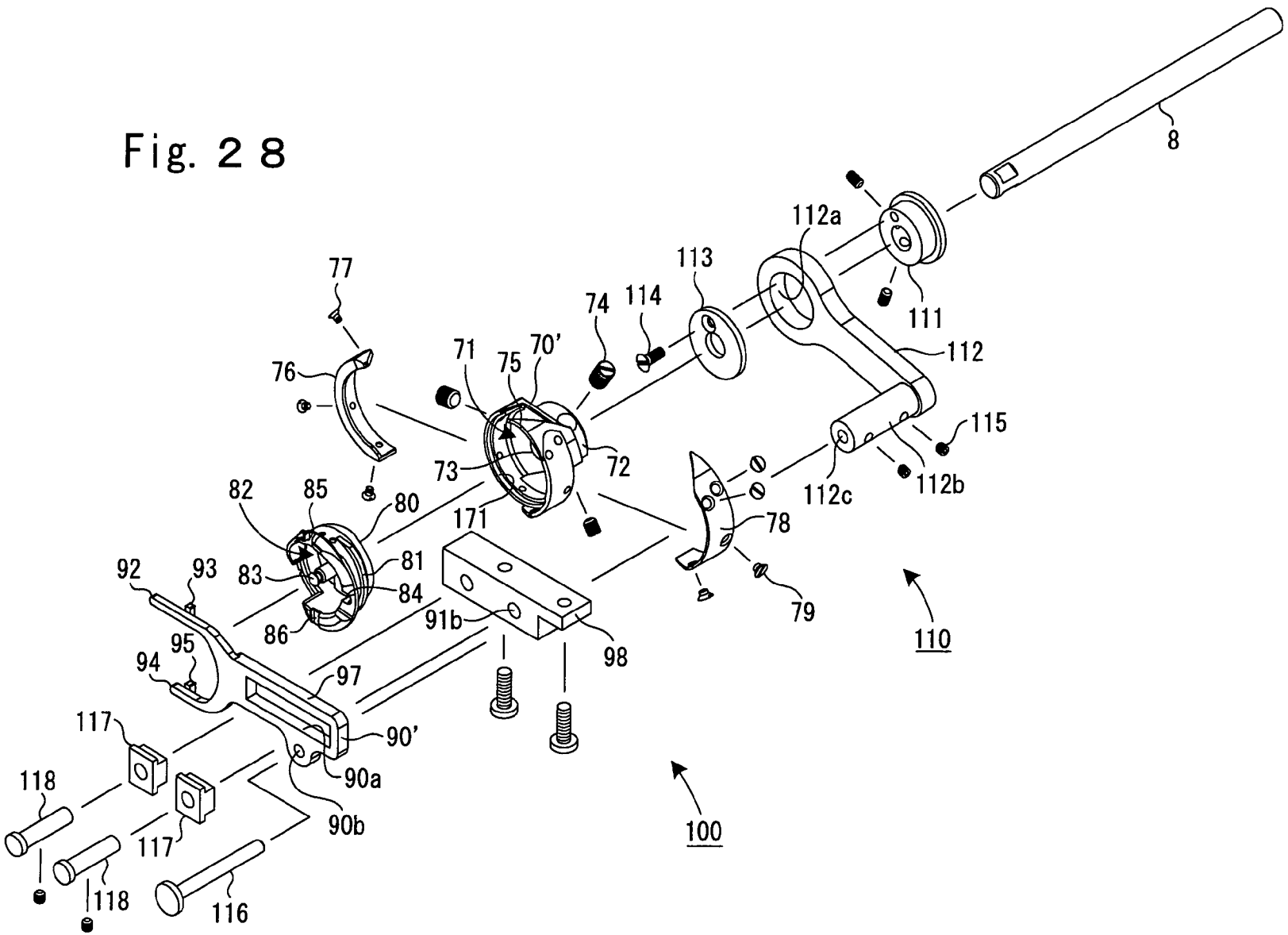
FIG. 28 An exploded perspective view showing the outer-hook-loop-taker-point type full rotation hook of FIG. 26.

This full rotation hook 1, as shown in FIG. 4, is disposed below the throat plate 7 attached to a bed 3 of the sewing machine body, and is exemplified by an outer-hook-loop-taker-point type full rotation hook 100, as shown in FIG. 26, FIG. 27 and FIG. 28. The full rotation hook 100 includes: a shuttle bobbin case (as will be called the "bobbin case 65", although not shown in FIG. 26 to FIG. 28 but contains one similar to the shuttle bobbin 66 shown in FIG. 2) accommodating the shuttle bobbin (as will be called the "shuttle bobbin 66", although not shown in FIG. 26 to FIG. 28 but contains one similar to the shuttle bobbin 66) having the lower thread wound thereon and easily removably fixed to the frame (not-shown) of the machine body; an inner hook 80 accommodating the shuttle bobbin case 65 and prevented from rotating relative to the frame by an inner hook stopper 90'; and an outer hook 70' accommodating the inner hook 80 and having the loop-taker point 75 and rotated by the lower shaft 8 or one part of the rotation driving portion. When the outer hook 70' is rotated counter-clockwise in FIG. 26 by the lower shaft 8, the loop-taker point 75 can pick up the loop of the upper thread 12 (as referred to FIG. 4) and can lap the outer circumference of the inner hook 80 through the clearance between the outer hook 70' and the inner hook 80.

The outer hook 70' is arranged to have a rotation center common to that of the lower shaft 8 or one part of the rotation driving portion. The outer hook 70' is equipped with an inner hook stopper driving unit 110, which reciprocates the inner hook stopper 90' in synchronism with the rotation of the lower shaft 8 to rotationally stop the inner hook 80 by a hook stopper driving cam 111 fixed to the lower shaft 8 eccentric in the radial direction perpendicular to the axial direction of the lower shaft 8 when the loop-taker point 75 of the outer hook 70' is positioned at the upper dead center, thereby to convert the rotation of the lower shaft 8 into horizontal movements. This inner hook stopper driving unit 110 performs the horizontal reciprocating movements to form two upper thread entrance EN4 and upper thread exits EX4 at such circumferentially different positions between the inner hook stopper 90' and the inner hook 80 as to form the clearances, through which the loop of the upper thread picked up for every rotation of the rotationally driven outer hook 70' by the loop-taker point 75 is guided in and out the outer circumference of the inner hook 80 after it was pulled out to the maximum by the outer circumference of the inner hook 80.

The upper thread entrance EN4 is arranged at a position where the loop of the upper thread picked up by the loop-taker point 75 is guided in on the outer circumference of the inner hook 80, and the upper thread exit EX4 is arranged at a position where the loop of the upper thread is guided out on the outer circumference of the inner hook 80 and pulled upward of the throat plate.

The upper thread entrance EN4 and the upper thread exit EX4 are arranged to have an angular space $\alpha$4 of 110 degrees to 180 degrees, preferably 150 degrees to 170 degrees. In the example shown in FIG. 26, the angular space $\alpha$4 is set to 180 degrees. Here, the upper thread entrance EN4 and the upper thread exit EX4 are formed by the clearance varying with the rotation of the outer hook 70'. The angular space $\alpha$4 between the upper thread entrance EN4 and the upper thread exit EX4 expresses the angular space value at the time when the clearance between the upper thread entrance EN4 and the upper thread exit EX4 becomes the maximum for each thread passage. In the operation tests of the inventors, it has been confirmed that the outer-hook-loop-taker-point type full rotation hook 100 normally operated as the hook within the range of 110 degrees to 180 degrees.

The inner hook 80 has a structure identical to that of the inner hook 80 of the aforementioned full rotation hook 1 so that its description is omitted by designating it by the common reference numerals. However, the upper inner hook stopper groove 85 and the lower inner hook stopper groove 86 are so arranged at circumferentially different positions of the inner hook 80 as to have the aforementioned angular space a4 from the rotation center O4 of the inner hook 80.

The outer hook 70' also has a structure substantially identical to that of the outer hook 70 of the aforementioned full rotation hook 1 so that its description is omitted by designating it by the common reference numerals. However, the race groove to be fitted on the inner hook race 81 of the inner hook 80 is formed concentric to the lower shaft 8, so this race groove is designated by 171. When the inner hook race 81 of the inner hook 80 is fitted in the race groove 171 of the outer hook 70', the rotation center O4 of the inner hook 80 to be mounted in the outer hook 70' is concentric to the rotation center of the race groove 171 so that it is concentric to that of the lower shaft 8 or the rotation driving portion.

The inner hook stopper 90' is formed, like the inner hook stopper 90 of the outer hook 70 of the full rotation hook 1, generally into a bifurcated shape, of which the upper arm portion 92 is equipped with the protruding upper inner hook stopper 93 and of which the lower arm portion 94 is equipped with the protruding lower inner hook stopper 95. In this inner hook stopper 90', the inner hook stopper 97 extends laterally of FIG. 28, unlike the inner hook stopper base portion 91 of the inner hook stopper 90 of the outer hook 70 of the full rotation hook 10. The inner hook stopper driving unit 110 reciprocally moves the inner hook stopper 90' in synchronism with the rotation of the lower shaft 8 or one part of the rotation driving portion thereby to stop the rotation of the inner hook 80.

By moving the inner hook stopper 90' reciprocally in the radial direction d4 of the lower shaft 8 by the inner hook stopper driving unit 110, the upper thread entrance EN4 and the upper thread exit EX4 are so formed at circumferentially different positions of the inner hook 80 between the inner hook stopper 90' and the inner hook 80 as to form the clearance, through which the loop of the upper thread 12 picked up by the loop-taker point 75 for every rotation of the rotationally driven outer hook 70' is guided in and out the circumference of the inner hook 80 after it was pulled out to the maximum by the outer circumference of the inner hook 80.

This inner hook stopper driving unit 110 is so constructed of a mechanism for establishing the horizontal reciprocating movements from the lower shaft 8 as to include the hook holder driving cam 111 or an eccentric cam fixed on the lower shaft 8 for converting the rotation of the lower shaft 8 into horizontal movements, and a hook holder driving rod 112 to be fitted on the hook holder driving cam 111. The hook holder driving rod 112 is equipped at its one end with a drive rod hole 112*a* to be rotatably fitted on the cam portion of the hook holder driving cam 111, and at its other end with a drive rod arm 112*b* for fixing the inner hook stopper 90'. After the drive rod hole 112*a* of the hook holder driving rod 112 was fitted on the hook holder driving cam 111 fixed on the lower shaft 8, a cam washer 113 is so arranged on the side of the hook holder driving rod 112 and fixed on the hook holder driving cam 111 by a fixing member 114 such as a screw that the hook holder driving rod 112 may not come out from the hook holder driving cam 111. Here, the hook holder driving rod 112 can convert the rotation of the lower shaft 8 into the horizontal movements, because it retains clearances even if clamped between the hook holder driving cam 111 and the cam washer 113.

Moreover, a driving rod connecting hole 112*c* is formed in the driving rod arm 112*b* of the hook holder driving rod 112. A connecting pin 116 is inserted into a connecting drive hole 90*b* formed in the lower portion of the inner hook stopper base 97 of the inner hook stopper 90' and is then fixed in the drive rod arm 112*b* by a fixing member 115 such as screws. As a result, the flange portion formed at the head of the connecting pin 116 can be press-fitted on the inner hook stopper base 97. In the inner hook stopper base 97 of the inner hook stopper 90', moreover, there is formed a sliding rectangular hole 90*a*, into which two square pieces 117 having flanges are movably fitted, for example. After this, the inner hook stopper base 97 is fixed on an inner hook stopper base 98 which is fixed in a predetermined position on the frame of the sewing machine body. Here, predetermined spaces are left between the two square pieces 117 and the two end faces of the sliding rectangular hole 90*a* of the inner hook stopper 90', and the inner hook stopper 90' retains clearances even if it is clamped between the inner hook stopper base 98 and the flange portions of the square pieces 117, so that the inner hook stopper 90' can be reciprocally moved in the horizontal direction.

By thus disposing the inner hook stopper 90' on the inner hook stopper driving unit 110, the upper inner hook stopper 93 is arranged in the direction of the throat plate 7, and the upper inner hook stopper 93 and the lower inner hook stopper 95 are arranged at the angular space $\alpha 4$ substantially equal to that of the upper inner hook stopper groove 85 and the lower inner hook groove 86 of the inner hook 80.

When the outer hook 70', the inner hook 80, the inner hook stopper 90' and the inner hook stopper driving unit 110 thus constructed are assembled, predetermined clearances are formed between the upper inner hook stopper groove 85 and the upper inner hook stopper 93 and between the lower inner hook stopper groove 86 and the lower inner hook stopper 95. These clearances function as the upper thread entrance EN4 and exit EX4.

Next, the rotation hook actions of the outer-hook-loop-taker-point type full rotation hook 100, which is equipped with those upper thread entrance EN4 and exit EX4 and in which the outer hook 70' performs the rotational movement with respect to the inner hook 80 in synchronism with the needle 6, upon the upper thread 12 are described with reference to FIG. 29. In this action description, the direction is so taken as views FIG. 29 in front.

Here, this outer-hook-loop-taker-point type full rotation hook 100 performs two rotations for one cycle of the upward and downward movements of the needle 6. In FIG. 29 to be used for the description of the hook actions, it is assumed that the outer hook 70' rotates counter-clockwise when the lower shaft 8 performs the rotational movement of the counter-clockwise direction. For conveniences, moreover, the action description is started from the state (FIG. 29A), in which the loop-taker point 75 reaches the axial position of the needle 6 when the needle 6 having the upper thread 12 inserted thereinto rises by 2.0 mm from the lower dead center, and in which the loop-taker point 75 of the outer hook 70' positioned at the upper dead center. At this position, the clearances are formed between the upper rotation stopper groove 85 of the inner hook 80 and the two side faces of the upper inner hook stopper 93 of the inner hook stopper 90' for horizontal reciprocations of a predetermined length in the radial direction d4 of the lower shaft 8, and the lower inner hook stopper 95 of the inner hook stopper 90' abuts against the lefthand wall of the lower rotation stopper groove 86 of the inner hook. For conveniences, moreover, the upper inner hook stopper 93 and the lower inner hook stopper 95 of the inner hook stopper 90' are shown in circular shapes in FIG. 29.

When the needle 6 begins to rise from the aforementioned state, the upper thread 12 inserted into the needle 6 is pressed by the cloth through which the upper thread 12 penetrates together with the needle 6 at the upper face of the thread plate 7 so that it is not raised together with the needle 6 but left to form the loop.

Figure 29B:
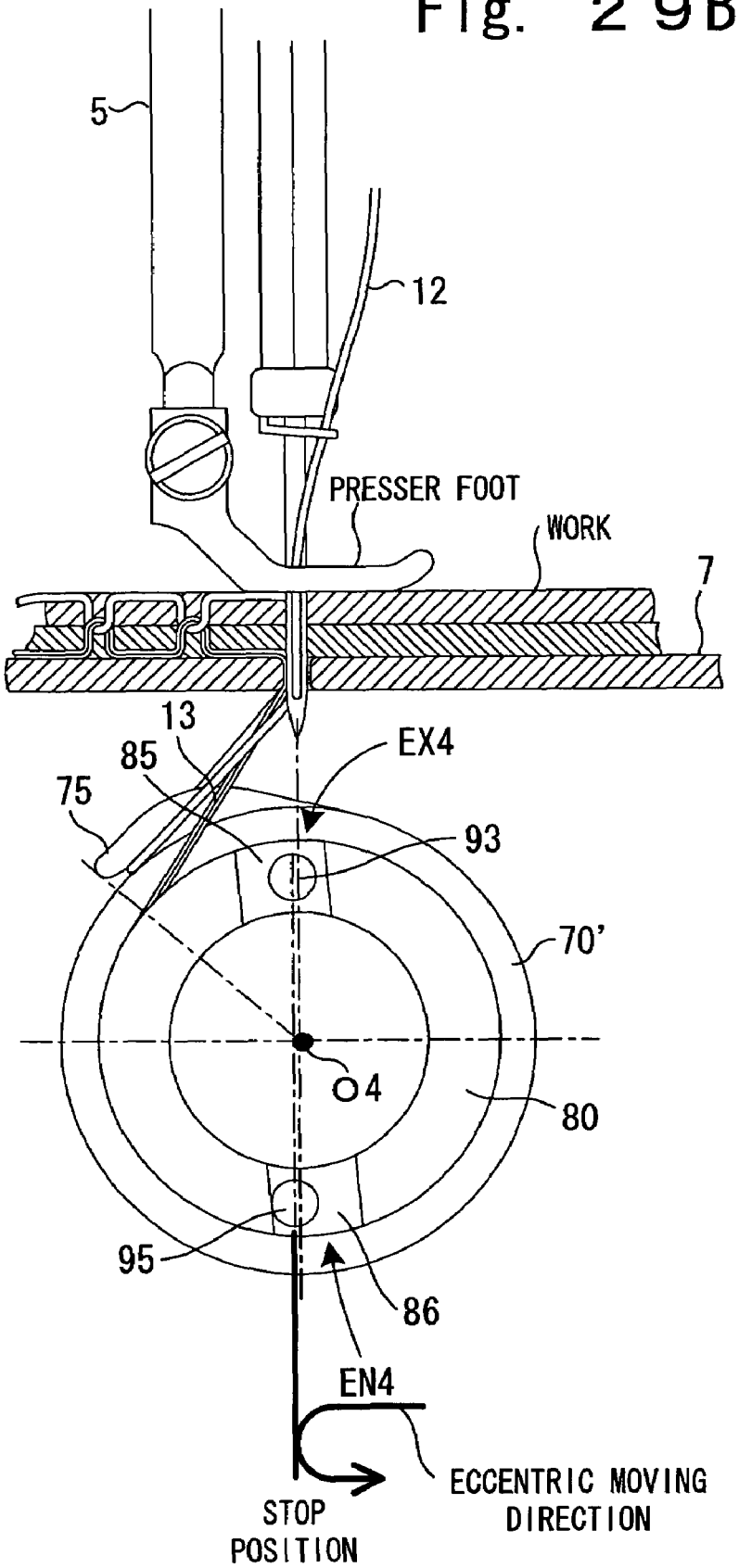
FIG. 29B An action explaining diagram showing an action state of the outer-hook-loop-taker-point type full rotation hook of FIG. 26.
Figure 29C:
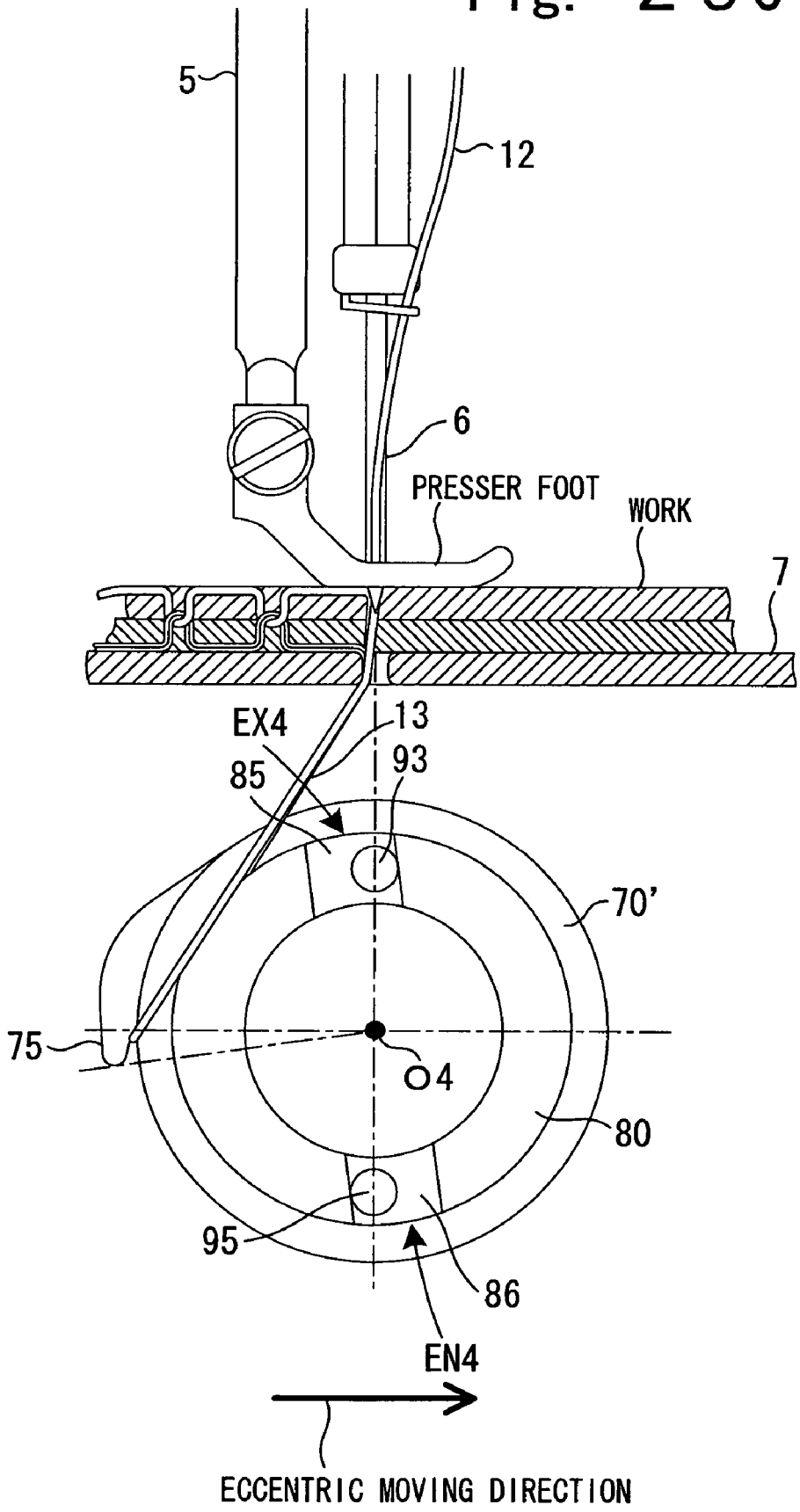
FIG. 29C An action explaining diagram showing an action state of the outer-hook-loop-taker-point type full rotation hook of FIG. 26.

This loop of the upper thread 12 is picked up, as shown in FIGS. 29B and 29C, by the loop-taker point 75 of the outer hook 70' rotated counter-clockwise by the rotational drive of the lower shaft 8, so that it is pulled in on the outer circumference of the inner hook 80. At this time, the inner hook 80 accommodated in the outer hook 70' is rotated counter-clockwise by the slight friction between the inner hook race 81 and the outer hook race groove 171. Then, the inner hook stopper 90' moves rightward in synchronism of the rotation of the lower shaft 8 so that the upper inner hook stopper 93 of the inner hook stopper 90' having a clearance for the upper rotation stopper groove 85 of the inner hook 80 comes into abutment against the righthand wall of the upper rotation stopper groove 85 (FIG. 29C). Here, the lower rotation stopper groove 86 of the inner hook 80 and the lower inner hook stopper 95 of the inner hook stopper 90' remain in abutment. In this state, the rotation center O4 of the inner hook 80 is aligned on the Y-axis with the center position of the upper inner hook stopper 93 and the lower inner hook stopper 95 of the inner hook stopper 90'.

Figure 29D:
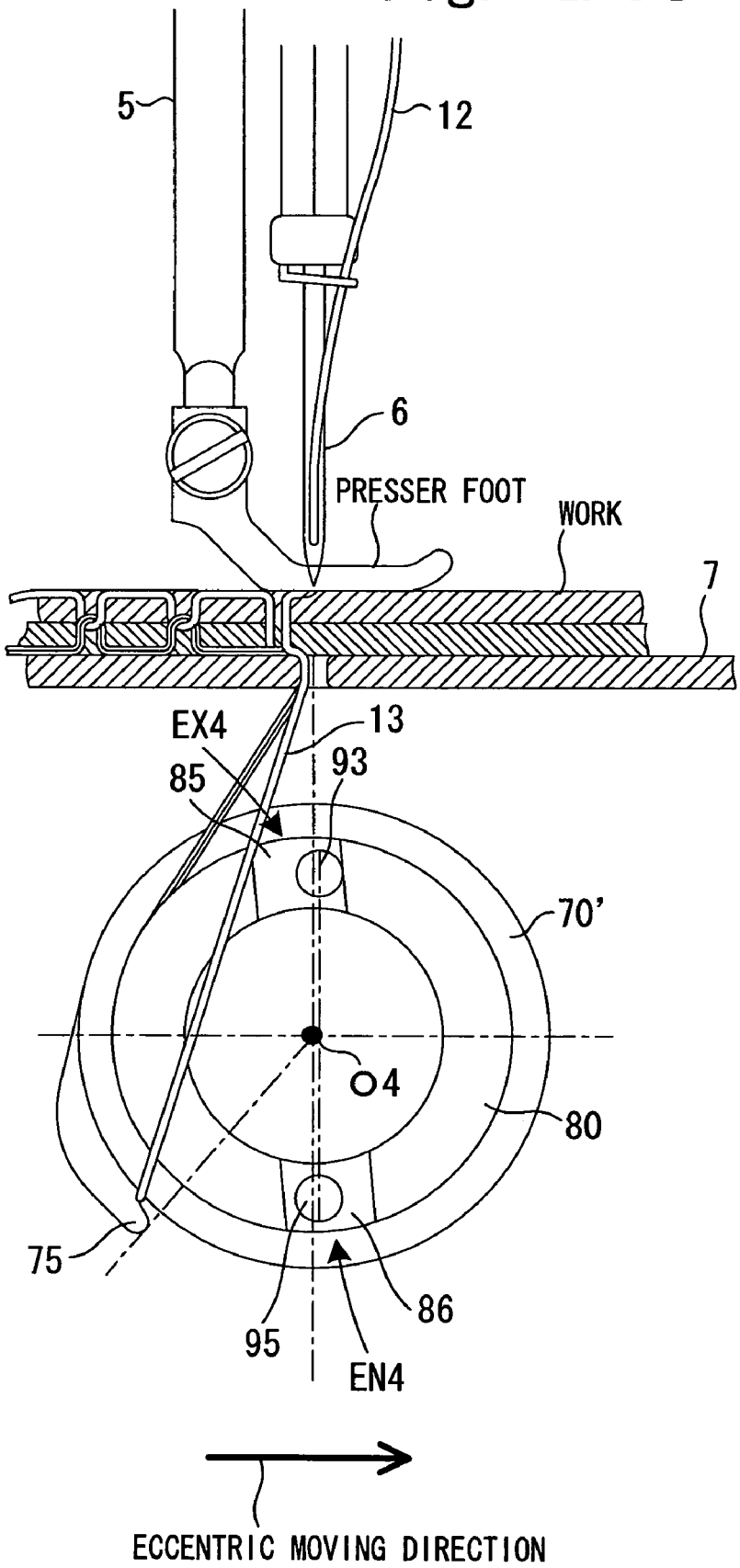
FIG. 29D An action explaining diagram showing an action state of the outer-hook-loop-taker-point type full rotation hook of FIG. 26.
Figure 29E:
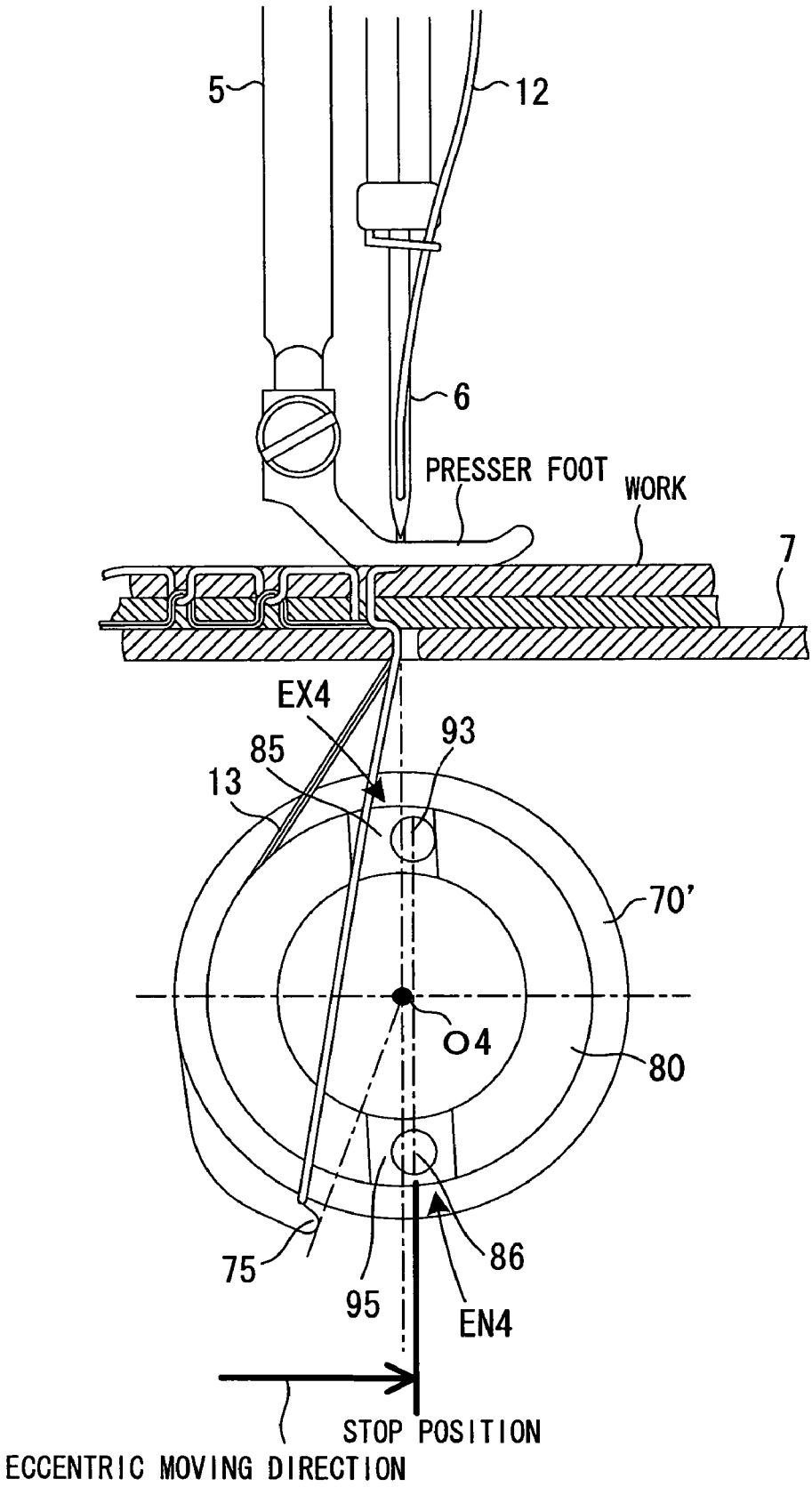
FIG. 29E An action explaining diagram showing an action state of the outer-hook-loop-taker-point type full rotation hook of FIG. 26.

The loop of the upper thread 12 pulled in on the outer circumference of the inner hook 80 is guided downward, as shown in FIG. 29D and FIG. 29E, by the loop-taker point 75 being moved by the rotational movement of the outer hook 70', and the inner hook stopper 90' moves rightward in synchronism with the rotation of the lower shaft 8. Then, the lower inner hook stopper 95 gradually comes out of abutment against the lefthand wall of the lower rotation stopper groove 86 of the inner hook 80. This is because the inner hook stopper 90' has been displaced rightward over the rotation center of the inner hook 80. However, the upper inner hook stopper 93 remains in abutment against the righthand wall of the upper rotation stopper groove 85.

Figure 29F:
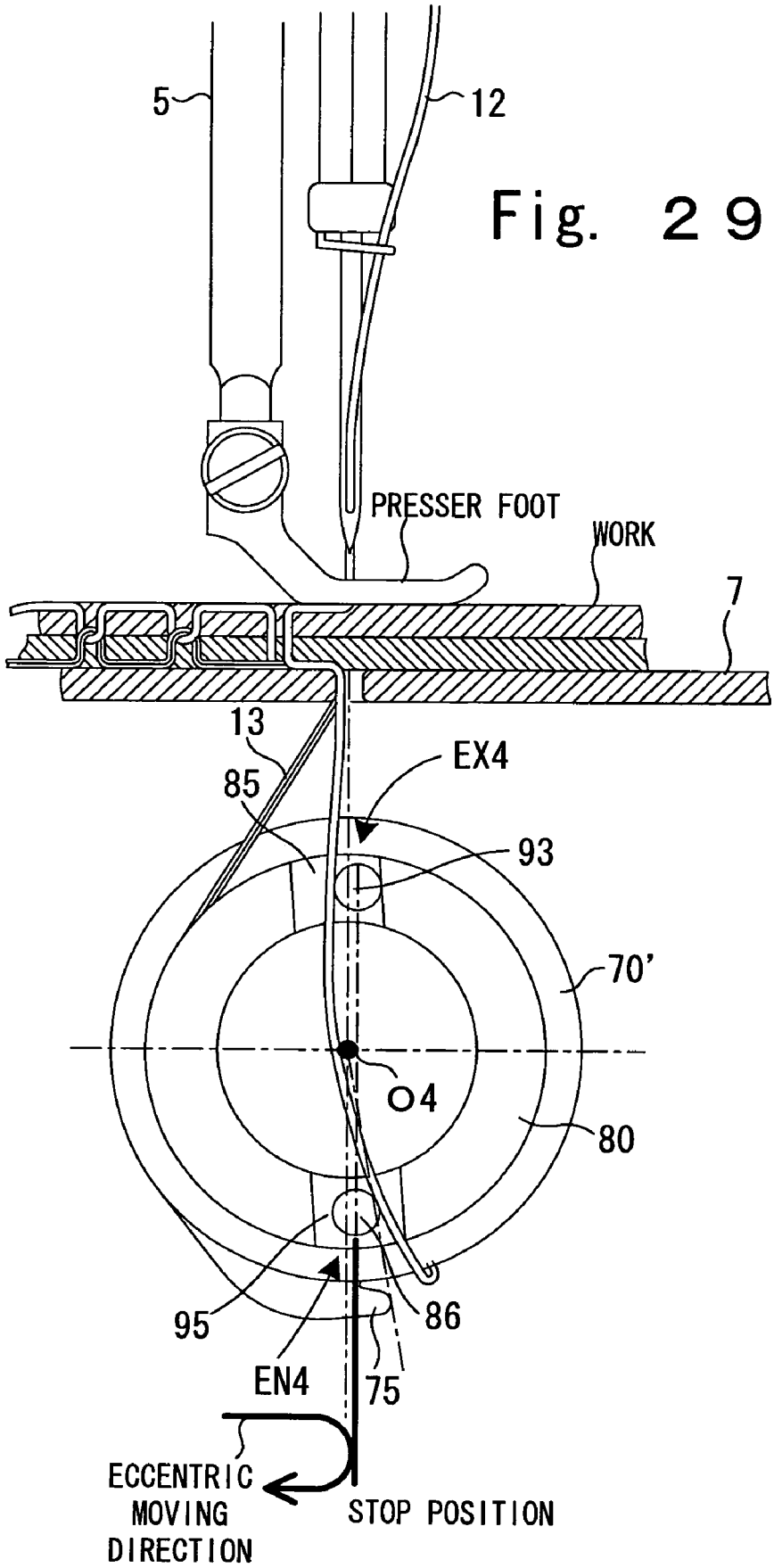
FIG. 29F An action explaining diagram showing an action state of the outer-hook-loop-taker-point type full rotation hook of FIG. 26.
Figure 29G:
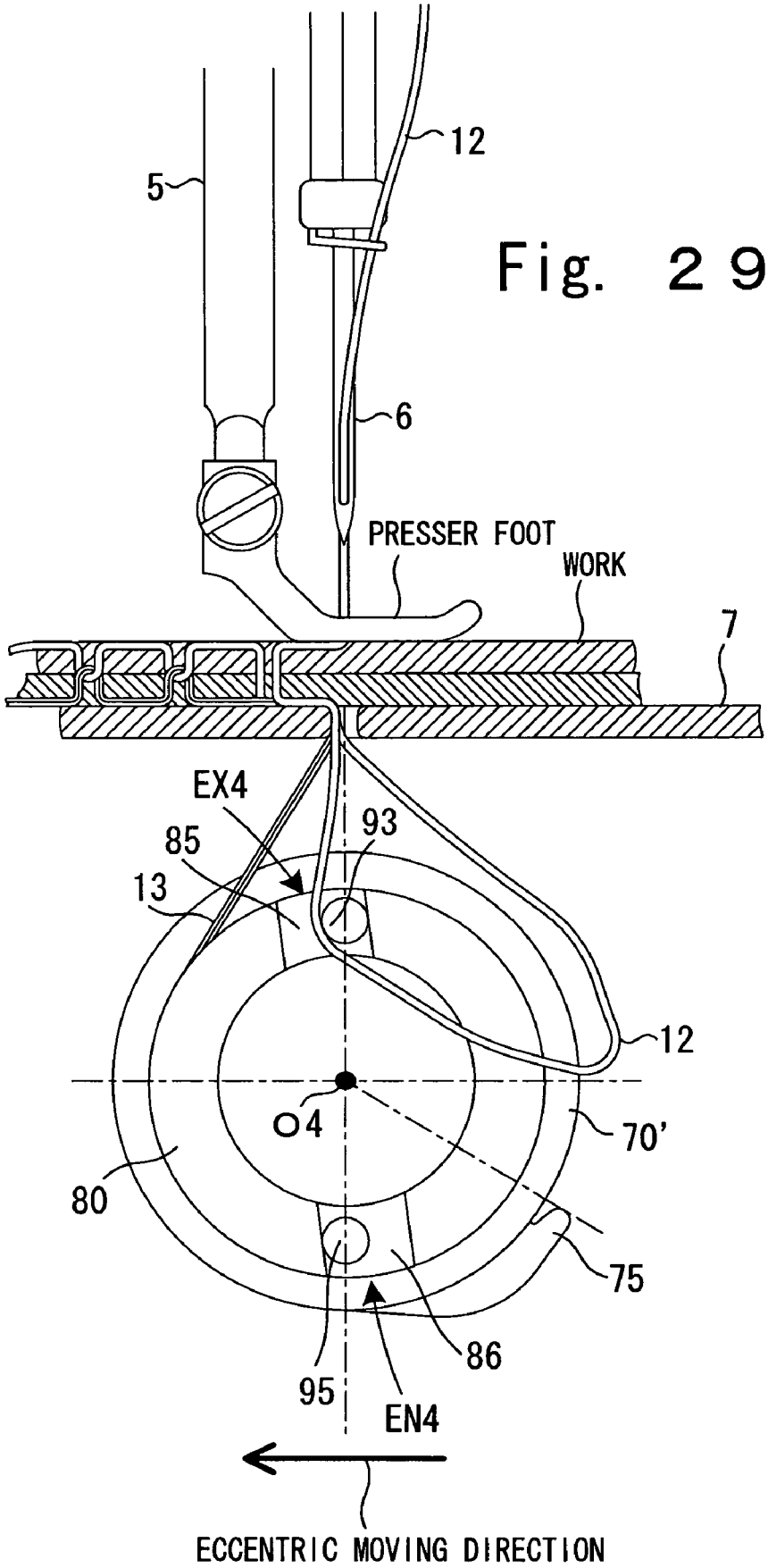
FIG. 29G An action explaining diagram showing an action state of the outer-hook-loop-taker-point type full rotation hook of FIG. 26.
Figure 29H:
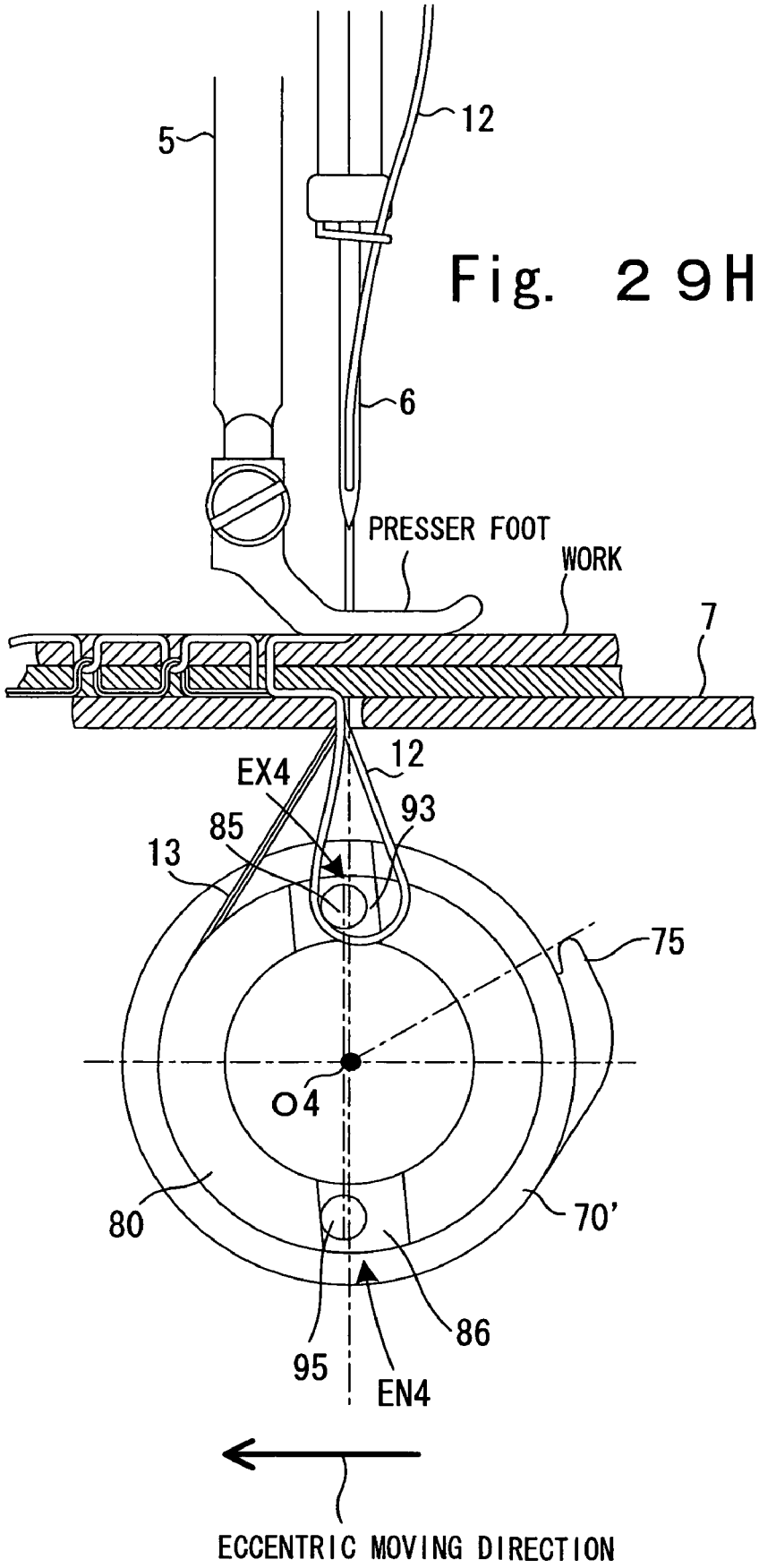
FIG. 29H An action explaining diagram showing an action state of the outer-hook-loop-taker-point type full rotation hook of FIG. 26.
Figure 291:
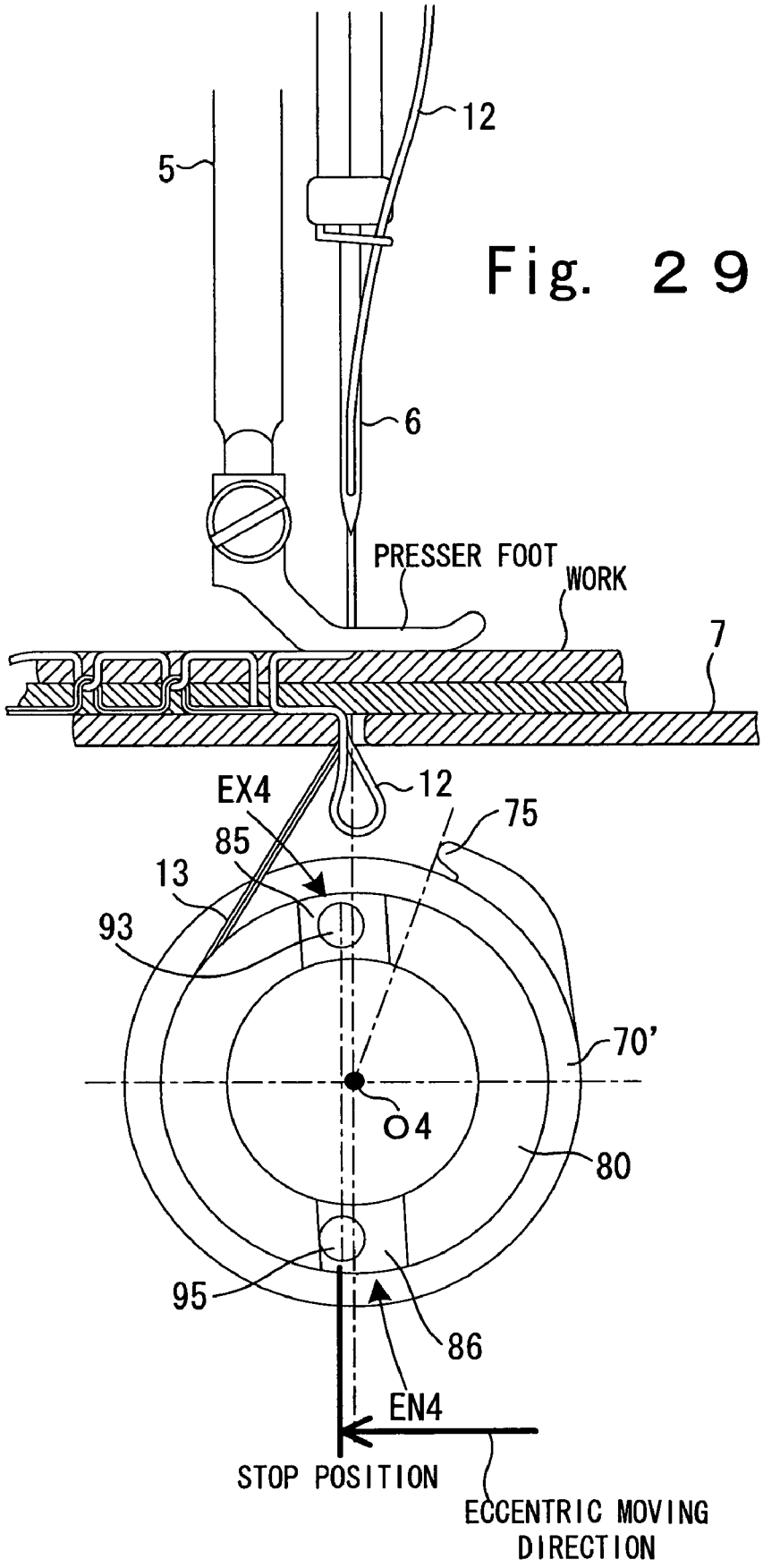

The loop of the upper thread 12 having been guided downward of the outer circumference of the inner hook 80 is further guided, as shown in FIG. 29F, by the loop-taker point 75 being moved by the rotational movement of the outer hook 70', to the lower rotation stopper groove 86 of the inner hook 80 regulated in the rotational movement by the inner hook stopper 90', so that it passes through the clearance between the lower rotation stopper groove 86 and the lower inner hook stopper 95. The loop of the upper thread 12 can smoothly pass through the clearance for the upper thread entrance EN4. When the loop of the upper thread 12 thus passes through the lower rotation stopper groove 86, the thread take-up lever 14 (as referred to FIG. 4) pulls up the upper thread 12 having been guided out from the inner hook 80. In this state where the thread take-up lever 14 is pulled up the upper thread 12, as shown in FIG. 29G, as the inner hook stopper 90' moves leftward in synchronism with the rotation of the lower shaft 8, the lower inner hook stopper 95 of the inner hook stopper 90' comes into abutment against the lefthand wall of the lower rotation stopper groove 86 of the inner hook 80. Here, the upper inner hook stopper 93 of the inner hook stopper 90' also remains in abutment against the righthand wall of the upper rotation stopper groove 85 of the inner hook 80. In this state, the rotation center O4 of the inner hook 80 is aligned on the Y-axis with the center position of the upper inner hook stopper 93 and the lower inner hook stopper 95 of the inner hook stopper 90'.

When the outer hook 70' performs a further rotational movement from the state of FIG. 29G, the upper inner hook stopper 93 of the inner hook stopper 90' gradually comes out of abutment against the righthand wall of the upper rotation stopper groove 85 of the inner hook 80, as the inner hook stopper 90' moves leftward in synchronism with the rotation of the lower shaft 8. As a result, the upper thread 12 pulled up by the thread take-up lever 14 passes through the clearance between the upper rotation stopper groove 85 and the upper inner hook stopper 93, and interlaces with the lower thread 13 to form lock stitches in the work. The loop of the upper thread 12 can smoothly pass through the clearance for the upper thread exit EX4. In this state, the lower inner hook stopper 95 is left in abutment against the lefthand wall of the lower rotation stopper groove 86.

Thus, while the outer hook 70' is performing one rotational movement, the inner hook stopper 90' performs horizontal reciprocating movements in the radial direction d4 of the lower shaft 8 in synchronism with the rotation of the lower shaft 8. When the upper thread 12 of the needle 6 is picked up by the loop-taker point 75 of the outer hook 70' and guided in on the outer circumference of the inner hook 80, the clearance can be formed between the lower rotation stopper groove 86 and the lower inner hook stopper 95 thereby to guide the upper thread 12 smoothly in on the outer circumference of the inner hook 80. As the outer hook 70' rotates so that the upper thread 12 is guided out from the inner hook 80, the clearance is formed between the upper rotation stopper groove 85 and the upper inner hook stopper 93 when the thread take-up lever 14 takes up the upper thread 12. As a result, the upper thread 12 can be pulled up by the thread take-up lever 14 without any resistance to the upper thread 12 being extracted from the rotation hook.

This outer-hook-loop-taker-point type full rotation hook 100 is further described on a specific example.

In the outer-hook-loop-taker-point type full rotation hook 100 of a general size, as shown in FIG. 26, the hook holder driving cam 111 is fixed to the lower shaft 8 at a mounting angle of 90 degrees counter-clockwise from the upper dead center of 0 degrees, where the loop-taker point 75 of the outer hook 70' is positioned, and with an eccentricity of 0.3 mm. As a result, the inner hook stopper 90' performs horizontal reciprocating movements from the position of the rotation center O4 of the inner hook 80 to the position of 0.3 mm in the radial direction d4 of the lower shaft 8.

As shown in FIG. 26, moreover, the upper inner hook stopper groove 85 and the lower inner hook stopper groove 86 of the inner hook 80 are set to have the angular space $\alpha$4 of 180 degrees.

As in the outer-hook-loop-taker-point type full rotation hook 10 of Embodiment 1, moreover, the upper inner hook stopper 93 and the lower inner hook stopper 95 of the inner hook stopper 90' are formed into a square protrusion shape having a width of 2 mm and a length of 2 mm. Moreover, the upper inner hook stopper groove 85 and the lower inner hook stopper groove 86 of the inner hook 80 are formed into a rectangular recess shape having a width of 3.2 mm and such a depth that the clearance between the upper inner hook stopper 93 and the lower inner hook stopper 95 and the end face of the protrusion may be 0.5 mm when the outer-hook-loop-taker-point type full rotation hook 100 is assembled in the bed 3 of the sewing machine body.

On the other hand, the outer hook 701 is so fixed on the lower shaft 8 that the loop-taker point 75 may reach the axial position of the needle 6 to pick up the loop of the upper thread 12 when the needle 6 rises by 2.0 mm from the lower dead center.

Figure 30:
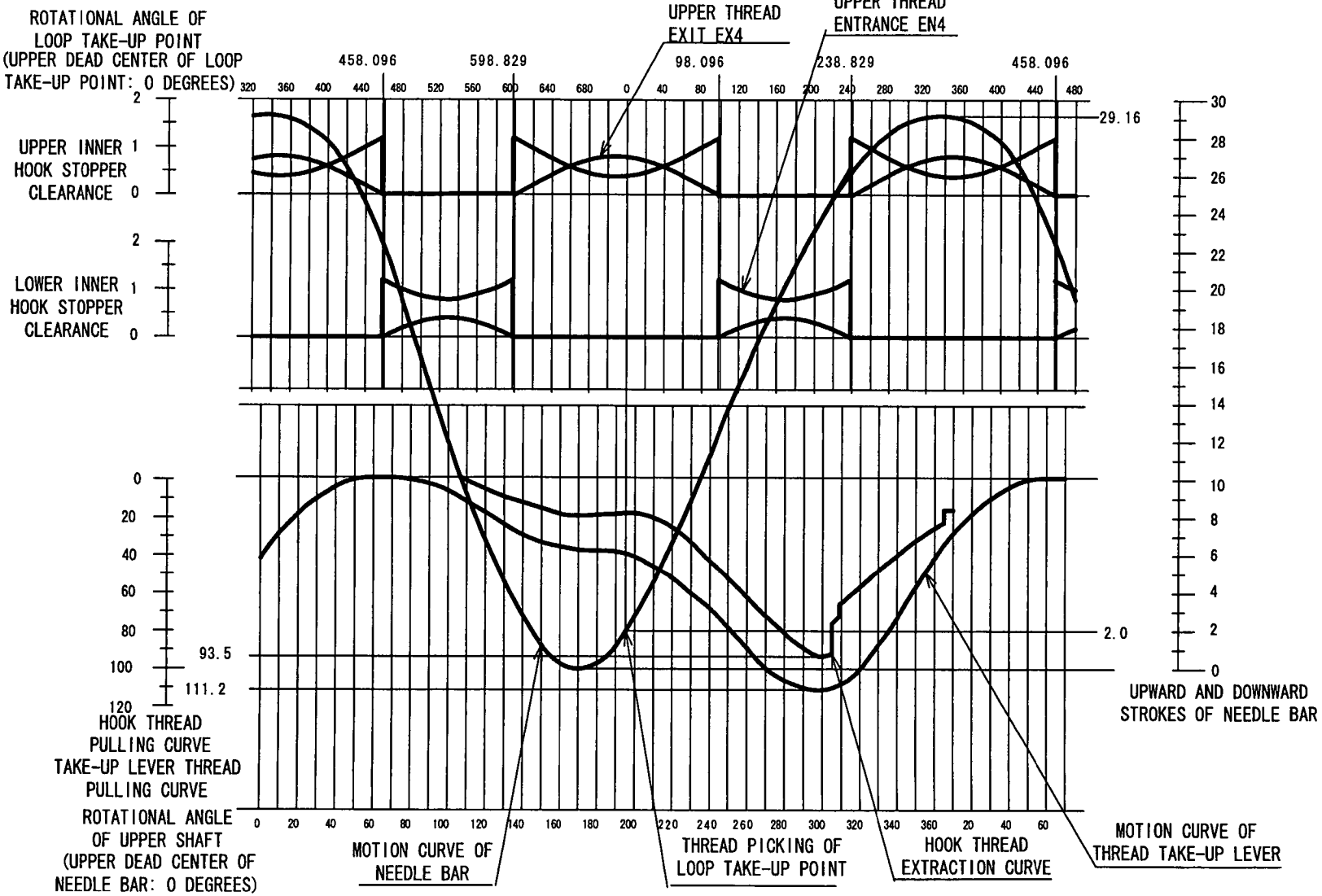
FIG. 30 An action explaining diagram (or a motion diagram) showing the action states of the needle bar, the thread take-up lever, and the upper thread entrance/exit of the rotation hook of the sewing machine, to which the outer-hook-loop-taker-point type full rotation hook of FIG. 26 is applied.

The rotation hook actions of the outer-hook-loop-taker-point type full rotation hook 100 are shown in the motion diagrams of the sewing machine of FIG. 30. In these motion diagrams, the outer-hook-loop-taker-point type full rotation hook 100 takes the state shown in FIG. 29A, when the rotational angle of the loop-taker point 75 of the outer hook 70' is at the upper dead center of 0 degrees, the state shown in FIG. 29B, when the rotational angle is 50 degrees, the state shown in FIG. 29C, when the rotational angle is 98.096 degrees, the state shown in FIG. 29D, when the rotational angle is 140 degrees, the state shown in FIG. 29E, when the rotational angle is 160 degrees, the state shown in FIG. 29F, when the rotational angle is 190 degrees, the state shown in FIG. 29G, when the rotational angle is 238.829 degrees, the state shown in FIG. 29H, when the rotational angle is 300 degrees, and the state shown in FIG. 29I, when the rotational angle is 340 degrees.

When the loop-taker point 75 of the outer hook 70' picks up the loop of the upper thread 12 at the upper dead center of 0 degrees, it is found that the upper thread exit EX4 (i.e., the clearance to be established between the upper rotation stopper groove 85 of the inner hook and the upper inner hook stopper 93 of the inner hook stopper 90) is opened, whereas the upper thread entrance EN4 (i.e., the clearance to be established between the lower rotation stopper groove 86 of the inner hook and the lower inner hook stopper 95 of the inner hook stopper 90) is closed. When the outer hook 70' rotates counter-clockwise from the upper dead center of 0 degrees to 98.096 degrees, both the upper thread entrance EN4 and exit EX4 are simultaneously closed. When the outer hook 70' subsequently rotates counter-clockwise, it is found that the inner hook 80 regulated in the rotational movement by the upper inner hook stopper 93 and the lower inner hook stopper 95 is caused to revolve by the rotational movement of the outer hook 90' so that the upper thread entrance EN4 is opened. While this upper thread entrance EN4 is opened (that is, while the loop-taker point is positioned from the angle of 98.096 degrees to 238.829 degrees), the loop-taker point 75 of the outer hook 70' can pass the loop of the upper thread 12 smoothly from the upper thread entrance EN4. When the outer hook 70' subsequently rotates counter-clockwise from 98.096 degrees to 238.829 degrees, both the upper thread entrance EN4 and exit EX4 are simultaneously closed. When the outer hook 70' subsequently rotates counter-clockwise, it is found that the inner hook stopper 90' is moved leftward in synchronism with the rotation of the lower shaft 8 to open the upper thread exit EX4. While this upper thread exit EX4 is opened (that is, while the loop-taker point is positioned from the angle of 238.829 degrees to 458.096 degrees), the loop-taker point 75 of the outer hook 70' can pass the loop of the upper thread 12 smoothly from the upper thread exit EX4.

Here, the positions of the upper rotation stopper groove 85 and the lower rotation stopper groove 86 of the inner hook 80 may be changed within the range of the angular space $\alpha$4 from 110 degrees to 180 degrees, if the lower rotation stopper groove 86 can be arranged at the position where the loop of the upper thread 12 picked up by the loop-taker point 75 of the outer hook 70' is guided in, after it has been pulled in to the maximum, on the outer circumference of the inner hook 80, and if the upper rotation stopper groove 85 can be arranged at the position where the loop of the upper thread 12 is guided out from the outer circumference of the inner hook 80 and pulled upward of the throat plate 7. In this case, it is needless to say that the upper inner hook stopper 93 and the lower inner hook stopper 95 of the inner hook stopper 90' are arranged at the substantially equal angular spaces.

Here, the outer-hook-loop-taker-point type full rotation hook 100 has been described on the type, which makes two rotations for one cycle of the upward and downward movements of the needle 6. However, the full rotation hook should not be limited thereto, but similar actions and advantages can be obtained even if the full rotation hook makes one rotation for one cycle of the upward and downward movements of the needle 6. In short, the outer-hook-loop-taker-point type full rotation hook 100 may rotate at any speed for one cycle of the upward and downward movements of the needle 6, if the loop of the upper thread 12 picked up by the loop-taker point 75 for each predetermined rotation of the rotationally driven outer hook 70' can be guided in, after it was pulled out to the maximum by the outer circumference of the inner hook 80, on the outer circumference of the inner hook 80 and can be guided out from the outer circumference of the inner hook 80.

As in the outer-hook-loop-taker-point type full rotation hook 100 of Embodiment 1, moreover, the shuttle bobbin 66 itself may also be accommodated in the inner hook 80, as shown in FIG. 10. This structure is well known in the art, and the shuttle bobbin 66 is held, after accommodated in the inner hook 80, rotatably by a shuttle bobbin holder lever 67.

Embodiment 5

In the seam puckering preventing shuttle device of the sewing machine of the invention, as shown in FIG. 4, the thread tension balance of a thread tension balancing device 15 for adjusting the disturbances in stitches due to the hardness of cloth, how to weave the cloth, or the thickness or strength of threads is stabilized so that the tension of the upper thread 12 may be balanced with the tension of the lower thread 13 to be let off the shuttle bobbin accommodated in the full rotation hook 1 thereby to stabilize the interlace point of the upper thread 12 and the lower thread 13 at a interlaced point. In order the pulsation of the upper thread 12 to be let off and pulled up by the thread take-up lever 14 may be suppressed when the upper thread 12 is guided in and out the full rotation hook 1, the upper thread 12 is taken up from a spool and introduced into the needle 6 through thread deflection preventing conduits 16 and 17 and through the tread tension balancing device 15. These thread deflection preventing conduits 16 and 17 are disposed at the upstream stage of the thread tension balancing device 15 so that the thread tension of the thread tension balancing device 15 can be made constant to stabilize the interlace point between the upper thread and the lower thread at the interlaced point. Since the upper thread 12 is inserted from the spool through the thread deflection preventing conduit 16 (and/or 17) and the thread tension balancing device 15 into the needle 6 thereby to make the thread balance of the thread tension balancing device 15 constant, when the upper thread 12 is guided in and out the full rotation hook, the tension of the upper thread 12 for suppressing the pulsations of the upper thread let off and pulled up by the thread take-up lever 14 is balanced with the tension of the lower thread let off from the shuttle bobbin accommodated in the full rotation hook so that the interlace point between the upper thread 12 and the lower thread 13 can be stabilized at the interlaced point thereby to prevent the seam puckering.

Moreover, the arm 2 of the sewing machine body, to which the individual full rotation hooks thus far described are applied, may also be provided with an arm thread guide 19, a first thread deflection preventing conduit 16, a small thread tension balancing device 18 or a thread streamer, a second thread deflection preventing conduit 17, a thread guard (not-shown) and a thread tension balancing device 15. The first thread deflection preventing conduit 16 is disposed at the upstream stage of the small thread tension balancing device 18 for regulating the position for the upper thread 12 to enter with respect to the small thread tension balancing device 18, and the second thread deflection preventing conduit 17 is disposed at the upstream stage of the thread tension balancing device 15 for regulating the position for the upper thread 12 to enter with respect to the thread tension balancing device 15, so that the position where the upper thread 12 enters can be substantially fixed with respect to each of the thread tension balancing devices. As a result, when the upper thread 12 is inserted from the spool through the arm thread guide 19, the first thread deflection preventing conduit 16, the small thread tension balancing device 18, the second thread deflection preventing conduit 17, the thread guard (not-shown) and the thread tension balancing device 15 into the needle, the thread balance through the individual thread tension balancing devices 18 and 15 can be fixed to stabilize the interlace point between the upper thread and the lower thread can be stabilized at the interlaced point. Since the upper thread 12 is inserted from the spool through the thread deflection preventing conduit 16 (and/or 17) and the thread tension balancing device 15 into the needle 6 thereby to make the thread balance of the thread tension balancing device 15 constant, when the upper thread 12 is guided in and out the full rotation hook, the tension of the upper thread 12 for suppressing the pulsations of the upper thread let off and pulled up by the thread take-up lever 14 is balanced with the tension of the lower thread let off from the shuttle bobbin accommodated in the full rotation hook so that the interlace point between the upper thread 12 and the lower thread 13 can be stabilized at the interlaced point thereby to prevent the seam puckering.

Figure 31:
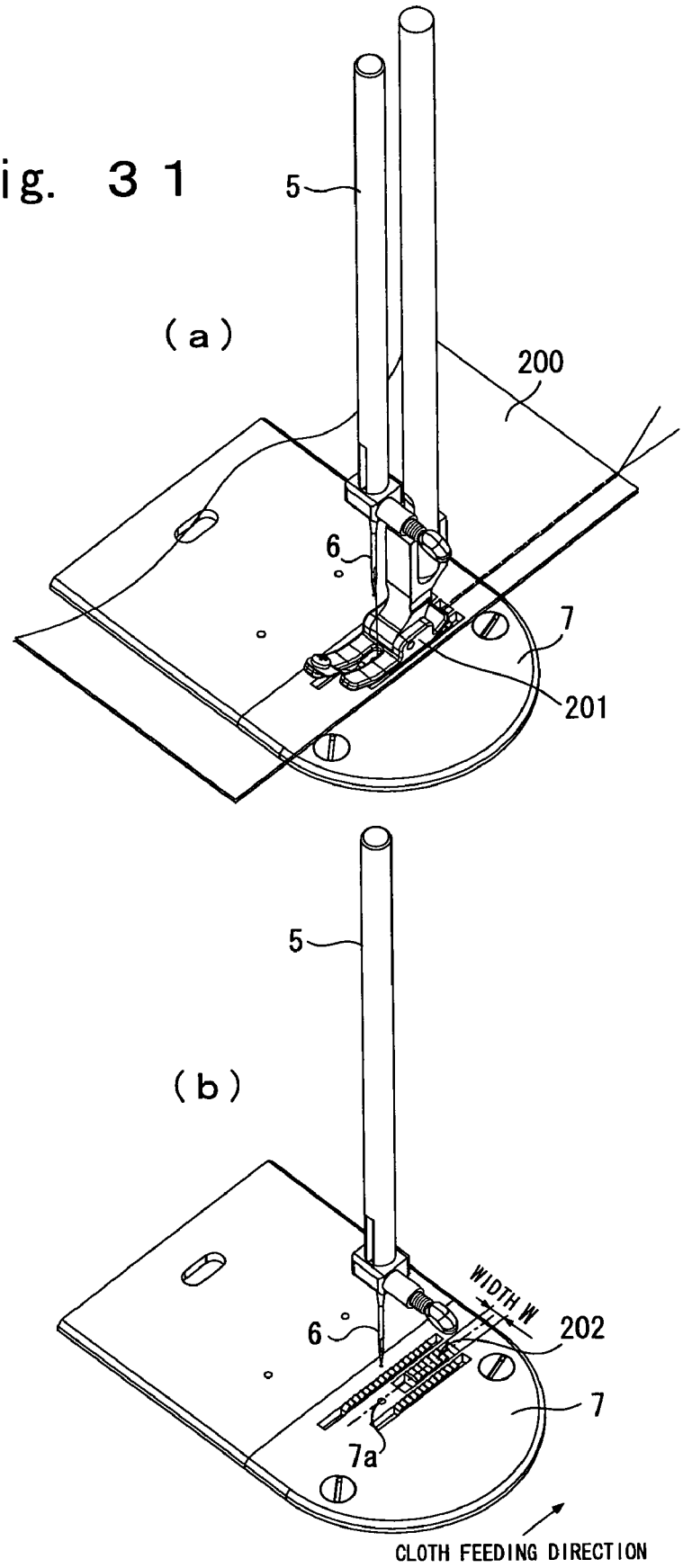
FIG. 31 (a) An explanatory view showing the sewing state of the sewing machine, and (b) an explanatory view showing the relations among the needle, the throat plate and the feed dog.

In the seam puckering preventing shuttle device (or the seam puckering preventing horizontal shuttle device) of the sewing machine of the invention, as shown in FIGS. 31A and 31B, a work 200 is clamped on the throat plate 7 between a presser foot 201 and a feed dog 202, and the upper thread 12 is guided in and out the full rotation hook 1 (as referred to FIG. 4), and is let off and pulled up by the thread take-up lever 14 (as referred to FIG. 4). When the work 200 is to be advanced stitch by stitch of the work by the feed dog 202, this feed dog 202 feeds stitch by stitch the work 200 having the stitches with the presser foot 201 and extending through the center of the needle drop hole 7*a* of the throat plate 7. This feed dog 202 has a transverse width W of 2 times to four times, preferably 2.5 times to 3.5 times as large as the diameter of the needle drop hole 7*a* of the throat plate 7. According to this embodiment, the feed dog 202 has the width W of a predetermined times as large as the diameter of the needle drop hole 7*a*. When the work is clamped on the throat plate 7 between the presser foot 201 and the feed dog 202 and when upper thread 12 is guided in and out the full rotation hook 1, and let off and pulled up by the thread take-up lever 14, the work 200 is advanced stitch by stitch with the feed dog 202, and the work 200 can be clamped by the feed dog 202 together with the sewn stitches and stably fed without any displacement thereby to prevent the seam puckering.

In the seam puckering preventing shuttle device (or the seam puckering preventing horizontal shuttle device) of the sewing machine of the invention, as shown in FIGS. 33A and 33B, a work 200 is clamped on the throat plate 7 between a presser foot 201 and a feed dog 202, and the upper thread 12 is guided in and out the full rotation hook 1 (as referred to FIG. 4), and is let off and pulled up the thread take-up lever 14 (as referred to FIG. 4). When the work 200 is to be advanced stitch by stitch of the work by the feed dog 202, the work 200 is caused by the inertia to slide into such a clearance at the instant when it is decelerated from the stitch-by-stitch feeding speed at which the work 200 is clamped by the presser foot 201 to the stop as is formed between the throat plate 7 and the presser foot 201 raised by the feed dog 202, thereby to prevent the slackness of the work 200 caused by being fed more than the necessary amount. For this prevention, the presser foot 201 is equipped at an entrance portion 201*a* of the work 200 with a resilient member 203 in ordinary contact with the work 200 not sewn. This resilient member 203 is properly exemplified by a resilient leaf spring. Here, the entrance portion 201*a* of the presser foot 201 is positioned on the side, to which the work 200 is fed, with respect to the dropping position of the needle 6.

Figure 32:
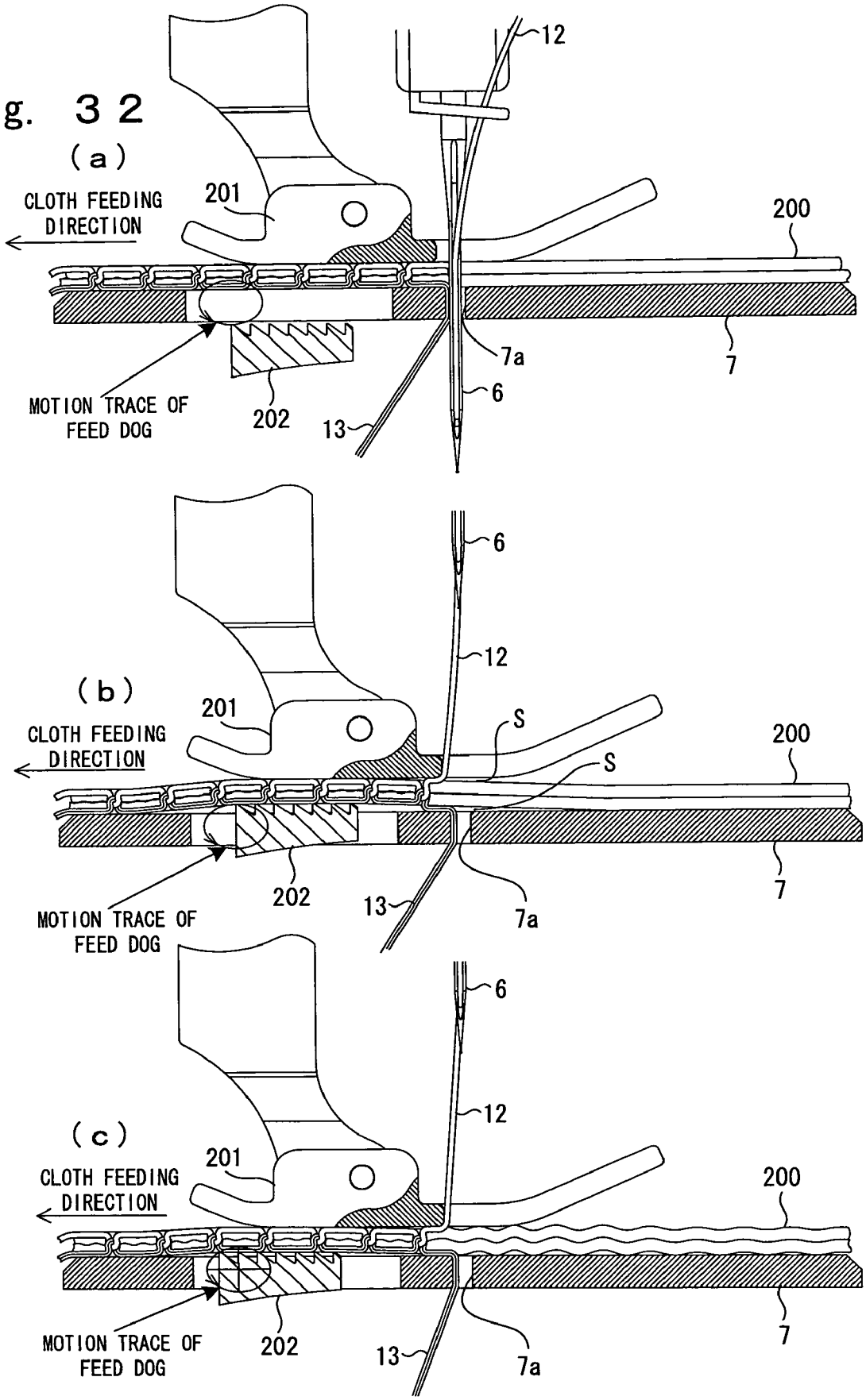
FIG. 32 Diagrams showing the sewing state of the sewing machine. (a) an explanatory diagram when the feed dog is positioned below the throat plate, (b) an explanatory diagram of the state, in which the feed dog clamps the work together with the presser foot so that the feeding speed is most accelerated, and (c) an explanatory diagram of the state, in which the feed dog is in the state of (b) so that the feed speed is decelerated.

The presser foot of the prior art not having such resilient member 203 is ordinarily subjected to the seam puckering. Specifically, as shown in FIG. 32, in the state where the needle 6 is stuck into the work 200, that is, when the needle 6 is positioned at the lower dead center, the feed dog 202 is positioned below the throat plate 7 (FIG. 32A). From this state, the upper thread 12 is guided in and out the full rotation hook and is then pulled up by the thread take-up lever 14. Then, the needle 6 is lifted, and the feed dog 202 rises while performing an elliptical movement to clamp the work 200 together with the presser foot 201 thereby to advance the work by one stitch. At this time, the feeding speed of the feed dog 202 is being accelerated. On the other hand, the feed dog 202 protrudes from the throat plate 7 so that the clearance S is formed between the throat plate 7 and the presser foot 201 (FIG. 32B). When a predetermined cloth feeding pitch is approached, the feeding speed of the feed dog 202 is decelerated. At this time, the work 200 is raised by the feed dog 202 from the upper face of the throat plate 7 to establish the clearance S between the throat plate 7 and the presser foot 201 so that the work 200 is accelerated to slide into the clearance S and is fed more than necessary. At this instant, the presser foot 201 and the feed dog 202 clamp only the sewn side of the work 200, as viewed from the needle center, so that wrinkles are formed in the work (FIG. 32C), which has been fed more than necessary by the cloth feeding inertia of the work 200. In this state, therefore, the needle 6 is stuck into the work 200 thereby to cause the seam puckering.

Figure 33:
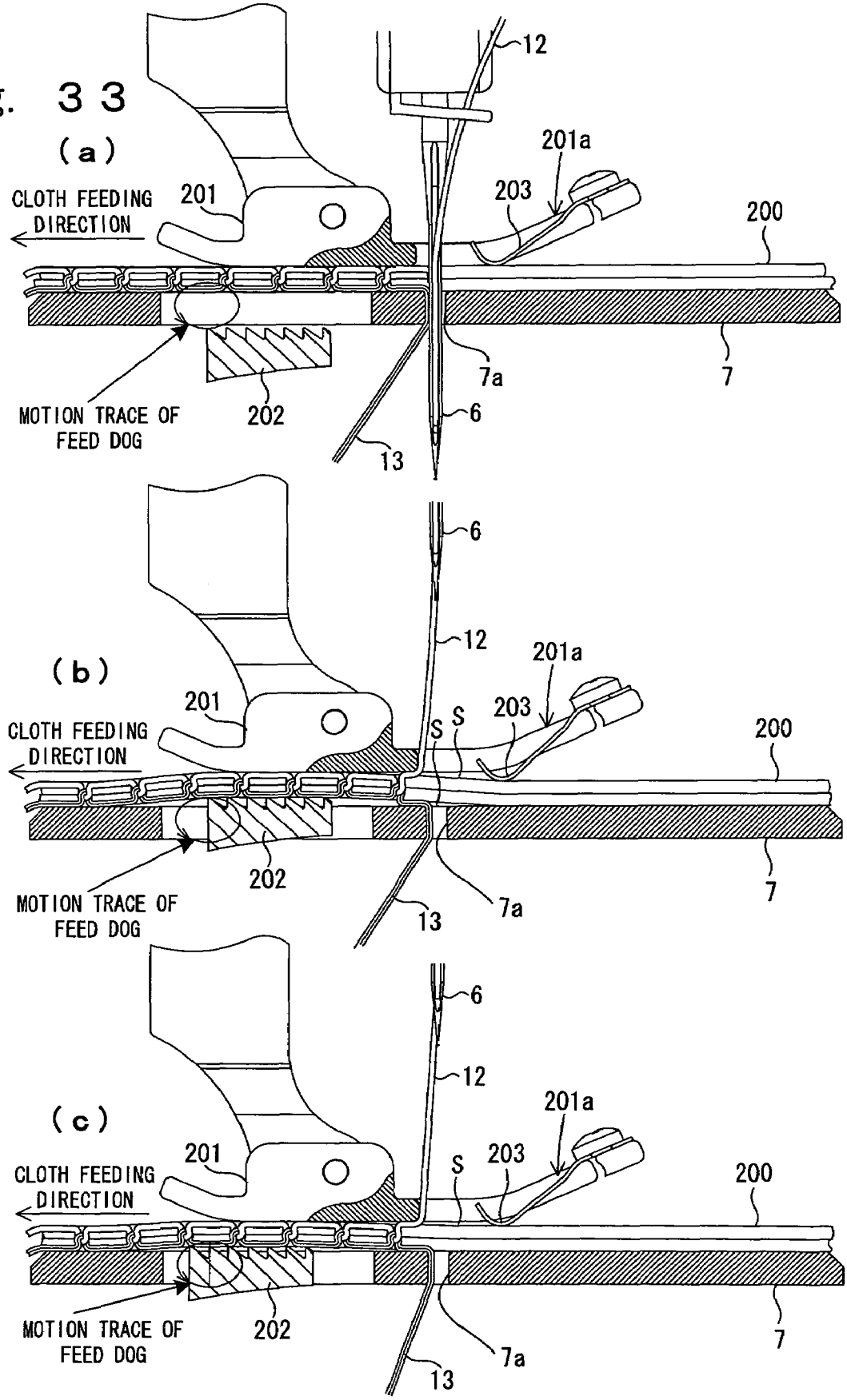
FIG. 33 Diagrams showing one preferred mode of embodiment, in which the seam puckering preventing shuttle device of the sewing machine of the invention is applied to the presser foot. (a) an explanatory diagram of the sewing state of the sewing machine, in which the feed dog is positioned below the throat plate, (b) an explanatory diagram of the sewing state of the sewing machine, in which the feed dog clamps the work together with the presser foot so that the feeding speed is most accelerated, and (c) an explanatory diagram of the state, in which the feed dog is in the state of (b) so that the feed speed is decelerated.

In the presser foot 201 having the resilient member 203, on the contrary, in the state where the needle 6 is stuck in the work 200, i.e., where the needle 6 is positioned at the lower dead center, as shown in FIG. 33, the feed dog 202 is positioned below the throat plate 7 (FIG. 33A). When the upper thread 12 is guided, from this state, in and out the full rotation hook and is pulled up by the thread take-up lever, the needle 6 is raised, and the feed dog 202 rises in the elliptical movement and clamps the work 200 with the presser foot 201 thereby to advance the work by one stitch. At this time, the feeding speed of the feed dog 202 is being accelerated. Moreover, the feed dog 202 protrudes over the throat plate 7 thereby to form the clearance S between the throat plate 7 and the presser foot 201 (FIG. 33B). When the predetermined cloth feeding pitch is approached, the feeding speed of the feed dog 202 is decelerated. At this time, the clearance S is formed between the throat plate 7 and the presser foot 201 so that the work 200 slides into that clearance S and is fed more than necessary. Since, however, the resilient member 203 always in contact with the not-sewn work 200 is disposed at the entrance portion 201*a* of the presser foot 201, the work 200 is pressed onto the throat plate 7 by the resilient force of that resilient member 203 so that the work 200 does not slide into the clearance S to be formed between the throat plate 7 and the presser foot 201. As a result, no wrinkle is formed in the work 200 to be sewn by the needle 6, so that the work 200 can be sewn without any seam puckering (FIG. 33C).

According to this embodiment, the presser foot 201 is equipped, at the entrance portion 201*a* of the work 200, with the resilient member 203 always in contact with the not-sewn work 200. This work 200 is clamped on the throat plate 7 between a presser foot 201 and a feed dog 202, and the upper thread 12 is guided in and out the full rotation hook, and is pulled up by the thread take-up lever. When the work 200 is to be advanced stitch by stitch of the work by the feed dog 202, the slackness of the work 200 caused by sliding of the work 200 into such a clearance S generated between the throat plate 7 and the presser foot 201 raised by the feed dog 202 due to the inertia at the instant when it is decelerated from the stitch-by-stitch feeding speed at which the work 200 is advanced while being clamped by the presser foot 201 to the stop as is formed, thereby to prevent the seam puckering of the work 200. Especially, the occurrence of the seam puckering by the cloth feeding inertia of the work is serious in the high-speed sewing but can be prevented by disposing the resilient member 203 at the entrance portion 201*a* of the presser foot 201 for the work 200.

The invention has been described on the specific modes of embodiment shown in the drawings. However, the invention should not be limited to those embodiments but could naturally adopt any of the structures that have been heretofore known for the advantages thereof. For example, the rotational direction of the rotation hook may be clockwise not counterclockwise. Moreover, the rotation hook may rotate not twice but others.

The invention claimed is:

1. A seam puckering preventing shuttle device of a sewing machine, which uses an upper thread inserted into a needle moving upward and downward while drawing a trace vertically of a throat plate, and a lower thread accommodated in a full rotation hook, which is disposed below the throat plate and accommodates the lower thread, and which picks up the upper thread, at the time when the upper thread inserted into the needle extending through a work placed on the throat plate and performing reciprocating movements in the vertical direction is raised from the lower dead center of the needle for each feed of the work, with a loop-taker point of the full rotation hook to interlace the upper thread and the lower thread thereby to form lock stitches in the work, wherein the full rotation hook includes: an inner hook accommodating a shuttle bobbin having the lower thread wound thereon and fixed removably, and prevented from rotating relative to the frame by an inner hook stopper; and an outer hook mounting the inner hook therein, having the loop-taker point and rotated by a rotation driving portion;

wherein the inner hook is arranged to have its rotation center eccentric to the rotation center of the rotation driving portion so that an upper thread entrance and an upper thread exit are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven as pulled out to the maximum by the outer circumference of the inner hook;

wherein the upper thread entrance is arranged at the position where the loop of the upper thread picked up by the loop-taker point is guided in on the outer circumference of the inner hook whereas the upper thread exit is arranged at the position where the loop of the upper thread is guided out on the outer circumference of the inner hook and pulled upward of the throat plate;

wherein the upper thread entrance and the upper thread exit are arranged at an angular space of 120 degrees to 160 degrees; and wherein the rotation center of the inner hook is eccentric in the direction at the angular space between the upper thread entrance and the upper thread exit with respect to the rotation center of the rotation driving portion.

2. A seam puckering preventing shuttle device of a sewing machine as set forth in claim 1, comprising, for balancing the tension of the upper thread with the tension of the lower thread guided out from the shuttle bobbin to thereby stabilize the interlace point between the upper thread and the lower thread;

a thread deflection conduit;

a thread tension balancing device; and wherein, the upper thread is inserted from a spool through the thread deflection preventing conduit and the a thread tension balancing device into the needle thereby to fix the thread tension of the thread tension balancing device, so that the pulsations of the upper thread, as might otherwise be caused by taking or pulling up the upper thread by a thread take-up lever when the upper thread is guided in and out of the full rotation hook are suppressed.

3. A seam puckering preventing shuttle device of a sewing machine as set forth in claim 1, wherein, the work is advanced stitch by stitch by a feed dog by clamping the work on the throat plate between a presser foot and the feed dog, and by taking up the upper thread by a thread take-up lever for guiding in and out the upper thread on the full rotation hook; and wherein the feed dog extends through the center of a needle drop hole of the needle for advancing the work stitch by stitch by clamping the work having seams with the presser foot, and has a width two to four times, as large as the diameter of the needle drop hole.

4. A seam puckering preventing shuttle device of a sewing machine as set forth in claim 1, wherein, the work is advanced stitch by stitch by a feed dog by clamping the work on the throat plate between a presser foot and the feed dog, and by taking up the upper thread by a thread take-up lever for guiding in and out the upper thread the full rotation hook; and wherein, at deceleration from the feeding speed to the feeding stop for the work having the seams to advance while being clamped on the feed dog by the presser foot, inertia does not cause the work to slide into a clearance formed between the throat plate and the presser foot raised by the feed dog and the work is not loosened by the cloth feed more than a necessary amount for one stitch, the presser foot being equipped at an entrance portion thereof for the work, with a resilient member for constant contact with the work before sewn.

5. A seam puckering preventing shuffle device of a sewing machine, which uses an upper thread inserted into a needle moving upward and downward while drawing a trace vertically of a throat plate, and a lower thread accommodated in a full rotation hook , which is disposed below the throat plate and accommodates the lower thread, and which picks up the upper thread, at the time when the upper thread inserted into the needle extending through a work placed on the throat plate and performing reciprocating movements in the vertical direction is raised from the lower dead center of the needle for each feed of the work, with a loop-taker point of the full rotation hook to interlace the upper thread and the lower thread thereby to form lock stitches in the work, wherein the full rotation hook includes: an inner hook accommodating a shuffle bobbin case accommodating a shuffle bobbin having the lower thread wound thereon and removably fixed, and prevented from rotating relative to the frame by an inner hook stopper; and an outer hook mounting the inner hook therein, having the loop-taker point and rotated by a rotation driving portion;

wherein the inner hook is arranged to have its rotation center eccentric to the rotation center of the rotation driving portion so that an upper thread entrance and an upper thread exit are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven was pulled out to the maximum by the outer circumference of the inner hook;

wherein the upper thread entrance is arranged at the position where the loop of the upper thread picked up by the loop-taker point is guided in on the outer circumference of the inner hook whereas the upper thread exit is arranged at the position where the loop of the upper thread is guided out on the outer circumference of the inner hook and pulled upward of the throat plate;

wherein the upper thread entrance and the upper thread exit are arranged at an angular space of 120 degrees to 160 degrees ; and wherein the rotation center of the inner hook is eccentric in the direction at the angular space between the upper thread entrance and the upper thread exit with respect to the rotation center of the rotation driving portion.

6. A seam puckering preventing shuttle device of a sewing machine as set forth in claim 5 comprising, for balancing the tension of the upper thread with the tension of the lower thread guided out from the shuttle bobbin to thereby stabilize the interlace point between the upper thread and the lower thread:

a thread deflection conduit;

a thread tension balancing device; and wherein, the upper thread is inserted from a spool through the thread deflection preventing conduit and the thread tension balancing device into the needle thereby to fix the thread tension of the thread tension balancing device, so that the pulsations of the upper thread, as might otherwise be caused by taking or pulling up the upper thread by a thread take-up lever when the upper thread is guided in and out of the full rotation hook, are suppressed.

7. A seam puckering preventing shuttle device of a sewing machine as set forth in claim 5, wherein, the work is advanced stitch by stitch by a feed dog by clamping the work on the throat plate between a presser foot and the feed dog, and by taking up the upper thread by a thread take-up lever for guiding in and out the upper thread on the full rotation hook; and wherein the feed dog extends through the center of a needle drop hole of the needle for advancing the work stitch by stitch by clamping the work having seams with the presser foot, and has a width two to four times as large as the diameter of the needle drop hole.

8. A seam puckering preventing shuttle device of a sewing machine as set forth in claim 5, wherein, the work is advanced stitch by stitch by a feed dog by clamping the work on the throat plate between a presser foot and the feed dog, and by taking up the upper thread by a thread take-up lever for guiding in and out the upper thread the full rotation hook; and wherein, at deceleration from the feeding speed to the feeding stop for the work having the seams to advance while being clamped on the feed dog by the presser foot, inertia does not cause the work to slide into a clearance formed between the throat plate and the presser foot raised by the feed dog and the work is not loosened by the cloth feed more than a necessary amount for one stitch, the presser foot being equipped, at an entrance portion thereof for the work, with a resilient member for constant contact with the work before sewn.

9. A seam puckering preventing shuttle device of a sewing machine, which uses an upper thread inserted into a needle moving upward and downward while drawing a trace vertically of a throat plate, and a lower thread accommodated in a full rotation hook, which is disposed below the throat plate and accommodates the lower thread, and which picks up the upper thread, at the time when the upper thread inserted into the needle, extending through a work placed on the throat plate and performing reciprocating movements in the vertical directions is raised from the lower dead center of the needle for each feed of the work, with a loop-taker point of the full rotation hook to interlace the upper thread and the lower thread thereby to form lock stitches in the work, wherein the full rotation hook includes:

an inner hooks;

a shuttle bobbin having the lower thread wound thereon and removably fixed within the inner hook; and the loop-taker point;

a rotary member, defining a rotation center, for rotatably driving the inner hook; and a non-rotatable outer hook mounting the inner hook rotatably therein;

wherein the inner hook includes two driven portions arranged at circumferentially spaced positions, and the rotary member includes two driving portions individually loosely fitted to the driven portions, as pairs of a driven portion and a driving portion, for rotatably driving the inner hook;

wherein the driven portions are arranged with a rotation center eccentric to the rotation center of the rotary member so that, when one pair of a the driving portion and a driven portion are engaged to rotatably drive the inner hook, the driving portion and the driven portion of the other pair have a clearance therebetween, before the loop of the upper thread is pulled to the maximum by the loop-taker point of the inner hook for guiding in and out the loop of the upper thread on the side of the driving portions of the inner hook;

wherein the upper thread entrance is arranged at the phase where the loop of the upper thread picked up by the loop-taker point is guided onto the outer circumference of the inner hook whereas the upper thread exit is arranged at the phase where the loop of the upper thread is guided off of the outer circumference of the inner hook and pulled upward of the throat plate;

wherein the upper thread entrance and the upper thread exit are angularly spaced 90 degrees to 130 degrees at circumferentially different positions across the upper dead center of the loop-taker point; and wherein the rotation center of the driven portions is eccentric, in a direction backward of the upper dead center of the loop-taker point, with respect to the rotation center of the rotary member.

10. A seam puckering preventing shuttle device of a sewing machine as set forth in claim 9 comprising, for balancing the tension of the upper thread with the tension of the lower thread guided out from the shuttle bobbin to thereby stabilize the interlace point between the upper thread and the lower thread:

a thread deflection conduit;

a thread tension balancing device; and wherein, the upper thread is inserted from a spool through the thread deflection preventing conduit and the thread tension balancing device into the needle thereby to fix the thread tension of the thread tension balancing device, so that the pulsations of the upper thread, as might otherwise be caused by taking or pulling up the upper thread by a thread take-up lever when the upper thread is guided in and out of the full rotation hook, are suppressed.

11. A seam puckering preventing shuffle device of a sewing machine as set forth in claim 9, wherein, the work is advanced stitch by stitch by a feed dog by clamping the work on the throat plate between a presser foot and the feed dog, and by taking up the upper thread by a thread take-up lever for guiding in and out the upper thread on the full rotation hook; and wherein the feed dog extends through the center of a needle drop hole of the needle for advancing the work stitch by stitch by clamping the work having seams with the presser foot, and has a width two to four times as large as the diameter of the needle drop hole.

12. A seam puckering preventing shuffle device of a sewing machine as set forth in claim 9, wherein, the work is advanced stitch by stitch by a feed dog by clamping the work on the throat plate between a presser foot and the feed dog, and by taking up the upper thread by a thread take-up lever for guiding in and out the upper thread the full rotation hook; and wherein, at deceleration from the feeding speed to the feeding stop for the work having the seams to advance while being clamped on the feed dog by the presser foot, inertia does not cause the work to slide into a clearance formed between the throat plate and the presser foot raised by the feed dog and the work is not loosened by the cloth feed more than a necessary amount for one stitch, the presser foot being equipped, at an entrance portion thereof for the work, with a resilient member for constant contact with the work before sewn.

13. A seam puckering preventing shuttle device of a sewing machine as set forth in claim 4 wherein the length of the needle defines an axis and wherein the rotation center of driven portions is axially opposite the upper dead center of the loop-taker point relative to the rotation center of the rotary member.

14. A seam puckering preventing shuttle device of a sewing machine, which uses an upper thread inserted into a needle moving upward and downward while drawing a trace vertically of a throat plate, and a lower thread accommodated in a full rotation hook, which is disposed below the throat plate and accommodates the lower thread, and which picks up the upper thread, at the time when the upper thread inserted into the needle1 extending through a work placed on the throat plate and performing reciprocating movements in the vertical direction1 is raised from a the lower dead center of the needle for each feed of the work, with a loop-taker point of the full rotation hook to interlace the upper thread and the lower thread thereby to form lock stitches in the work, wherein the full rotation hook includes, a shuttle bobbin case accommodated within the inner hook, a shuttle bobbin removably fixed within the shuttle bobbin case and having the lower thread wound thereon; a loop-taker point; a rotary member, defining a rotation center, for rotatably driving the inner hook; and a non-rotatable outer hook mounting the inner hook for rotation therein;

wherein the inner hook includes two driven portions arranged at circumferentially spaced different positions, and two driving portions circumferentially spaced and individually loosely fitted to the driven portions, as pairs of a driven portion and a driving portion, for rotatably driving the inner hook;

wherein the driven portions are arranged with a rotation center eccentric to the rotation center of the rotary member so that, when one pair of a the driving portion and a driven portion are engaged to rotatably drive the inner hook, the driving portion and the driven portion of the other pair have a clearance therebetween, before the loop of the upper thread is pulled to the maximum by the loop-taker point of the inner hook, for guiding in and out the loop of the upper thread on the side of the driving portions of the inner hook;

wherein the upper thread entrance is arranged where the loop of the upper thread picked up by the loop-taker point is guided onto the outer circumference of the inner hooks whereas the upper thread exit is arranged where the loop of the upper thread is guided off of the outer circumference of the inner hook and pulled upward of the throat plate;

wherein the upper thread entrance and the upper thread exit are angularly spaced 90 degrees to 130 degrees at circumferentially different positions across the upper dead center of the loop-taker point; and wherein the rotation center of the driven portions is eccentric, in a direction backward of the upper dead center of the loop-taker point, with respect to the rotation center of the rotary member.

15. A seam puckering preventing shuttle device of a sewing machine as set forth in claim 14 wherein the driven portions are individually formed of a groove or hole extending a predetermined length in the circumferential direction or in a radial direction whereas the driving portions are made of projections extending a predetermined length in the circumferential direction.

16. A seam puckering preventing shuttle device of a sewing machine as set forth in claim 15 wherein the length of the needle defines an axis and wherein the rotation center of driven portions is axially opposite the upper dead center of the loop-taker point relative to the rotation center of the rotary member.

17. A seam puckering preventing shuffle device of a sewing machine as set forth in claim 14 comprising, for balancing the tension of the upper thread with the tension of the lower thread guided out from the shuttle bobbin to thereby stabilize the interlace point between the upper thread and the lower thread:

a thread deflection conduit;

a thread tension balancing device; and wherein, the upper thread is inserted from a spool through the thread deflection preventing conduit and the thread tension balancing device into the needle thereby to fix the thread tension of the thread tension balancing device, so that the pulsations of the upper thread, as might otherwise be caused by taking or pulling up the upper thread by a thread take-up lever when the upper thread is guided in and out of the full rotation hook, are suppressed.

18. A seam puckering preventing shuttle device of a sewing machine as set forth in claim 14, wherein, the work is advanced stitch by stitch by a feed dog by clamping the work on the throat plate between a presser foot and the feed dog, and by taking up the upper thread by a thread take-up lever for guiding in and out the upper thread on the full rotation hook; and wherein the feed dog extends through the center of a needle drop hole of the needle for advancing the work stitch by stitch by clamping the work having seams with the presser foot, and has a width two to four times as large as the diameter of the needle drop hole.

19. A seam puckering preventing shuttle device of a sewing machine as set forth in claim 14, wherein, the work is advanced stitch by stitch by a feed dog by clamping the work on the throat plate between a presser foot and the feed dog, and by taking up the upper thread by a thread take-up lever for guiding in and out the upper thread the full rotation hook; and wherein, at deceleration from the feeding speed to the feeding stop for the work having the seams to advance while being clamped on the feed dog by the presser foot, inertia does not cause the work to slide into a clearance formed between the throat plate and the presser foot raised by the feed dog and the work is not loosened by the cloth feed more than a necessary amount for one stitch, the presser foot being equipped, at an entrance portion thereof for the work, with a resilient member for constant contact with the work before sewn.

20. A seam puckering preventing shuttle device of a sewing machine as set forth in claim 14 wherein the length of the needle defines an axis and wherein the rotation center of driven portions is axially opposite the upper dead center of the loop-taker point relative to the rotation center of the rotary member.

21. A seam puckering preventing horizontal shuttle device of a sewing machine, which uses an upper thread inserted into a needle moving upward and downward while drawing a trace vertically of a throat plate, and a lower thread accommodated in a full rotation horizontal hook, which is disposed below the throat plate and accommodates the lower thread, and which picks up the upper thread, at the time when the upper thread inserted into the needle extending through a work placed on the throat plate and performing reciprocating movements in the vertical direction is raised from the lower dead center of the needle for each feed of the work, with a loop-taker point of the full rotation horizontal hook to interlace the upper thread and the lower thread thereby to form lock stitches in the work, wherein the full rotation horizontal hook includes: an inner hook accommodating a shuttle bobbin having the lower thread wound thereon and fixed removably, and prevented from rotating relative to the frame by an inner hook stopper; and an outer hook mounting the inner hook therein, having the loop-taker point and rotated by a rotation driving portion;

wherein the inner hook is arranged to have its rotation center eccentric to the rotation center of the rotation driving portion so that an upper thread entrance and an upper thread exit are formed between the inner hook stopper and the inner hook at circumferentially different positions where clearances are formed to guide in and guide out the loop of the upper thread on the outer circumference of the inner hook after the loop of the upper thread picked up by the loop-taker point for every predetermined rotations of the outer hook rotationally driven was pulled out to the maximum by the outer circumference of the inner hook;

wherein the upper thread entrance is arranged in a rotational direction of 180 degrees to 210 degrees, of the loop-taker point from the needle drop point of the needle and at the position where the loop of the upper thread picked up by the loop-taker point is guided in on the outer circumference of the inner hook, whereas the upper thread exit is arranged in a rotational direction of 90 degrees to 180 degrees, from the upper thread entrance and at the position where the loop of the upper thread is guided out on the outer circumference of the inner hook and pulled upward of the throat plate; and wherein the rotation center of the inner hook is eccentric in the direction at the angular space between the upper thread entrance and the upper thread exit with respect to the rotation center of the rotation driving portion.

22. A seam puckering preventing shuttle device of a sewing machine as set forth in claim 21, wherein the inner hook includes a shuttle bobbin support pin erected at the center of an upward diverging housing portion for holding the shuttle bobbin, so that the shuttle bobbin may be prevented from being rotationally inscribed with the inner hook to rewind the lower thread from the bobbin, and so that the bobbin may be prevented from being rotationally inscribed with the housing portion to float.

23. A seam puckering preventing shuttle device of a sewing machine as set forth in claim 21 comprising, for balancing the tension of the upper thread with the tension of the lower thread guided out from the shuttle bobbin to thereby stabilize the interlace point between the upper thread and the lower thread:

a thread deflection conduit;

a thread tension balancing device; and wherein, the upper thread is inserted from a spool through the thread deflection preventing conduit and the thread tension balancing device into the needle thereby to fix the thread tension of the thread tension balancing device, so that the pulsations of the upper thread, as might otherwise be caused by taking or pulling up the upper thread by a thread take-up lever when the upper thread is guided in and out of the full rotation hook, are suppressed.

24. A seam puckering preventing shuttle device of a sewing machine as set forth in claim 21, wherein, the work is advanced stitch by stitch by a feed dog by clamping the work on the throat plate between a presser foot and the feed dog, and by taking up the upper thread by a thread take-up lever for guiding in and out the upper thread on the full rotation hook; and wherein the feed dog extends through the center of a needle drop hole of the needle for advancing the work stitch by stitch by clamping the work having seams with the presser foot, and has a width two to four times as large as the diameter of the needle drop hole.

25. A seam puckering preventing shuttle device of a sewing machine as set forth in claim 21, wherein, the work is advanced stitch by stitch by a feed dog by clamping the work on the throat plate between a presser foot and the feed dog, and by taking up the upper thread by a thread take-up lever for guiding in and out the upper thread the full rotation hook; and wherein, at deceleration from the feeding speed to the feeding stop for the work having the seams to advance while being clamped on the feed dog by the presser foot, inertia does not cause the work to slide into a clearance formed between the throat plate and the presser foot raised by the feed dog and the work is not loosened by the cloth feed more than a necessary amount for one stitch, the presser foot being equipped, at an entrance portion thereof for the work, with a resilient member for constant contact with the work before sewn.

* * * * *

UNITED STATES PATENT AND TRADEMARK OFFICE

CERTIFICATE OF CORRECTION

PATENT NO. : 7,490,567 B2
APPLICATION NO. : 10/571921
DATED : February 17, 2009
INVENTOR(S) : Kouichi Sakuma It is certified that error appears in the above-identified patent and that said Letters Patent is hereby corrected as shown below:

Column 47, line 26 (claim 2, line 10), "the a thread" should read -- the thread --;
line 32 (claim 2, line 16), "hook are" should read -- hook, are --;
line 43 (claim 3, line 11), "times, as" should read -- times as --; and
line 59 (claim 4, line 15), "equipped at" should read -- equipped, at --.

Column 49, line 34 (claim 9, line 15), "hooks" should read -- hook --; and
line 51 (claim 9, line 31), "a the driving" should read -- a driving --.

Column 50, line 53 (claim 13, line 2), "4" should read -- 9 --;
line 65 (claim 14, line 8), "needle1" should read -- needle -- ; and
line 67 (claim 14, line 10), "direction 1" should read -- direction --.

Column 51, line 19 (claim 14, line 29), "a the driving" should read -- a driving --.

Signed and Sealed this

Fourteenth Day of July, 2009

JOHN DOLL
*Acting Director of the United States Patent and Trademark Office*